US006879793B2

(12) United States Patent
Chiba et al.

(10) Patent No.: US 6,879,793 B2
(45) Date of Patent: Apr. 12, 2005

(54) METHOD FOR FORMING IMAGE

(75) Inventors: Tatsuhiko Chiba, Kanagawa (JP); Michihisa Magome, Shizuoka (JP); Keiji Komoto, Shizuoka (JP); Kaori Hiratsuka, Shizuoka (JP); Takeshi Kaburagi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/463,421

(22) Filed: Jun. 18, 2003

(65) Prior Publication Data

US 2004/0018028 A1 Jan. 29, 2004

(30) Foreign Application Priority Data

Jun. 19, 2002 (JP) ..... 2002-179153

(51) Int. Cl.[7] ..... G03G 15/30
(52) U.S. Cl. ..... 399/149; 399/150
(58) Field of Search ..... 399/130, 149, 399/150; 430/105, 107, 111, 120

(56) References Cited

U.S. PATENT DOCUMENTS

| | | | | |
|---|---|---|---|---|
| 4,664,504 A | | 5/1987 | Oda et al. | 355/15 |
| 4,769,676 A | | 9/1988 | Mukai et al. | 355/15 |
| 4,851,960 A | | 7/1989 | Nakamura et al. | 361/225 |
| 5,432,037 A | | 7/1995 | Nishikiori et al. | 430/126 |
| 5,659,852 A | * | 8/1997 | Chigono et al. | 399/175 |
| 5,976,755 A | | 11/1999 | Yoshida et al. | 430/126 |
| 6,081,681 A | | 6/2000 | Nagase et al. | 399/174 |
| 6,128,456 A | | 10/2000 | Chigono et al. | 399/176 |
| 6,421,512 B2 | | 7/2002 | Watanabe et al. | 399/149 |
| 2001/0016127 A1 | | 8/2001 | Watanabe et al. | 399/149 |

FOREIGN PATENT DOCUMENTS

| | | |
|---|---|---|
| JP | 59-133573 | 7/1984 |
| JP | 62-203182 | 9/1987 |
| JP | 63-133179 | 6/1988 |
| JP | 63-149669 | 6/1988 |
| JP | 64-20587 | 1/1989 |
| JP | 2-302772 | 12/1990 |
| JP | 5-2289 | 1/1993 |
| JP | 5-53482 | 3/1993 |
| JP | 5-61383 | 3/1993 |
| JP | 5-150539 | 6/1993 |
| JP | 7-99442 | 10/1995 |
| JP | 10-307421 | 11/1998 |
| JP | 10-307455 | 11/1998 |
| JP | 10-307456 | 11/1998 |
| JP | 10-307457 | 11/1998 |
| JP | 10-307458 | 11/1998 |
| JP | 11-15206 | 1/1999 |
| JP | 2000-181200 | 6/2000 |
| JP | 2001-188416 | 7/2001 |
| JP | 2001-194864 | 7/2001 |
| JP | 2001-215798 | 8/2001 |
| JP | 2001-215799 | 8/2001 |
| JP | 2001-235897 | 8/2001 |
| JP | 2001-235899 | 8/2001 |

* cited by examiner

*Primary Examiner*—Hoan Tran
(74) *Attorney, Agent, or Firm*—Fitzpatrick, Cella, Harper & Scinto

(57) ABSTRACT

To provide a method for forming images in which the image bearing member and the toner carrying member are arranged with a gap of 100 μm to 250 μm, and the equation (1) and equation (2) are satisfied. (1) 22≦(the frequency of the alternating current component of the alternating electric field/the peripheral speed of the toner carrying member)×the maximum electric field intensity at the time of developing≦1.20. (2) 8≦(the frequency of the alternating current component of the alternating electric field/the peripheral speed of toner carrying member)×(the fluidity index of Carr/the floodability index of Carr)≦50. According to the method for forming images of the present invention, it is possible to obtain a high quality image without generating fog and light shielding while attaining a uniform halftone with a high image density even over long-term.

28 Claims, 6 Drawing Sheets

METHOD FOR FORMING IMAGE

BACKGROUND OF THE INVENTION

1. Field of the Invention

The present invention relates to a method for forming an image for eliciting an electrostatic latent image in electrophotography.

2. Description of the Related Art

In recent years, in the field of electrophotography, some currents of technologies have arisen in the light of miniaturization of a device, cost-effectiveness, environmental grounds, and so on. One of them is a technology called a cleaning simultaneous with development or cleanerless.

In the conventional electrophotographic process, a residual toner remained on a latent image bearing member after transferring toner onto a recording medium. The toner is then removed therefrom at a cleaning step by anyone of various methods, wherein the removed residual toner is accumulated into a waste toner container as waste toner. A method for image forming, in which the above steps were repeated through the cleaning step, have been used. For such a cleaning step, conventionally, blade cleaning, fur brush cleaning, roller cleaning, and so on have been used. These methods are designed to scratch the residual toner forcefully, or to dam back and recover the residual toner into a waste toner container. Therefore, there is a problem caused by pressing such a member used for cleaning the residual toner against the surface of the latent image bearing member. For example, the member being strongly pressed against the latent 1 image bearing member causes wearing of the latent image bearing member and shortening of life thereof. From the point of view of the device, the installation of a cleaning mechanism into a device inevitably leads to enlargement of such a device, hindering miniaturization of the device. Furthermore, a system that does not generate waste toner while having excellent fixation and offset-proof properties has been desired from the viewpoint of saving resources, reduction in waste and effective use of toner.

On the other hand, as a system that does not generate waste toner, technologies called cleaning simultaneous with development or cleanerless have been also proposed in the art. For example, the technologies about cleanerless have been disclosed in JP 59-133573 A, JP 62-203182 A, JP 63-133179 A, JP 64-20587 A, JP 2-302772 A, JP 5-2289 A, JP 5-53482 A, JP 5-61383 A, and so on.

Furthermore, there is a technology of contact charging as an ecology technique about charging.

In electrophotography, a typical method for forming an electrical latent image is one comprising allowing uniform charging to a predetermined polarity and potential on the surface of a photoconductor utilizing a photoconductive material as a latent image bearing member and subjecting the charged photoconductor to an image-pattern exposure to form an electric latent image.

Conventionally, a corona charging device (a corona discharging device) has been used frequently as a charging device that carries out a charging treatment (also including an electric discharge treatment) on the surface of a latent image bearing member to charge it uniformly with a desired polarity and potential. The corona charging device is a non-contact charging device and includes a discharge electrode such as a wire electrode and a screening electrode surrounding the discharge electrode. Furthermore, the corona charging device has a discharge opening being formed to face an image bearing member which is provided as an object to be charged. The surface of the image bearing member can be charged to a desired polarity and potential by subjecting the surface to a discharge current (a corona shower) which is generated by the application of a high voltage to both the screening electrode and the discharge electrode.

In recent years, various kinds of contact charging devices have been proposed and put in practical use as charging devices for objects to be charged such as a latent image bearing member because of their advantages such as low generation of ozone and a low requirement on electric power, compared with a corona charging device.

A contact charging device is to charge the surface of an object to be charged to desired polarity and potential by bringing a conductive charging member (a contact charging member or a contact charging device) such as a roller type (charging roller), a fur brush type, a magnetic brush type, and a blade type into contact with the charging object such as an image bearing member to allow the application of a predetermined charging bias to the contact charging member.

In the charging mechanism (the mechanism of charging, and the principle of charging) of the contact charging, two kinds of charging mechanisms: (1) a discharge-charge mechanism; and (2) a direct-injection charging mechanism, are intermingled, and each characteristic appears depending on which mechanism is dominant in the contact charging.

(1) Discharge-charge Mechanism

It is the mechanism in which the surface of a charging object is charged according to the discharge phenomenon produced in a minute gap between the contact-charging member and the object to be charged. The discharge-charge mechanism has the fixed discharge thresholds of the contact-charging member and the object to be charged, so that there is a need to apply a voltage larger than the charging potential to the contact-charging member. In addition, even though the amount of the resulting discharged product is remarkably small as compared with a corona charging device, theoretically, the generation of the discharged product is hardly avoidable. Thus, a trouble to be caused by an active ion such as ozone will be inevitable.

(2) Direct-injection Charging Mechanism

It is a system in which the surface of an object to be charged is charged by directly injecting an electrical charge into the object to be charged from the contact-charging member. Alternatively, the mechanism may be called a direct charging, injection charging, or charge-injection charging. In more detail, the contact-charging member of an intermediate resistance contacts the surface of the object to be charged and injects electrical charges directly into the surface of the object to be charged. At this time, basically, a discharge phenomenon is not used (i.e., discharge does not occur). Therefore, even if the applied voltage to the contact-charging member is equal to or below a discharge threshold, the object to be charged can be charged to the electric potential corresponding to the applied voltage. As this charging system does not involve the generation of ions, there is no trouble to be caused by the discharged product. However, because of the properties of the direct-injection charging, the contact ability of the contact-charging member with the object to be charged is greatly effective against the charging property. Therefore, in order that the contact-charging member is constructed such that it is brought into contact with the charging object at a higher frequency, there is a need of designing the contact-charging member to have denser contacting points with the object to be charged, to make the difference in rotating speed between the contact-charging member and object to be charged larger, and so on.

For the contact-charging device, a roller charging system using a conductive roller (a charging roller) as a contact-charging member is preferable in respect of the stability of charging and is widely used.

In a charging mechanism used in the conventional roller-charging, the discharge-charge mechanism of the above item (1) is dominant.

A charging roller is produced using a rubber or foam material which is conductive or has an intermediate resistance. In addition, some rollers are constructed by laminating the materials so as to have desired characteristics.

Furthermore, the charging roller has its own elasticity so as to have a constant contacting status with the charging object. Therefore, the frictional resistance thereof is large. In many cases, furthermore, the charging roller is driven by the object to be charged or with a little speed difference therewith. Therefore, even if direct-injection charging is about to be carried out, a decrease in absolute charging ability, an insufficient contact ability, contact unevenness attributed to the form of the roller, and charging unevenness due to deposit on the object to be charged are unavoidable.

FIG. 1 is a graph that represents an example of charge efficiency of the contact charging in the electrophotographic method. The horizontal axis indicates a bias applied to the contact-charging member and the vertical axis indicates the charged potential of the object to be charged (hereinafter, also referred to as a photosensitive member) obtained at the time. The charging characteristics of the photosensitive member when the roller-charging is used are denoted by the letter "A". The charging is initiated at a potential over a discharge threshold of about −500 V. Therefore, for charging the photosensitive member at −500 V, typically, the application of a DC voltage of −1,000 V or the application of an AC voltage with a peak-to-peak voltage of 1200 V so as to constantly keep the potential difference equal to or more than the discharge threshold in addition to the DC charging voltage of −500 V is commonly performed to converge the potential of the photosensitive member to the charged potential.

More specifically, in the case where a charging roller is brought into contact with an OPC photosensitive member of 25 $\mu$m in thickness by pressurizing, when the voltage of about 640 V or more is applied, the surface potential of the photosensitive member will begin to rise. After rising, the surface potential of the photosensitive member increases linearly with an inclination of 1 with respect to the applied voltage. Here, this threshold voltage is defined as a charging-initiation voltage Vth.

In other words, for providing the photosensitive member with the surface potential Vd to be required in the electrophotographic method, the charging roller requires that a DC voltage which is equal to or higher than the sum of the surface potential and the charging-initiation voltage (Vd+Vth) is applied. Thus, a charging, method in which the charging is performed by applying only DC voltage to the contact-charging member is referred to as "a DC charging system".

However, in the DC charging system, the resistance value of the contact-charging member varies as its environmental conditions, etc. are changed. In addition, the thickness of the photosensitive member is changed as the photosensitive member is shaved, so that the Vth of the contact-charging member can be also fluctuated. Therefore, it is difficult to adjust the potential of the photosensitive member to a desired potential.

For this reason, as disclosed in JP 63-149669 A, the "AC charging system" has been used for attaining further equalization of charging. The "AC charging system" applies to the contact charging member a voltage obtained by superimposing the AC component of the peak-to-peak voltage of 2×Vth or more on the DC voltage corresponding to the desired Vd. This aims at "equalizing effects" of the potential with AC. Therefore, the potential of the object to be charged is converged on the Vd in the middle of the peak of the AC voltage. The potential is not influenced by any disturbance from its surroundings such as environmental one.

However, even in the contact-charging device, its essential charging mechanism utilizes the discharge phenomenon from the contact-charging member to the photosensitive member. Therefore, as described above, the voltage to be applied to the contact-charging member should be equal to or higher than the surface potential of the photosensitive member, and a trace amount of ozone is generated.

When the AC charging is performed for charge equalization, further generation of ozone, the generation of oscillation noises from the contact-charging member and the photosensitive member in the electric field of the AC voltage (AC charging noise), a deterioration in the surface of the photosensitive member due to discharge, and the like occur remarkably, thereby causing new problems.

Furthermore, the fur-brush charging uses a member (a fur brush-charging device) having a brush part constructed of conductive fibers as a contact-charging member. The conductive fiber brush part is brought into contact with the photosensitive member provided as an object to be charged to charge the surface of the photosensitive member to the desired polarity and potential by applying a predetermined charging bias. The discharge-charge mechanism of the above item (1) is dominant in the charging mechanism of the fur-brush charging.

For the fur brush-charging device, there are two different types, namely a fixed type and a roll type, which have been practically used in the art. The fixed type fur brush-charging device is constructed such that fibers of intermediate resistance are woven in a base fabric in the shape of a pile and are then fixed on an electrode. On the other hand, the roll type one is constructed such that a pile is twisted around a core metal. In this case, the fur brush-charging device having a fiber density of about 100/mm$^2$ can be prepared with comparative ease. However, the contact ability is still inadequate for attaining sufficiently uniform charging by direct-injection charging. In addition, for attaining sufficiently uniform charging with direct-injection charging, it is necessary to differ the rotating speed of the fur brush-charging device from that of the photosensitive member, which is hardly attained by the mechanical configuration thereof and is not realistic.

The charging characteristics of the fur brush-charging at the time of applying the DC voltage can be represented as shown by "B" in FIG. 1. Therefore, in the case of the fur brush-charging as well, the charging Is often performed using a discharge phenomenon with a high charging bias in both the fixed type and the roll type of the fur brush-charging.

On the other hand, magnetic brush charging uses a member (a magnetic brush charging device) having a magnetic brush part as a contact-charging member, in which conductive magnetic particles are magnetically trapped into a brush shape by a magnet roll or the like. The magnetic brush part is brought into contact with the photosensitive member provided as an object to be charged to charge the surface of the photosensitive member to the desired polarity and potential by applying a predetermined charging bias.

In the case of magnetic brush charging, the direct-injection charging mechanism of the above item (2) is dominant in the charging mechanism.

The conductive magnetic particles that constitute the magnetic brush part are those having grain sizes in the range of 5 to 50 $\mu$m. In addition, providing the magnetic brush charging device with a sufficient rotating speed different from that of the photosensitive member allows uniform direct-injection charging.

As is represented by "C" in the graph of the charging characteristics of FIG. 1, it becomes possible to obtain the charged potential almost proportional to the applied bias.

However, in this case, there are several disadvantages such as a complicated configuration of the device and the adhesion of conductive magnetic particles composing the magnetic brush part, which have fallen to the surface of the photosensitive member.

Here, the case is considered in which these contact-charging methods are applied in the cleaning simultaneous with development method or the cleanerless image forming method as described above.

The cleaning simultaneous with development method or the cleanerless image forming method does not use a cleaning member. Thus, the transfer residual toner on the photosensitive member directly contacts the contact-charging member, so that the toner may be adhered to or mixed in the contact-charging member. Furthermore, in the case of the charging method in which the discharge-charge mechanism is dominant, the adhesion property of the toner with respect to the charging member becomes worse due to toner deterioration caused by the discharge energy. When the insulating toner typically used in the art is adhered to or mixed in the contact-charging member, the charging property of the object to be charged is degraded.

In the case of the charging method in which the discharge-charge mechanism is dominant, such degradation in the charging property of the object to be charged occurs suddenly at the time when the toner layer adhering to the surface of the contact-charging member becomes a resistance that blocks the discharge voltage. On the other hand, in the case of the charging method when the direct-injection charging mechanism is dominant, the transfer residual toner adhered to or mixed in the contact-charging member reduces the contact probability of the surface of the contact-charging member and the object to be charged, thereby degrading the charging property of the object to be charged.

The degradation in the uniform charging property of the object to be charged leads to a degradation in contrast and uniformity of the electrostatic latent image after the image exposure, resulting in a decrease in the image density while worsening the fog.

Furthermore, in the cleaning simultaneous with development method or the cleanerless image forming method, it is important that the charging polarity and the charge amount of the transfer residual toner on the photosensitive member are controlled to stabilize the recovery of the transfer residual toner in the step of development so that the deterioration of the development characteristics due to the recovered toner is prevented. Therefore, the charging member is responsible for controlling the charging polarity and the charge amount of the transfer residual toner.

The behavior of the toner before and after the step of image transfer will be described with reference to the example using a common laser printer. In the case of a reversal development using a charging member that applies a negative polarity voltage, a photosensitive member having a negative charging property, and toner having negative charging property, a visualized image is transferred onto a recording medium by a transfer member having a positive polarity. Here, the charging polarity of the transfer residual toner varies from positive to negative depending on, for example, the relationship between a type of recording medium (difference in thickness, resistance, dielectric constant, etc.) and image area. However, even if the transfer residual toner together with the surface of the photosensitive member are shifted to the positive polarity side in the step of transfer, due to the charging member having a negative polarity at the time of charging the photosensitive member having the negative charging property, the charging polarity of the transfer residual toner can be uniformly set to the negative side. Therefore, in the case of using reversal development as a developing method, the negatively charged transfer residual toner remains on a bright section potential part where the toner should be developed. In this case, on the other hand, on the dark section potential part where the toner should not be developed, the transfer residual toner is pulled toward the toner carrying member in relation to a developing electric field and can be recovered without remaining on the photosensitive member having a dark section potential. Therefore, the cleaning simultaneous with development or the cleanerless image forming method are achieved by controlling the charging polarity of the transfer residual toner simultaneously with charging property of the photosensitive member by the charging member.

However, it becomes difficult to recover the toner by the developing member when the amount of the transfer residual toner adhered on or mixed in the contact-charging member exceeds the amount in which the contact-charging member can control the charged polarity of the toner because the charged polarities of the transfer residual toner cannot be set uniformly. In addition, the charging properties of toner on the toner carrying member may be affected when the uniform charging is not achieved over the transfer residual toner even though the transfer residual toner is recovered on the toner carrying member by mechanical force such as sliding friction. Thus, the development characteristics may be decreased.

In other words, in the cleaning simultaneous with development or the cleanerless image forming method, the charge-control characteristics when the transfer residual toner passes through the charging member and the characteristics of adhering on or mixing in the charging member are related closely to durability and image quality.

In terms of the adhesion and mixing characteristics of the transfer residual toner to the charging member, many techniques relating to the charging process have been disclosed.

Disclosed in JP 7-99442 B is the configuration in which powders are applied on the surface of the contact-charging member, of which the surface is in contact with the surface of the object to be charged, for preventing the charging unevenness and providing uniform charging in a stable manner. However, the rotation of the contact-charging member (charging roller) is driven by the object to be charged (photosensitive member) (no driving with speed difference). Even though the generation of the ozone product is extremely decreased as compared with the corona charging device such as a scorotron, the charging principle is still based on the discharge-charge mechanism just as in the case of the roller-charging described above. In particular, for obtaining more stable charging uniformity, the application of the voltage is performed such that the AC voltage is superimposed on the DC voltage. Thus, the generation of the ozone product by discharge may be increased. Therefore, when the device is used for a long time, the problem such as an image flow caused by the ozone product tends to occur. Furthermore, when it is applied to the cleanerless image forming apparatus, it becomes difficult to adhere the applied powders uniformly on the charging member because of the mixing of the transfer residual toner, so that the effect of allowing uniform charging becomes decreased.

In JP 5-150539 A, there is disclosed a method for image forming using contact charging, in which toner includes at least image-manifesting particles and conductive particles having an average particle size smaller than that of the image-manifesting particles, for preventing the charge inhibition to be caused by adhesion or accumulation of toner particles or silica fine particles which could not be removed by blade cleaning on the surface of the charging means after repeating image formation in the long term. However, the contact charging or the adjacent charging used herein is based on the discharge-charge mechanism, so that there arises the problem resulting from not the direct-injection charging mechanism but the discharge-charging as described above. In the case of application to the cleanerless image forming apparatus, as compared with one having a cleaning mechanism, an influence on the charging property, which is caused by a large amount of conductive fine particles and transfer residual toner undergoing the charging process, and the recovering property with respect to a large amount of the conductive fine particles and the transfer residual toner in the development process, and an influence on the development characteristics of toner with the recovered conductive fine particles and the transfer residual toner are not considered. Furthermore, in the case of applying the direct-injection charging mechanism on the contact charging, a required amount of the conductive fine particles is not supplied to the contact-charging member, so that the charging failure may be caused due to an influence of the transfer residual toner.

Furthermore, in the case of the adjacent charging, it is difficult to uniformly charge the photosensitive member in the presence of a large amount of the conductive fine particles and the transfer residual toner. There is no effect of leveling the pattern of the transfer residual toner, so that a pattern ghost for shielding the pattern image exposure of the transfer residual toner will be caused. Furthermore, upon the instantaneous interruption of a power source or a paper jam during the image formation, the contamination inside the device with toner becomes remarkable.

Furthermore, disclosed, for example, in JP 2001-188416 A, JP 2001-215798 A, and JP 2001-215799 A, is a method of image forming with cleaning simultaneous with development, in which the transfer residual toner recovering property in the development is assisted or controlled using a roller member, fur brush or the like to be contacted against the photosensitive member or the charging member during a period between the transferring process and the charging process. Such a kind of the Image forming apparatus has a favorable cleaning-simultaneous-with-development property and is capable of extensively decreasing the amount of waste toner. In this case, however, the advantages of the cleaning simultaneous with development are impaired in that its cost becomes high and it cannot be designed to be smaller.

On the other hand, for example, in JP 10-307456 A, JP 10-307421 A, JP 10-307455 A, JP 10-307457 A, JP 10-307458 A, and JP 10-307456 A, there is disclosed a method for forming an image with cleaning simultaneous with development, in which the conductive particles are directly applied to the charging member with specific grain size or are continuously supplied to the charging member in an indirect manner by externally adding the conductive particles to the toner. In these methods, at the initial stage of printing, a good image can be obtained without causing at least defective charging and light shielding upon the image exposure. Therefore, regarding the above proposal, further improvements have been required and possible in the performances when toner particles having smaller particle size are used for improving the stability in long-term repetitive usage and increasing a resolution.

Furthermore, even though there is a need for improvement of toner in consideration of transfer, charging, and recovering properties, in the prior art, there is no description about a preferable configuration of toner and no consideration with respect to durability and charging stability against the change in printing ratio, resulting in the insufficient ones.

For example, in each of JP 59-133573 A, JP 62-203182 A, JP 63-133179 A, JP 64-20587 A, JP 2-302772 A, JP 5-2289 A, JP 5-53482 A, JP 5-61383 A, and JP 2001-194864 A, there is no description about a favorable method of image forming. In addition, there is no description about the configuration of toner.

In JP 2001-188416 A, JP 2001-215798 A, JP 2001-215799 A, and so on, there is proposed a contact-charging cleanerless system using a two-component developing system. In this proposed system, effects can be surely obtained to a certain degree with respect to charging defect. However, the photosensitive member originally tends to be chipped by sliding friction with the ears of carriers in the two-component development. Since it is easy to generate especially the half-tone unevenness resulting from a deep blemish or the like, a further improvement also from the viewpoint of the photosensitive member service life and so on is needed.

Furthermore, as disclosed in JP 2000-181200 A, another system is proposed such that the polarity of toner is controlled by making a toner-scraping member contact to the charging roller to increase the toner recovering ability. With this method, it is surely possible to improve the toner recovering ability at an initial stage of the process. Even though toner recovering ability is improved, there is a need that the residual toner passes through the gap between the charging member and the toner image bearing member. Therefore, there is a tendency of causing aggregation and fusion of toners. In other words, as It results in the occurrence of light shielding, fusion, and so on, a further improvement is required.

The charge control characteristics of the transfer residual toner when it passes through the charging member are improved to enhance the cleaning-simultaneous-with-development performance as disclosed in JP 11-15206 A. That is, there is proposed a method of image forming using toner including toner particles containing a specific carbon black and a specific azo-based iron compound and inorganic fine particles. Furthermore, in the method of image forming with cleaning simultaneous with development, it is also proposed that the cleaning simultaneous with development performance is improved by decreasing the amount of the transfer residual toner with toner excellent in transfer efficiency which specifies the shape factor of toner.

However, the contact charging used here is also based on the discharge-charge mechanism, and has the above-mentioned problem caused not by direct-injection charging mechanism but by discharge-charging. Furthermore, these proposals attain the effects of suppressing a decrease in the charging properties of the contact-charging member in the presence of the transfer residual toner. In this case, however, the effects of positively increasing the charging property are not expectable.

Furthermore, in JP 2001-235897 A and JP 2001-235899 A, there is disclosed a method in which toner is used, which can improve the wear resistance of the surface of the photosensitive member by having no magnetic substance on the surface of the toner and is superior in transfer property and rigidity because of a specific circularity, in the adjacent or contact development method. In this method, the amount of the transfer residual toner is small, so that the inhibitory affect on the charging part is small and the recovering ability in the developing part is also excellent. In this case, however, the conductive particles on the surface of the toner tend to be peeled off because of its excellent fluidity. As a result, there newly causes another problem in that a decrease in the amount of conductive particles to be supplied is easily caused in the latter stage of the durability. In addition, the charging property is retained as the amount of the toner present in the charging part is extremely small. Therefore, toner contamination of the photosensitive member supposedly occurs by the generation of the so-called jam or the like, also in the processes subsequent to the transferring process. In such a case, variations of resistance on the charging part, inroads of toner, and so on are increased. As a result, recovery of the image from the charging defect status takes much time. Furthermore, there is a tendency of causing streak-like fog and unevenness on the half-tone image.

Furthermore, in recent years, there is a tendency of increasing the degree of toner fog resulting from insufficiency of the charging property, and the amount of the transfer residual toner, and widening the toner charging distribution due to the increasing requirement for the high Image quality along with a smaller toner particle size and an increase in print speed. However, there is no satisfactory toner having an appropriate developing property and the recovering ability or cleanerless image forming method, while considering the above facts.

SUMMARY OF THE INVENTION

An object of the invention is to provide a cleanerless image forming method capable of providing a high quality image without causing fog and light shielding, while providing a high image density and a uniform halftone, even if it is used for a long time.

The present invention relates to a method for forming image comprising the steps of: charging an image bearing member by applying a voltage on a charging member; forming an electrostatic latent image while writing image information as the electrostatic latent image on the charged image bearing member; developing the electrostatic latent image by magnetic toner carried on a toner carrying member to thereby form a toner image; and transferring the toner image onto a recording medium, the step of charging being carried out such that the charging member and the image bearing member move in opposite directions to each other so as to form a contact portion where the charging member and the image bearing member are brought into contact with each other, the step of developing Including cleaning for recovering the toner remained on the image bearing member without being transferred onto the recording medium in the transferring, as cleaning simultaneous with development, the method being characterized in that the toner carrying member is provided with a layer thickness regulating member so as to contact therewith; the image bearing member and the toner carrying member are arranged with a gap of 100 $\mu$m to 250 $\mu$m therebetween; the magnetic toner includes, toner particles containing at least a binder resin and a magnetic substance, and conductive fine particles; a maximum electric field intensity (V/$\mu$m) of an alternating electric field formed on the toner carrying member at the time of developing, a frequency (Hz) of an alternating current component of the alternating electric field, and a peripheral speed (mm/sec) of the toner carrying member satisfy a relationship represented by the following equation (1); and the frequency (Hz) of the alternating current component of the alternating electric field formed on the toner carrying member, the peripheral speed (mm/sec) of the toner carrying member, and a floodability index of Carr for the toner and a fluidity index of Carr for the toner satisfy a relationship represented by the following equation (2):

$$22 \leqq (\text{the frequency of the alternating current component of the alternating electric field/the peripheral speed of the toner carrying member}) \times \text{the maximum electric field intensity at the time of developing} \leqq 120; \text{ and} \quad (1)$$

$$8 \leqq (\text{the frequency of the alternating current component of the alternating electric field/the peripheral speed of the toner carrying member}) \times (\text{the floodability index of Carr/the fluidity index of Carr}) \leqq 50. \quad (2)$$

DETAILED DESCRIPTION OF THE INVENTION

Figure 1:
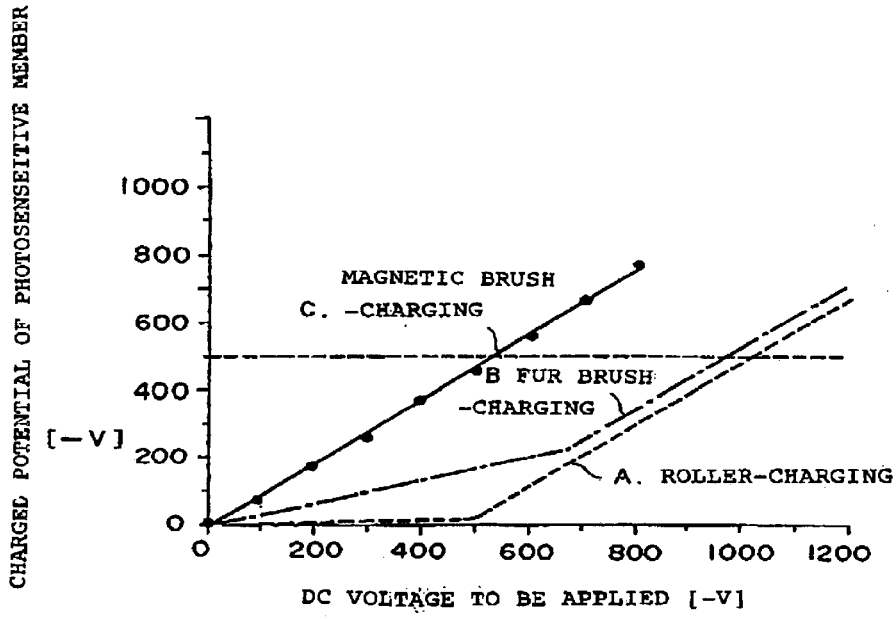
FIG. 1 is a graph showing an example of charging efficiency of contact charging in the photographic method.

The most important point to a magnetic one component cleanerless system is how to stabilize the charging. For this purpose, it is important to efficiently recover the toner remaining on the image bearing member while preventing the generation of fogging toner and transfer residual toner. Unless the remaining toner is well received, an increase in the generation of fog on paper is caused. In addition, uniform charging cannot be achieved with the toner remaining on the image bearing member, so that a high definition image will not be obtained, and image defects, such as poor charging, are produced.

The inventors of the present invention have made an intensive study and have found that the above-mentioned problems can be solved as described below. In a method for forming image including: a charging step in which a voltage is applied to a charging member to charge an image; an electrostatic latent image forming step in which image information is written as an electrostatic latent image on the charged image bearing member; a developing step in which a layer thickness regulating is brought into contact with the toner carrying member on which the toner is being carried and a toner layer is formed on the toner carrying member; and a transferring step in which the toner image is transferred onto a recording medium, (1) the toner of development means contains toner particles and the conductive fine particles, and the charging step is at least a step in which the charging member and the image bearing member are brought into contact with each other so as to form a contact portion while moving in the opposite directions to charge the image bearing member;

(2) the image bearing member and the toner carrying member are placed to arrange a constant gap to form a developing portion, and in the developing portion in which an alternate electric field is formed, the distance between the image bearing member and the toner carrying member is defined in the range of 100 $\mu$m to 250 $\mu$m;

(3) the maximum electric field intensity at the time of development of alternating electric field formed on this toner carrying member (V/$\mu$m), frequency (Hz) of alternating current component of the alternating electric field, and peripheral speed (mm/sec) of the toner carrying member satisfy the following relationship:

the value of (frequency of the alternating current component of the alternating electric field/peripheral speed of toner carrying member)×the maximum electric field intensity at the time of developing falls within the range of 22 to 120; and (4) the frequency (Hz) of the alternating current component of the alternating electric field formed on the toner carrying member (V/$\mu$m), the peripheral speed (mm/sec) of the toner carrying member, and the floodability index of Carr and fluidity index of Carr for the toner satisfy the following relationship:

the value of (frequency of the alternating current component of the alternating electric field/peripheral speed of toner carrying member)×(the floodability index of Carr/fluidity index of Carr) falls within the range of 8 to 50, thereby reaching the present invention.

As described above, in order to perform uniform charging, it is required to bring the charging member into contact with the image bearing member. Since the generation of ozone or the like can be controlled and it becomes hard to produce deterioration of the image bearing member by performing contact charging, a high definition image can be obtained also in a long-term activity. However, if the contact charging is performed in a cleanerless system, toner remaining on the image bearing member, such as the transfer residual toner and fogging toner, adheres to the charging member, and the uniformity of charging will be spoiled or poor charging will be caused, or the like. For this reason, in order to be charged stably, it is important to prevent the adhesion of an excess amount of toner between the charging member and the image bearing member at least. The inventors have been dedicated to making studies over and over and found out that, by combining the configuration of the toner which has the fluidity index/floodability index in the range of the present invention, and charging member which slides in the direction of a counter, the charge amount and coherence of toner in front of and behind a nip portion of the charging member were controllable, thereby reaching the present invention.

Figure 2:
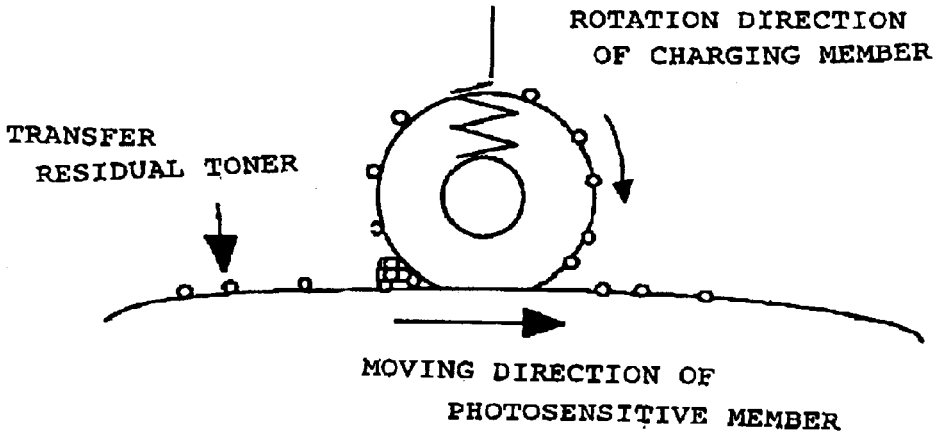
FIG. 2 is a schematic diagram showing a charging member and peripheral portions thereof applied in a method of image forming of the present invention.

The schematic diagram of the charging member nip portion of the present invention is shown in FIG. 2. As shown in this figure, in the present invention, the toner bank in front of the nip portion has arisen. The inventors think that the toner bank is able to raise the recovering ability of toner as compared with the former by decelerating the inrush speeds of the residual toner and the conductive fine particles to be transported to the image bearing member into the charging member. Furthermore, the present invention has an effect also on durable resistance change in the charging member. That is, in the present invention, the toner is softly recovered from the toner bank or the surroundings thereof in which the influence of linear load of the charging member is reduced. As a result, the deformation of toner or the toner embedding into a foaming member to be caused by the linear load of the charging member is considered to be reduced.

In addition, when residual toner itself is made to pile up temporarily, the residual toner (inversion toner) having the reversed charging properties relative to the regular toner adheres to the charging member electrostatically, and is then applied and injected into the regular polarity. The toner having the regular polarity and a lower charge amount also adheres physically to the charging member. Then, an appropriate charge amount is applied. Since the toner to which these regular and suitable charges are applied has the same polarity as that of the charging member, the toner is gradually discharged out by electrostatic repulsion from the charging member. For this reason, the present invention has the feature in which toner is recovered on the recess of charging member, and is easy to become an aggregate However, since the toner of the present invention has a moderate fluidity index, it becomes possible to reduce the phenomenon in which the discharged toner becomes an aggregate to pollute the image bearing member, and so on.

The toner has a regular moderate charge amount. Thus, in the developing portion, the same behavior as that of the development toner is carried out, and the toner is recovered by the alternating electric field of the developing portion.

Regarding the distance (between S–D) between the image bearing member of the above item (2) and the toner carrier, in combination with the toner of the present invention, the distance is required to be in the range of 100 $\mu$m to 250 $\mu$m, preferably 100 $\mu$m to 200 $\mu$m. Consideration of the relation between the distance between S–D and the fog on an image bearing member elucidated that, when the distance between S–D was large, fog to an image bearing member increased and the amount of inversion toner also increased.

The details about this reason are not clear. However, some degree of correlation can be observed between the dispersibility which is one of the coefficients in the toner floodability index of the present invention and the fluidity index. Thus, it is considered that the effects can be increased as follows. When the toner of the present invention, which is excellent in fluidability to some extent, and the developing conditions (after-mentioned) are combined, delivery of charging among the recovered toner and conductive fine particles, or toner fellow, tended to occur, and the distance between S–D extends further, thereby increasing the effect.

For stable charging, a decrease in the amount of the transfer residual toner or a decrease in the amount of the fogging toner is required. When there is much residual toner, the holdup volume in the charging member will increase too much. As a result, the balance between holdup and discharging will collapse. In particular, when the distance between S–D is large and the amount of the inversion toner is large, the inversion toner adheres to the charging member electrostatically. Therefore, the toner is not discharged from the charging member until a completely regular polarity charge is applied and infected. For this reason, it is easy to increase a holdup volume, which is not desirable. On the other hand, if the distance between S–D becomes narrow, the fogging toner on the image bearing member will decrease in number, and the inversion toner component decreases dramatically. Also, the charging member is not saturated with the toner which piles up therein, and the uniformity of charging is maintained. However, when the distance between S–D becomes nearer than 100 μm, the toner layer formed on the toner carrier will touch the image bearing member substantially. Therefore, physical fog by contacting and buildup of the charge leak by recovering paper powders with the toner will be caused. Therefore, it is important to define the distance between S–D in the range of 100 μm to 250 μm, preferably 100 μm to 200 μm.

Next, (3) will be explained. The value of (frequency of the alternating current component of an alternating electric field)/(peripheral speed of a toner carrying member))×(the maximum electric field intensity at the time of development) should be in the range of 22 to 120, preferably in the range of 30 to 105.

This is explained as follows. (Frequency of the alternating current component of an alternating electric field/peripheral speed of a toner carrying member) is considered to be the counts of amplitude of the developing in a developing area and pulls back. Further, the value is considered to be taken as the ease of carrying out of the developing in a developing area, and the ease of carrying out of recovery of residual toner by multiplying the maximum electric field intensity. In cleanerless, it is important that residual toner is recovered as described above. Thus, (frequency of the maximum electric field intensity at the time of development/peripheral speed of toner carrying member)×(the maximum electric field intensity at the time of developing), which is the measure of the recovering ability, is preferably larger. If it is less than 22 (preferably less than 30), the recovering ability decreases. On the other hand, if it is going to enlarge this value, it is possible to enlarge the frequency of the alternating current component of the alternating electric field applied to the toner carrying member, or to enlarge the maximum electric field intensity. However, when a frequency is enlarged, toner becomes hard to follow the bias. Thus, the amount of development falls and recovering ability tends to be insufficient, which is not desirable. Also, if the maximum electric field intensity is raised, fog increases and developing bias leaks by dielectric breakdown. Thus, an image cannot be obtained.

As described above, for attaining both good developing property and recovering ability, "(the frequency of the alternating current component of alternating electric field to be applied on the toner carrying member/peripheral speed of a toner carrying member)×(the maximum electric field intensity at the time of developing)" should be in the range of 22 to 120, preferably in the range of 30 to 105. The term "developing area" used herein means the area where toner flies onto the image bearing member substantially.

Next, regarding item (4), the value of "(frequency of the alternating current component of an alternating electric field/peripheral speed of toner carrying member)×(the floodability index of Carr/fluidity index of Carr)" should be in the range of 8 to 50, preferably in the range of 8 to 35.

The recovering ability of the toner in the present invention as described above is determined by the existence state of the residual toner around the nip portion of the charging member and the charging property. The ability to supply the residual toner to the charging member may be determined by the toner behavior such as the amount of the fogging toner/the amount of inversion component in the developing area and alternating developing bias to be applied to the toner carrying member.

Moreover, regarding the developing properties in durability, fogging and transferring properties are determined by the physical properties of the toner, such as magnetism and charging property, in addition to fluidity index, dispersibility, and so on of the invention.

Thus, in the cleanerless system, the balance of toner physical properties including the developing property and the recovering ability besides the process-elements, such as charging conditions and developing conditions, are needed. Then, the relation between the amount of toner which piles up in charging member and toner physical properties, the amount of inversion components/the amount of fog in the developing portion, and so on were examined. It became clear that the applicability of the process-element of development and recovery spread by making the value of a relationship (the floodability index of Carr/fluidity index of Carr) including the above-mentioned fluidity/floodability into the fixed range. In the case of the toner of the present invention, if the value of (the floodability index of Carr/the fluidity index of Carr) is large, lowering of a compression rate, the degree of condensation, buildup of dispersion, and so on will mainly arise. The amounts of residual toner, such as an inversion component and fog, increase, and consolidation is further easy to be carried out. There are many holdups and poor discharge ability, and the toner tends to be further aggregated. The light shielding to the image bearing member resulting from an aggregate, the saturation of the charging member with residual toner, regular charging of inversion toner, and the inhibition of an appropriate application of charge amount to the residual toner with an insufficient charge amount are expected. On the other hand, when the value of (the floodability index of Carr/fluidity index of Carr) is small, the toner will excel in fluidity too much. The toner holdup in nip portion-bank of the charging member decreases as a result. Further, part of the toner passes through the nip portion. Therefore, in this case as well, decreases in the charging stability and recovering ability are expected.

Then, (floodability index of Carr/the fluidity index of Carr) and recovering ability were further investigated. It is found that the value of the product of this value and the value of (a frequency of the alternating current component of an alternating electric field/peripheral speed of a toner carrying member) which is the receiving side of bias in the developing area, relates to the recovering ability of the toner. The reason for this is not certain. However, when (the floodability index of Carr/fluidity index of Carr) is made into a specific value, the residual toner has a charge amount that is suitable for recovery since the toner has a moderate holdup in the charging member; the ears of the toner on a toner carrying member become very uniform, and a developing area spreads; and the toner takes behavior suitable for recovery under specific recovery bias conditions.

If the value for (the frequency of the alternating current component of the alternating electric field/peripheral speed of toner support)×(the floodability index of Carr/fluidity index of Carr) is less than eight, it means that (the floodability index of Carr/fluidity index of Carr) is small, or that the frequency of the alternating current component of the alternating electric field is small. In the former case, as already stated, the residual toner on the image bearing member tends to pass through the charging member, and sufficient charge cannot be obtained. As a result, the recovering ability will be decreased. In the latter case, generally, in jumping developing, when the frequency at the time of developing is low, there is a tendency to cause an increase in the amount of fog. For this reason, the total amount of the residual toner which rushes into the charging member will increase, and the charging member is saturated. Therefore, recovering ability of the residual toner is considered to be reduced.

On the other hand, if the value of (frequency of the alternating current component of the alternating electric field/peripheral speed of toner carrying member)×(the floodability index of Carr/fluidity index of Carr) is larger than 50 (preferably larger than 35), it suggests that (the floodability index of Carr/fluidity index of Carr) is large, that the frequency of the alternating current component of the alternating electric field applied to the toner support is large, or that values may be large. Also in this case, events identical to those of the above explanation occur, thereby decreasing the recovering ability of toner.

As described above, in the method for image forming including at least: a charging step in which a voltage is applied to a charging member to charge an image bearing member; an electrostatic latent image forming step in which image information is written as an electrostatic latent image on the charged image bearing member; a developing step in which a layer thickness regulating member is brought into contact with a toner carrying member on which the toner is being carried to form a toner layer on the toner carrying member; and a transferring step in which toner image is transferred onto a recording medium, (1) the toner contains toner particles and conductive fine particles, and the charging step is a step in which the charging member and the image bearing member are brought into contact with each other so as to form a contact portion while moving in the opposite directions to charge the image bearing member, so that the residual toner is applied with a regular and appropriate charge amount;

(2) the image bearing member and the toner carrying member are placed as to arrange a constant gap to form a developing portion, and the amount of fogging toner is reduced in the developing portion in which an alternate electric field is formed by making the distance between the image bearing member and the toner carrying member fall in the range of 100 μm to 250 μm;

(3) the value of (frequency of the alternating current component of the alternating electric field/peripheral speed of toner carrying member)×(the maximum electric field intensity at the time of development) is defined in the range of 22 to 120 to utilize the developing bias that provides a good developing property and recovering ability; and (4) the value of (frequency of the alternating current component of an alternating electric field/peripheral speed of toner carrying member)×(floodability index of Carr/fluidity index of Carr) is defined in the range of 8 to 50 to adjust the holdup of the toner being held up in the charging member. These four synergistic effects allow excellent charging stability, even after long term use in a cleanerless system, and allow to obtain a high definition image.

The toner of the present invention may have a weight particle size of preferably in the range of 3 μm to 12 μm, more preferably in the range of 4 μm to 10 μm for consistently developing a more minute latent image dot to provide a high-quality image. When the weight average particle size of the toner is less than 3 μm, the transfer efficiency falls, so that the amount of the transfer residual toner on the photosensitive member increases. As a result, charge stability falls. Moreover, the fluidity and stirring property of fine particles fall. Thus, it becomes difficult to charge the respective toner particles uniformly. In addition, the amount of the magnetic substance contained in one toner particle decreases. Therefore, an increase in fog is caused, which is not preferable.

On the other hand, when the weight average particle size of toner exceeds 12 μm, spilling is readily generated in an alphabetic character or a line image, and high resolution is difficult to obtain. If the resolution of the device furthermore becomes high, in the case of the toner having a weight average particle size of 12 μm or more, the rendering of 1 dot will tend to deteriorate.

As for the magnetic toner of the present invention, it is preferred that the ratio of a weight average particle size/number average particle size is 1.40 or less, and 1.35 or less more preferably. The ratio of a weight average particle size/number average particle size of larger than 1.40 means that the particle size distribution of toner is large. Therefore, it becomes easy to produce selective development. In a long-term activity, aggravation of transfer property or fog is easily caused.

Here, although the average particle size and the particle size distribution of toner are measurable by various methods, such as a Coulter counter TA-II type or Coulter multiple sizer (made by Beckman Coulter, Inc.), the Coulter multiple sizer (made by Beckman Coulter, Inc.) is used in the present invention. In addition, an interface (made by Nikkaki Co., Ltd.) and a PC9801 personal computer (made by NEC), which output number distribution and volume distribution are connected, and, as an electrolyte, a 1% NaCl aqueous solution is prepared using the 1st class sodium chloride. For example, ISOTON R-II (made by Coulter scientific Japan) can be used.

As a measuring method, 0.1 ml to 5 ml of a surfactant, preferably alkylbenzene sulfonate, is added as a dispersant in the electrolyte aqueous solution (100 ml to 150 ml), and furthermore 2 mg to 20 mg of a measurement sample is added. The electrolyte suspended with the sample is subjected to a dispersion treatment with an ultrasonic dispersion device for about 1 to 3 minutes. Next, volume distribution and number distribution are computed by measuring the volume and the number of toner particles each having a size of 2 μm or more by the Coulter multiple sizer (100 μm aperture is used as an aperture). Then, the weight average paraticle size (D4) of the volume basis obtained from the volume distribution, and the length average particle size of the number basis obtained from the number distribution, that is, the number average particle size m (D1) are obtained. The same measurements are performed in the following example.

As for the toner used in the method for forming image of the present invention, it is preferred that the value of (floodability index of Carr/the fluidity index of Carr) falls in the range of 0.8 to 2.0, preferably 1.0 to 1.5. As described above, there is a correlation between the floodability index of Carr/the fluidity index of Carr and the amount of supply or the holdup of the residual toner of the charging member. However, as described above, even if there are too many holdups or too few holdups, good recovering ability of the residual toner cannot be expected. In view of this, in order to obtain a stable image over long-term activity, it is important to have the toner offer suitable residence time in the charging member, and to balance uptake and discharge. For that purpose, it may be important that (the floodability index of Carr/fluidity index of Carr) falls within the above range. Here, a toner formula such as the class, an amount, and hardness of inner additive agents such as a wax of toner, a colorant, a charge control agent, and a binder resin, and external additive, and toner/external additive form participate in the floodability index of Carr and the fluidity index of Carr. However, the indices tend to depend on the amount of a surface treating agent of a magnetic substance, for example, a polysiloxane compound, especially in magnetic toner with a high specific gravity.

The reason why the presence of a polysiloxane compound in toner can control the value of (the floodability index of Carr/the fluidity index of Carr) is not certain. However, this is probably because the presence of a part of the polysiloxane compound of the toner surface changes the surface tension, thereby changing the fluidity, angle of repose, angle of rupture, etc. of the toner. If the amount of the polysiloxane in the toner is less than 0.01% by mass, the value of (the floodability index of Carr/the fluidity index of Carr) will tend to become low, and if the amount is more than 0.20% by mass, the value of (the floodability index of Carr/the fluidity index of Carr) will tend to become large.

Here, a floodability index is an index which indicates the ease of happening of the flushing (scattering) phenomenon, and the index can be determined to be a totaled value of a fluidity index, an angle of rupture index, a difference angle index, and a dispersion index. Further, the fluidity index is an index with which the difficulty of the outflow by gravity is evaluated. This index can be calculated as a totaled value of an angle of repose index, a compression rate index, a spatula angle index, and the degree of uniformity index, or the degree of condensation index. Each of these indices can be usually determined by measuring various physical characteristics of a particulate matter using a powder tester, and converting the measurements into indices based on the predetermined index table.

Concretely, the indices are measured using a powder tester PT-R type (made by HOSOKAWA MICRON CORP.) and in accordance with a method described in pp. 151–155 of "revision-and-enlargement fine-particles physical-properties illustration (published by Society of Powder Technology, Japan Association of Powder Process Industry and Engineering, Japan)".

Measuring Method of Fluidity Index of Carr

Measurement on the following four items is performed, and each index is computed based on the following conversion table (Table 1).

Let the Totaled Value be a Fluidity Index.

A) Angle of repose

B) Compression rate

C) Spatula angle

D) Degree of condensation

TABLE 1

| REPOSE ANGLE | | COMPRESSION RATE | | SPATULA ANGLE | | DEGREE OF CONDENSATION | |
|---|---|---|---|---|---|---|---|
| DEGREE | INDEX | % | INDEX | DEGREE | INDEX | % | INDEX |
| <25 | 25 | <5 | 25 | <25 | 25 | | |
| 26~29 | 24 | 6~9 | 23 | 26~30 | 24 | | |
| 30 | 22.5 | 10 | 22.5 | 31 | 22.5 | | |
| 31 | 22 | 11 | 22 | 32 | 22 | | |
| 32~34 | 21 | 12~14 | 21 | 33~37 | 21 | | |
| 35 | 20 | 15 | 20 | 38 | 20 | | |
| 36 | 19.5 | 2 | 19.5 | 39 | 19.5 | | |
| 37~39 | 18 | | 18 | 40~44 | 18 | | |
| 40 | 17.5 | | 17.5 | 45 | 17.5 | | |
| 41 | 17 | 21 | 17 | 46 | 17 | <6 | 15 |
| 42~44 | 16 | 22~24 | 16 | 47~59 | 16 | | |
| 45 | 15 | 25 | 15 | 60 | 15 | | |
| 46 | 14.5 | 26 | 14.5 | 61 | 14.5 | 6~9 | 14.5 |
| 47~54 | 12 | 27~30 | 12 | 62~74 | 12 | 10~29 | 12 |
| 55 | 10 | 31 | 10 | 75 | 10 | 30 | 10 |
| 56 | 9.5 | 32 | 9.5 | 76 | 9.5 | 31 | 9.5 |
| 57~64 | 7 | 33~36 | 7 | 77~89 | 7 | 32~54 | 7 |
| 65 | 5 | 37 | 5 | 90 | 5 | 55 | 5 |
| 66 | 4.5 | 38 | 4.5 | 91 | 4.5 | 56 | 4.5 |
| 67~89 | 2 | 39~45 | 2 | 92~99 | 2 | 57~79 | 2 |
| 90 | 0 | >45 | 0 | >99 | 0 | >79 | 0 |

A) Angle of Repose Measuring Method

Toner is dropped via a funnel on a disk with a diameter of 8 cm. The angle of the formed conic deposit layer is measured directly using a protractor. As for the toner supply in that case, a sieve having an aperture of 608 μm (24 meshes) is arranged on a funnel, toner is mounted thereon, an oscillation is applied thereto, and the toner is supplied to the funnel.

B) Compression Rate Measuring Method

A compression rate C is computed by the following equation.

$$C=[(\rho P-\rho A)/\rho P]\times 100$$

where ρA denotes a bulk density, and is obtained as follows. The toner is uniformly supplied to a cylindrical container with a diameter of 5.03 cm and a height of 5.03 cm from above through the sieve having an aperture of 608 μm of openings (24 meshes), the upper surface of the container is leveled and the whole is weighed.

ρP denotes a tapping density. A cylindrical cap is fitted into the container after measurement of the above-mentioned ρA, fine particles are added up to this upper edge, and tapping with a tap pitch of 1.8 cm is performed 180 times. After the completion of tapping, the cap is removed, the fine particles are leveled by the upper surface of the container, the whole is weighed, and the density in this state is defined as ρP.

C) Spatula Angle Measuring Method

A 22×120 mm metal spatula is set horizontally immediately on a saucer which goes up and down, and the fine particles which passed the sieve having an aperture of 608 μm of openings (24 meshes) are made to deposit thereon. After the particles are sufficiently deposited, the saucer is lowered calmly and the angle of the side of the fine particles deposited on the spatula at that time with respect thereto is defined as (1). Next, the angle which is re-measured when the impact by a weight fall is exerted once on an arm which supports the spatula is defined as (2). The average of above-mentioned (1) and (2) is used as a spatula angle.

D) Degree of Condensation Measuring Method

In the measurement, three sieves different from one another in aperture are laminated on one another so that the sieve having the largest aperture serves as the uppermost layer and the sieve having the smallest aperture serves as the lowermost layer, 2 g of the fine particles is mounted thereon, and the degree of condensation is calculated from the residue of the particles on the sieves after application of an oscillation with an amplitude of 1 mm. Sieves to be used are determined on the basis of the value for the bulk density.

When the bulk density is less than 0.4 g/cm$^3$, sieves each having an aperture of 355 μm (40 meshes), 263 μm (60 meshes), and 154 μm (100 meshes) are used, when the bulk density is 0.4 g/cm$^3$ or more and less than 0.9 g/cm$^3$, sieves each having an aperture of 263 μm (60 meshes), 154 μm (100 meshes), and 77 μm (200 meshes) are used, and when the bulk density is 0.9 g/cm$^3$ or more, sieves each having an aperture of 154 μm (100 meshes), 77 μm (200 meshes), and 43 μm (325 meshes) are used.

Oscillating time T (sec) in that case is determined from the following equation.

$$T=20+\{(1.6-\rho W)/0.016\}$$

$$\rho W=(\rho P-\rho A)\times(C/100)10\rho A$$

The degree of condensation is determined from the following equation after measuring the residue w1, w2, and w3 of the uppermost, middle, and lowermost layers, respectively after the oscillation.

$$C\mathbf{0}-w\mathbf{1}\times 100\times(1/2)+w\mathbf{2}\times 100\times(1/2)\times(3/5)+10w\mathbf{3}\times 100\times(1/2)\times(1/5)$$

Floodability Index of Carr Measuring Method

Measurement on the following four items is performed, and each index is computed based on the following conversion table (Table 2). Let the totaled value be a floodability index.

E) Fluidity
F) Angle of rupture
G) Angle of difference
H) Dispersibility

TABLE 2

| FLUIDITY INDEX | | ANGLE OF RUPTURE | | ANGLE OF DIFFERENCE | | DISPERSIBILITY | |
|---|---|---|---|---|---|---|---|
| FORM TABLE 1 | INDEX | DEGREE | INDEX | DEGREE | INDEX | % | INDEX |
| >60 | 25 | 10 | 25 | >30 | 25 | >50 | 25 |
| 59~56 | 24 | 11~19 | 24 | 29~28 | 24 | 49~44 | 24 |
| 55 | 22.5 | 20 | 22.5 | 27 | 22.5 | 43 | 22.5 |
| 54 | 22 | 21 | 22 | 26 | 22 | 42 | 22 |
| 53~50 | 21 | 22~24 | 21 | 25 | 21 | 41~36 | 21 |
| 49 | 20 | 25 | 20 | 24 | 20 | 35 | 20 |
| 48 | 19.5 | 26 | 19.5 | 23 | 19.5 | 34 | 19.5 |
| 47~45 | 18 | 27~29 | 18 | 22~20 | 18 | 33~29 | 18 |
| 44 | 17.5 | 30 | 17.5 | 19 | 17.5 | 28 | 17.5 |
| 43 | 17 | 31 | 17 | 18 | 17 | 27 | 17 |
| 42~40 | 16 | 32~39 | 16 | 17~16 | 16 | 26~21 | 16 |
| 39 | 15 | 40 | 15 | 15 | 15 | 20 | 15 |
| 38 | 14.5 | 41 | 14.5 | 14 | 14.5 | 19 | 14.5 |
| 37~34 | 12 | 42~49 | 12 | 13~11 | 12 | 18~11 | 12 |
| 33 | 10 | 50 | 10 | 10 | 10 | 10 | 10 |
| 32 | 9.5 | 51 | 9.5 | 9 | 9.5 | 9 | 9.5 |
| 31~29 | 8 | 52~56 | 8 | 8 | 8 | 8 | 8 |
| <28 | 6.25 | 57 | 6.25 | 7 | 6.25 | 7 | 6.25 |
| 27 | 6 | 58 | 6 | 6 | 6 | 6 | 6 |
| 26~23 | 3 | 59~64 | 3 | 5~1 | 3 | 5~1 | 3 |
| <23 | 0 | >64 | 0 | 0 | 0 | 0 | 0 |

E) Fluidity

A fluidity index as it is used for fluidity.

F) Angle of Rupture

After an angle of repose is measured, a constant impact by a weight fall is applied to the rectangle bat on which an injection angle of repose base is mounted to collapse a deposit layer and the angle of the slant face after the collapse is defined as the angle of rupture.

G) Angle of Difference

Let the difference between the angle of repose and the angle of rupture be an angle of difference.

H) Dispersibility

Figure 6:
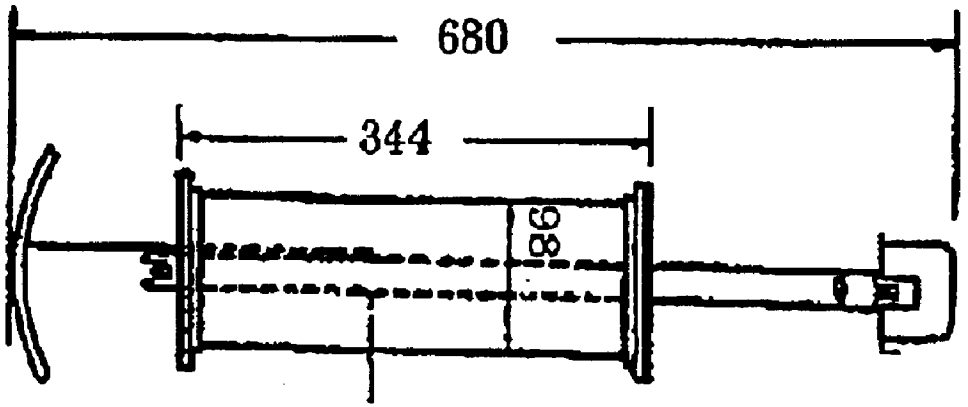
FIG. 6 is a schematic diagram of a measuring device used in a dispersion measuring method for carrying out the method of image forming of the present invention.

As shown in FIG. 6, 10 g of fine particles are dropped at once from the upper part through a glass cylinder with an inner diameter of 98 mm and a length of 344 mm, the amount W of the particles accumulated on the watch glass is measured, and the dispersibility is calculated from the following equation.

$$\text{Dispersibility } (\%) = (10 - w) \times 100/10$$

Average circularity of the magnetic toner of the present invention is preferably 0.955 or more, more preferably 0.970 or more. The magnetic toner tends to form a uniform ear in the developing portion when the average circularity of toner is 0.955 or more, and it becomes possible to perform faithful development to a latent image, and an improvement in image quality can be expected. Further, when the toner has the average circularity of 0.970 or more, its shape is considerably uniform. Thus, charging of the above toner tends to become uniform with the result that an inhibition of fog and an improvement in recovering ability are considerably achieved.

The transfer property of toner becomes satisfactory provided that the average circularity is 0.955 or more. This is considered to be because the contact area of the toner particle and the photosensitive member is small, thereby reducing adhesion to the photosensitive member of the toner particle resulting from the reflection force, van der Waals force, etc.

Furthermore, mode circularity of 0.99 or more in the circularity distribution of the toner means that many of the toner particles have nearly spherical forms, so that the above-mentioned action becomes much more remarkable, which is dramatically desirable.

The average circularity in the present invention was used as a simple method of expressing the form of a particle quantitatively. In the present invention, measurement was performed using the Toa Medical Electronics flow type particle image analysis apparatus "FPIA-1000." The circularity (Ci) of each particle measured about the group of particles each having a projected area diameter of 3 $\mu$m or more in diameter was determined by the following equation (9), respectively. Furthermore, as shown in the following equation (10), the value obtained by dividing the total of the circularity of all the particles measured by the total number (m) of particles is defined as the average circularity (C).

$$\text{Circularity (Ci)} = \frac{\text{The perimeter of a circle with the same projected area as that of a particle image}}{\text{The perimeter of the projection image of a particle}} \quad \text{equation (9)}$$

$$\text{Average circularity } (C) = \sum_{i=1}^{m} Ci/m \quad \text{equation (10)}$$

Further, the mode circularity is a peak circularity in which the circularity in the range of 0.40 to 1.00 is divided into 61 pieces in increments of 0.01, measured circularities of particles are assigned to each division range depending on the circularities, and the frequency value becomes maximum in the circularity frequency distribution.

Note that, "FPIA-1000", which is the measuring apparatus used in the present invention employs a computing method in which, after the circularity of each particle is measured, when computing mean circularity and mode circularity, the particles are classified into classes obtained by dividing the circularity of 0.40 to 1.00 into 61 pieces depending on their obtained circularities, and then the average circularity and the mode circularity are computed using the center value and frequency of a dividing point. However, each value of the average circularity, and mode circularity computed by this computing method differs quite slightly from each value of the average circularity and mode circularity computed by the above-mentioned equation directly using the circularity of each particle. The difference between them is of such magnitude that it can be substantially neglected, and in the present invention, the concept of the above-mentioned equation directly using the circularity of each particle is utilized in view of handling of data like of calculation time or simplification of a calculation operation expression, and a modification of such a computing method may be used.

The measurement procedure is as follows.

About 5 mg of magnetic toner is dispersed in 10 ml of water into which about 0.1 mg of surfactant is dissolved to prepare a dispersion solution, the dispersion solution is irradiated with a supersonic wave (20 kHz, 50 W) for 5 minutes, a dispersion solution concentration is set to 5,000–20,000 pieces/$\mu$l, and measurement is performed with the apparatus to determine the average circularity and mode circularity of a particle group of a projected area diameter of 3 $\mu$m or more.

The average circularity in the present invention is an index of the degree of the unevenness of magnetic toner. The average circularity indicates 1,000 when magnetic toner is a perfect globular form, and the more complicated the shape of a surface of the magnetic toner, the smaller the average circularity.

In this measurement, circularity is measured only about the particle group of a projected area diameter of 3 μm or more. The reason therefor is that many particle groups of an external additive which exists independently from toner particles are also contained in the particle group of less than 3 μm projected area diameter, which prevents accurate estimation of circularity about a toner particle group.

The proportion of Iron-containing particles exposed at a surface of the magnetic toner particles used in the image formation method of the present invention, is preferably 0.05 to 3.00%, more preferably 0.05 to 1.50%, most preferably 0.05 to 1.00%.

In the present invention, the proportion of iron-containing particles exposed at a surface of the magnetic toner particles is measured with a particle analyzer (PT1000: made by YOKOGAWA ELECTRIC CORP.). The particle analyzer carries out measurement based on the principle described in pages 65–68 of Japan Hard Copy 97 collected papers. In this device, each of fine particles such as toner is introduced into plasma. The element, number of particles and particle size of a luminescence object can be known from the emission spectra of the fine particles.

Among these, the proportion of iron-containing particles exposed at a surface of the magnetic toner particles is defined as what is determined by the following equation (11) from the simultaneity of luminescence of a carbon atom and luminescence of an iron atom, the atoms constituting a binder resin.

The proportion (%) of iron-containing particles exposed at a surface of the magnetic toner particles=100×the number of times of luminescence of only an iron atom/(the number of times of luminescence of iron atom which emitted light simultaneously with a carbon atom+the number of times of only the iron atom) (11)

Here, as for the simultaneous luminescence of a carbon atom and an iron atom, luminescence of an iron atom which emitted light within 2.6 msec from luminescence of a carbon atom is defined as the simultaneous luminescence, and luminescence of an iron atom after the luminescence is considered to be luminescence of only an iron atom.

Since the toner contains many magnetic substances in the present invention, simultaneous luminescence of a carbon atom and an iron atom means that the magnetic substances are dispersing in the toner, and, in other words, luminescence of only an iron atom can also mean that the magnetic substances are isolated from the toner.

The concrete measuring method is as follows. Measurement is carried out in an environment at a temperature of 23° C. and a humidity of 60% using the helium gas containing 0.1% of oxygen, and a toner sample which was left overnight and was subjected to moisture conditioning in this environment is used for the measurement. Carbon atoms (using a measurement wavelength of 247.860 nm and K factor of a recommended value) are measured in a channel 1, and iron atoms (using a measurement wavelength of 239.56 nm and K factor of 3.3764) are measured in a channel 2 to carry out sampling so that the number of luminescence of carbon atoms per scan reaches 1,000–1,400, the scan is repeated until the total number of luminescence of carbon atoms becomes 10,000 or more, and the number of luminescence is summed. At this time, in the distribution with an axis of ordinate indicating the number of luminescence of a carbon element and an axis of abscissa indicating the cubic root voltage of an element, the sampling and the measurement are performed so that the distribution may become a distribution which has one maximum and in which a trough does not exist. Then, based on this data, the noise cut level for all elements is set to 1.50V, and the proportion of iron-containing particles exposed at a surface of the magnetic toner particles is computed using the above-mentioned equation. In the below-mentioned examples, measurement is carried out similarly.

Materials such as an azo-based iron compound, which is a charge control agent, other than inorganic compounds containing iron atoms may also be contained in toner. However, such compounds are not counted as liberated iron atoms because carbon atoms in organic compounds emit light simultaneously with iron atoms.

Here, toner with a high proportion of iron-containing particles exposed at a surface of the magnetic toner particles not only reduces the charge amount of toner but also causes liberated magnetic substances to accumulate irregularly on a toner carrying member, so that uniform charging property of the toner is prevented and a decline in transfer efficiency is caused, leading to increased amount of residual toner, which is not preferable. For this reason, in the present invention, the proportion of iron-containing particles exposed at a surface of the magnetic toner particles is 3.00% or less, preferably 1.50% or less, and more preferably 1.00% or less.

On the other hand, the proportion of iron-containing particles-exposed at a surface of the magnetic toner particles of less than 0.05% means that substantially no magnetic substance is liberated from toner. Thus, although the toner with the low proportion of iron-containing particles exposed at a surface of the magnetic toner particles has high charge amount, the absence of leak site of charging thereof easily causes charge up thereof, and it becomes difficult to carry out uniform charging. Therefore, inversion fog tends to increase, which is not desirable.

The proportion of iron-containing particles exposed at a surface of the magnetic toner particles depends on the amount of the magnetic substances which toner contains, the particle size and particle size distribution of the magnetic substances, a method of manufacturing toner, etc. and, in a suspension polymerization method (after-mentioned) which is a suitable production method of the present invention, the rate depends on the hydrophobic degree, the uniformity of treatment, granulation conditions, etc of the magnetic substance. However, as an example, when the surface treatment of magnetic substances is uneven, a part of all of the magnetic substances (hydrophilicity is strong) with insufficient surface treatment will liberate.

The magnetic toner of the present invention can be produced by any well-known method. First of all, when producing the magnetic toner by the grinding method, for example, components required for the magnetic toner including: a binder resin; a magnetic substance; a release agent; a charge control agent; and a colorant as needed, other additives, etc are sufficiently mixed in a mixer such as a Henschel mixer and a ball mill, and then the whole is melted and kneaded using a heat kneader such as a heating roll, a kneader, and an extruder to make resins compatible with one another and other magnetic toner materials such as a magnetic substance are dispersed or dissolved therein. After cooling solidification and grinding of the resultant product, classification and, if needed, a surface treatment can be performed so that toner particles can be obtained. The classification may be performed prior to the surface treatment, or vise versa. In the classification process, a multidivision classifier is preferably used in terms of production efficiency.

The grinding process can be performed by a method using well-known grinding devices, such as a machine impact type and a jet type. In order to obtain toner which has a specific circularity according to the present invention, it is preferred to carry out treatment in which the product is ground by applying additional heat or a mechanical impact is auxiliary exerted thereon. A water bath method for dispersing pulverized (classified as needed) toner particles in hot water, a method of passing the particles through a hot air, etc. may also be used.

Means for applying a mechanical impulse force includes: a method using machine impact type pulverizers such as a cryptronsine system made by the Kawasaki Juko Co., and a turbo mill made by Tabo Industrial Co., Ltd.; and a method in which a vane rotating at a high velocity presses toner against the inside of a casing using a centrifugal force and a mechanical impulse force is applied to the toner by means of forces, such as a compressive force and a frictional force as performed in an apparatus such as a mechanofusion system by HOSOKAWA MICRON CORP., or the Nara machine factory hybridization system.

When using a mechanical impact method, the heat mechanical impact which applies the temperature near a glass transition point Tg of toner (Tg±10° C.) for treatment temperature is preferred from the viewpoint of condensation prevention and productivity. More preferably, it is especially effective in raising transfer efficiency to carry out the mechanical impact method at a temperature in the range of the glass transition point Tg of toner±5° C.

The binder resins to be used for the toner of the present invention, in the case manufactured by grinding method, include; monopolymers of styrene and derivatives thereof such as polystyrene and polyvinyl toluene; styrene copolymers such as styrene-propylene copolymer, styrene-vinyl toluene copolymer, styrene-vinyl naphthalene copolymer, styrene-acrylic methyl copolymer, styrene-acrylic ethyl copolymer, styrene-acrylic buthyl copolymer, styrene-acrylic octhyl copolymer, styrene-acrylic dimethylaminoethyl copolymer, styrene-metacrylic methyl copolymer, styrene-metacrylic ethyl copolymer, styrene-metacrylic buthyl copolymer, styrene-acrylic dimethyl amino ethyl copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, styrene-maleic acid ester copolymer; polymethyl methacrylate; polybuthyl methacrylate; polyvinyl acetate; polyethylene; polypropylene; polyvinyl butyral; silicone resin; polyester resin; polyamide resin; epoxy resin; polyacrylic resin; rosin; denatured rosin: terpene resin; phenolic resin; aliphatic or alicyclic hydrocarbon resin; aromatic petroleum resin; paraffin wax, and carnauba wax. Among them, the binder resin may be used independently or in combination of two or more kinds. Particularly, styrene copolymers and polyester resin are preferably used from the point of view of the developing property and fixing ability.

As for the glass transition point (Tg) of the toner used by the image forming method of the present invention, the point is preferably 40 to 80° C., and more preferably 45 to 70° C. If Tg is lower than 40° C., the storage stability of toner will deteriorate, whereas if it is higher than 80° C., the toner is inferior in fixing ability. Measurement of the glass transition point of toner is made with, for example, the inner heat input compensation type differential scanning calorimeter with high accuracy like Perkin-Elmer DSC-7. A measuring method is performed according to ASTM D 3418-8. In the present invention, after carrying out temperature rise of the sample once and taking hysteresis, the sample undergoes rapid cooling and the DSC curve measured when carrying out temperature rise again at a heating rate of 10° C./min, within the range of a temperature of 30 to 200° C. is used.

Although the magnetic toner used by the method for forming image of the present invention can also be produced by the pulverizing method as mentioned above, generally the toner particles obtained by the method are ones having an indeterminate form, and in order to obtain such physical properties that the average circularity is 0.955 or more as the desirable conditions of the toner according to the present invention, it is necessary to perform special mechanical or thermal treatment, or other treatment, so that the toner particle is inferior in productivity. Then, it is preferred to produce toner of the present invention in wet media, such as the dispersion polymerizing method, an association aggregation method, and a suspension-polymerization method. Among them, the suspension-polymerization method can readily meet the desirable conditions of the present invention, and can be used as a considerably preferable method.

In the suspension-polymerization method, after dissolving or dispersing a polymerizable monomer and a colorant (if necessary, a polymerization initiator, crosslinking agent, charge control agent, and other additives) to obtain a polymerizable monomer system, the polymerizable monomer system is dispersed using a suitable stirrer in a continuation layer (for example, water phase) containing a dispersion stabilizer, a polymerization reaction is simultaneously performed, and the toner which has a desired grain size is obtained. Since each toner particle shape is almost spherical in the toner obtained by the suspension-polymerization method, toner can be easily obtained that satisfies physical property requirements suitable for the present invention, namely the average circularity of 0.970 or more and mode circularity of 0.99 or more (hereinafter referred to as polymerization toner). Since the toner exhibits comparatively uniform distribution of charge amounts, it has high transfer property.

However, even if the usual magnetic substance is made to be contained in polymerization toner as in the above-mentioned case, many free magnetic substances exist and charging characteristics of toner particles fall remarkably. There involves a tendency of deterioration dispersion of a magnetic substance, which makes it difficult to meet the dispersibility of the magnetic substance as the indispensable requirements for the present invention. Toner with high circularity is hardly obtained because of strong interaction between a magnetic substance and water at the time of producing of suspension-polymerization toner, and the grain size distribution of toner is widened.

This is probably because (1) the magnetic substance is generally hydrophilic, and thus, easily exists on the toner surface, and (2) at the time of stirring water solvent, the magnetic substance moves at random, so that the suspended particle surface which results from a monomer is pulled and form is distorted, and cannot become a round shape easily, and the like. In order to solve such problems, modification of the surface characteristic which a magnetic substance has is important.

Although many proposals as mentioned above have been made about the surface modification of the magnetic substance used for polymerization toner, there is a problem that it is difficult to perform hydrophobic treatment on the surface of a magnetic substance uniformly, so that neither coalescence of magnetic substances nor the generation of a magnetic substance on which hydrophobic treatment is not carried out can be avoided. Thus, the dispersibility of a magnetic substance will not be enough and grain size distribution of the toner will be widened.

The toner which contains the magnetic iron oxide treated with alkyl trialkoxysilane is proposed as disclosed in JP 60-3181 B as an example of using a hydrophobic magnetic iron oxide. Although various electrophotographic characteristics of toner are improved to be sure by addition of the magnetic iron oxide, originally, the surface activity thereof is small and is not necessarily satisfactory, due to the occurrence of the coalescence of the particles at the time of treatment and uneven hydrophobic treatment. Further improvement is required to apply the toner to the method of image forming of the present invention. Although surely the hydrophobic degree increases when a treatment agent etc. is used so much or the treatment agent of high viscosity etc. is used, coalescence of particles etc. will arise and dispersibility will get worse conversely.

Thus, in polymerized toner using the conventional surface-treated magnetic substance, compatibility between hydrophobicity and dispersibility is not necessarily achieved, so that it is difficult to obtain a high definition image in a stable manner.

Then, as for the magnetic substance used for the magnetic toner of the present invention, it is preferred that hydrophobic treatment is carried out with a coupling agent. In case hydrophobic treatment of the magnetic substance surface is carried out, it is more preferable to use the method of carrying out a surface treatment by hydrolyzing a coupling agent while dispersing a magnetic substance in a water system medium to have a primary particle size. In this case, it is extremely preferred to carry out hydrophobic treatment after washing the magnetic substance produced in the aqueous solution, without drying it. The underwater hydrophobic treatment method can achieve more uniform treatment because the treatment hardly causes the coalescence of magnetic substances as compared to processing in a gaseous phase. Since the magnetic substance does not aggregate at the time of drying in the case of hydrophobic treatment without drying process, the magnetic substance is dispersed to have the primary particle size at the time of treatment and it is possible to carry out a very uniform surface treatment.

A coupling agent which generates gas like chlorosilcanes and silazane does not need to be used for the method of treating the magnetic substance surface, while hydrolyzing a coupling agent in a water system medium, and the method allows use of a coupling agent of high viscosity with which the satisfactory treatment has been so far difficult because of its ease of coalescence of magnetic substances in a gaseous phase, and the hydrophobic effect is extremely large.

As a coupling agent which can be used in the surface treatment of the magnetic substance according to the present invention, a silane coupling agent, a titanium coupling agent, etc. are mentioned, for example. A silane coupling agent is used more preferably and it is represented by the general formula (I).

$$R_mSiY_n(1) \quad (I)$$

(wherein R represents an alkoxy group, m represents an integer of 1 to 3, Y represents a hydrocarbon group such as an alkyl group, a vinyl group, a glycidoxy group, and a methacryl group, and n represents an integer of 1 to 3. Here, m+n=4.)

As the silane coupling agent shown in formula (I), for example, vinyltrimethoxysilane, vinyltriethoxysilane, vinyltris(β-methoxyethoxy)silane, β-(3,4-epoxycyclohexyl) ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldlmethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-decyltrimethoxysilane, hydroxypropyltrimethoxysilane n-hexadecyltrimethoxysilane, n-octadecyltrimethoxysilane and the like can be given.

Among those, in order to acquire sufficient hydrophobicity, it is preferred to use the alkyl trialkoxysilane coupling agent represented by the following general formula (II).

$$C_pH_{2P+1}—Si—(OC_qH_{2q+1})_3 \quad (II)$$

(wherein p represents an integer of 2 to 20, and q represents an integer of 1 to 3.)

If p in the above-mentioned formula is smaller than 2, hydrophobic treatment will become easy to perform, but it is difficult to fully give hydrophobicity and it becomes difficult to control the free magnetic substance. If p is larger than 20, hydrophobicity will become enough, but it is not preferred in that coalescence of magnetic substances more easily occurs to thereby make it difficult to fully carry out dispersion of the magnetic substance into toner.

If q is larger than 3, the reactivity of the silane coupling agent will fall and hydrophobic treatment will be hardly performed in a sufficient manner. It is especially preferable to use the alkyl trialkoxysilane coupling agent in which p in a formula represents an integer of 2 to 20 (preferably integer of 3 to 15), and q represents an integer of 1 to 3 (preferably integer of 1 or 2).

As for the treatment amount, the total amount of a silane coupling agent is preferably 0.05 to 5.0 parts by mass to 100 parts by mass of-the magnetic substance. It is preferred to adjust the amount of a treatment agent according to the surface area of a magnetic substance, the reactivity of a coupling agent, etc.

For treatment with a coupling agent in a water system medium as a surface treatment of a magnetic substance, a method of stirring the magnetic substance and coupling agent of a proper quantity in a water system medium is mentioned. Stirring is preferably performed using, for example, a mixer which has a stirring blade so that the magnetic substance may become a primary particle in the water system medium.

Here, a water system medium is a medium which uses water as the main component. Specifically, water itself, ones obtained by adding the little amount of surfactant in water, ones obtained by adding pH regulator in water, and ones obtained by adding the organic solvent in water are mentioned as a water system medium. As a surfactant, a nonionic surfactant like polyvinyl alcohol is preferred. A surfactant is preferably added in 0.1 to 5% by mass to water. Inorganic acids, such as hydrochloric acid, are mentioned as a pH regulator. Alcohols are mentioned as an organic solvent.

It is possible to perform treatment with one agent, or in combination of two or more kinds of agents, when using the above-mentioned silane coupling agents. When using plural agents together, the coupling agents are supplied at the same time or with time intervals, and a magnetic substance is processed.

In the magnetic substance obtained in this way, since aggregation of particles is not seen and hydrophobic treatment of each particle surface is carried out uniformly, the uniformity of toner particles will be satisfactory when the magnetic substance is used as a material for polymerization toner.

The polysiloxane compound used for the present invention provides an effect on the floodability index/fluidity index of the present invention in an extremely minute amount, but involves the feature that solubility with a resin is remarkable and the reduction in blocking resistance or transfer property of the toner is readily caused. Therefore, when a polysiloxane compound is used for the toner of the present invention, the addition should be controlled and stability in producing should be raised. It has been found that use of the magnetic substance is preferable in which 0.05 to 0.40 part by mass of polysiloxane compound is used for treatment with respect to 100 parts by mass of the magnetic substance as adding means as a result of studies of the inventors of the present invention. Since the aggregation property of the magnetic substance itself is improved by using such a magnetic substance at the toner manufacturing process, the coloring power of the toner can also be improved and polysiloxane can exist in the state of a minute amount also as an amount of free substances. Thus it is conceivable that the effect of the present invention tends to be readily exerted in a stable manner. In particular, in the suspension polymerization which is the production method of toner suitable for the present invention, since polysiloxane compounds may tend to gather in the toner surface, the tendency is strong.

On the other hand, in the present invention, if a polysiloxane compound is separately added, since the tendency of aggravation of the toner recovering ability, fog, etc. accompanying lowering of transfer ability to occur will become strong, which is an undesired tendency.

As a method for treating a magnetic substance with a polysiloxane compound, a silane coupling agent is hydrolyzed in an acid region in a water system medium, by performing a condensation reaction for a short time by raising temperature thereafter or making pH at the time of treating fall within an alkali region, coupling treatment and the treatment and a polysiloxane compound of the magnetic substance surface can be carried out simultaneously.

In this case, each treatment amount is important in order to demonstrate the synergistic effect of the uniformity of hydrophobic treatment and polysiloxane. It is preferred that treatment is carried out on the magnetic substance 100 parts by mass with the silane coupling agent of 0.5 to 5.0 parts by mass and the polysiloxane compound of 0.05 to 0.4 parts by mass.

The amount of the above-mentioned polysiloxane compound which a magnetic substance has can be controlled by the above-mentioned reaction conditions, and the amount and a kind of the coupling agent to be supplied.

Measurement of the amount of a polysiloxane compound is performed as follows.

Since it is conceivable that the polysiloxane in the present invention is in dissolution/dispersion condition in toner particles, quantitative determination thereof is performed by a solvent extraction operation of toner particles. More specifically, when measuring the polysiloxane in toner particles, toner is dispersed by a supersonic wave into an IPA solvent, followed by filtration/vacuum drying to remove an external additive, it is extracted in a THF solvent, NMR (Si) of an extract is measured, and the quantitative determination is carried out by comparing an integral value of polysiloxane component peak intensity with a calibration curve measured beforehand by silicone oil etc.

When measuring directly from the magnetic substance, 100 g of hydrophobic-treated magnetic substance is supplied into toluene, and supersonic treatment is performed for 1 hour. After the treatment, a filtrate separation is carried out on the magnetic substance and a toluene solution.

Then, the amount of eluted polysiloxane compounds is computed from the amount of Si elements or the amount of carbon before and after toluene elution. The toluene solution on which the filtrate separation was carried out may be condensed, and the amount of a polysiloxane compound may be calculated from the obtained amount of compounds.

The magnetic substances used for the magnetic toner of the present invention may also contain elements such as phosphorus, cobalt, nickel, copper, magnesium, manganese, aluminum, and silicon, and uses iron oxide, such as a tri-iron tetraoxide and γ-iron oxide, as a main component. Among them, the iron oxide may be used independently or in combination of two or more kinds. As for these magnetic substances, a BET specific surface area by a nitrogen adsorption process is preferably 2–30 $m^2/g$ and, is particularly more preferably 3–28 $m^2/g$. Further, preferable are those each having a Mohs hardness of 5 to 7.

Form of a magnetic substance includes a polyhedron, an octahedron, a hexahedron, a globular form, a needle shape, and a scaly shape. Then, what has few anisotropy, such as a polyhedron, an octahedron, a hexahedron, or a globular form, is preferable in increasing image density.

As for the magnetic substance of the present invention, it is preferable that σr/σs, which is a ratio of residual magnetization (σr) to the intensity of magnetization (saturation magnetization: σs) of the toner in a magnetic field of 79.6 kA/m (1,000 ersteds), is 0.11 or less. σr/σs of larger than 0.11 suggests that the residual magnetization of toner is large, and the toner after development becomes easy to exist by magnetic condensation as a chain. This condition is also seen in the transfer residual toner or fogging toner. The toner cannot but behave as a big lump in this case, and even if it has moderate charging property, it becomes inferior in recovering ability in a recovery area.

In view of the above, it is more preferable that the form of the magnetic substance is globular, a polyhedron, or a hexahedron with little residual magnetization. Further, by including elements such as phosphorus and silicon in a magnetic substance, it is possible to make sr/ss further lower. The form of a magnetic substance can be identified by use of SEM or TEM, and if there is a distribution in the form, the most common form among the existing forms is defined as the form of the magnetic substance.

As volume average particle size of a magnetic substance, 0.05–0.40 μm is preferred. Since lowering of the degree of black in an image becomes remarkable, and a coloring power becomes inadequate as a colorant of a monochrome toner and also condensation of composite oxide particles becomes strong when volume average particle size is less than 0.05 μm, there is a tendency for dispersibility to get worse. Further, the magnetic substance tends to be reddish black, and image quality level falls. On the other hand, when volume average particle size exceeds 0.40 μm, the coloring power comes to be insufficient like a common colorant. In addition, especially, when using the magnetic substance as a colorant for small particle size toner, it becomes difficult in terms of probability to uniformly disperse the magnetic substance to each toner particle, and dispersibility is likely to become worse, which is not preferable.

Note that the volume average particle size of a magnetic substance can be measured using a transmission electron microscope. More specifically, after fully dispersing toner particles which should be observed into an epoxy resin, a hardened product obtained by hardening the dispersed product for two days in an atmosphere at a temperature of 40° C. is formed into a flaky sample using a microtome. The photograph of 10,000 times or 40,000 times the magnifying power of the flaky sample is taken using a transmission electron microscope (TEM), and the particle size of 100 magnetic substance in a view are measured. Then, volume average particle size was computed based on the corresponding diameter of a circle having an area equal to the projected area of a magnetic substance. It is also possible to measure the particle size with an image analyzing device.

The magnetic toner used for the method for forming image of the present invention may use other colorants together in addition to a magnetic substance. As a colorant which can be used together, a magnetic or nonmagnetic inorganic compound, a well-known dye, and a pigment can be mentioned. Specifically, particles such as: ferromagnetic metallic particles like cobalt and nickel; alloys obtained by adding to these elements chromium, manganese, copper, zinc, an aluminum, rare earth elements, etc.; and hematite, titanium black, the Nigrosine dye/pigment, carbon black, phthalocyanine, etc. can be mentioned. It is preferable that these elements are also used after the surface treatment.

As for the hydrophobic degree of the magnetic substance used for the present invention, it is preferable that it is 35 to 95%, and more preferably it is 40 to 95%. The hydrophobic degree can be arbitrarily changed by the type, amount, and the treatment method of a treatment agent on the surface of a magnetic substance. The hydrophobic degree indicates the hydrophobicity of a magnetic substance, and means that what has the low hydrophobic degree has high hydrophilicity. Therefore, when a magnetic substance with a low hydrophobic degree is used, in the suspension-polymerization method suitably used in case where the toner of the present invention is produced, the magnetic substance shifts to a water system during granulation, and grain size distribution becomes broadcloth, and it will exist as a free magnetic substance, which is not preferable. Further, there is a tendency for dispersion of a magnetic substance to also get worse. In order to make the hydrophobic degree higher than 95%, the amount of the treatment agent on the surface of a magnetic substance must be so much. In such a condition, coalescence of a magnetic substance is easily caused, and the uniformity of the treatment will be spoiled.

Note that the hydrophobic degree in the present invention is measured by the following method.

A methanol titration test is used for measurement of the hydrophobic degree of a magnetic substance. The methanol titration test is an experimental test which mesures the hydrophobic degree of the magnetic substance having the surface of which hydrophobic treatment was carried out.

The degree-of-hydrophobic measurement using methanol is performed as follows. 0.1 g of a magnetic substance is added in 50 ml of water of a beaker with a capacity of 250 ml. Methanol is gradually added in liquid thereafter, and titration is performed. Under these circumstances, methanol is supplied from a liquid bottom, and titration is performed while stirring the liquid gently. Sedimentation termination of a magnetic substance is considered to be the time at which no suspended matter of the magnetic substance is observed on the liquid surface, and the hydrophobic degree is expressed as volume percentage of methanol in a liquid mixture of methanol and water obtained when the titration has reached the sedimentation termination. In the example to be described later, measurement is performed similarly.

The amount of the magnetic substance for use in the magnetic toner of the present invention is preferably 10 to 200 parts by mass to 100 parts by mass of the binder resin. It is more preferable to use 20 to 180 parts by mass. If the amount is less than 10 parts by mass, the coloring power of toner is scarce, and inhibition of fog is also difficult. On the other hand, if the amount exceeds 200 parts by mass, the holding power by the magnetism of the toner to a toner carrying member will become strong and developing property falls. Further, uniform dispersion of the magnetic substance to each of the toner particles will become difficult, and magnetic condensation easily occurs, which is not preferable.

Note that measurement of the content of the magnetic substance in toner can be carried out using the Perkin-Elmer thermal-analysis device TGA7. A measuring method is as follows. Under a nitrogen atmosphere, toner is heated from normal temperature to 900° C. at a rate of temperature rise of 25° C./min. loss-in-amount mass % between 100° C. and 750° C. is defined as the amount of binder resins, and residual weight is approximately defined as the amount of magnetic substances.

In the case of magnetite, for example, the magnetic substance used for the magnetic toner of the method for forming image of the present invention is produced by the following method.

Alkalis such as sodium hydroxide equal to or more than an equivalent with respect to an iron component are added in a ferrous salt aqueous solution, and the aqueous solution containing ferrous hydroxide is prepared. The air is blown while maintaining pH of the prepared aqueous solution at seven or more (preferably pH 8 to 14), the ferrous hydroxide is oxidized while heating the aqueous solution at 70° C. or more, and a seed crystal used as the core of magnetic iron oxide fine particles is generated first.

Next, an aqueous solution which contains about one equivalent of ferrous sulfate is added in a slurring liquid containing the seed crystal on the basis of the addition of the alkali added before. The air is blown while maintaining pH of the liquid at 6 to 14 to proceed the reaction of the ferrous hydroxide, and the seed is used as the core crystal to grow magnetic iron oxide fine particles. At this time, by choosing pH arbitrarily, it is possible to control the form of the magnetic substance. The pH of the liquid shifts to the acidity side as the oxidation reaction progresses, but the pH of the liquid is not preferably less than six. Although after the completion of the oxidation reaction it is also possible to directly adjust pH etc. to carry out a coupling treatment, after re-dispersing in another water system medium the iron-oxide fine particles obtained by washing, and filtering after the completion of the oxidation reaction without drying it, it is preferable that the coupling treatment is performed by making pH of the re-dispersed solution fall within an acidity region, adding a silane coupling agent with stirring the solution enough, and raising its temperature after hydrolysis, or by making the pH fall within an alkali region. Anyway, it is important to perform a surface treatment without passing through a drying process after the completion of the oxidation reaction, and it is difficult to uniformly disperse a magnetic substance in a water system medium when dried before the coupling treatment, with the result that a uniform treatment cannot be performed.

As the ferrous salt, iron sulfate as a common by-product in the sulfuric-acid-method titanium production, and iron sulfate as a by-product in connection with the surface washing of a steel plate can be used, and iron chloride etc. can be also used.

In the production method of the magnetic oxide of iron by an aqueous solution method, iron concentration of 0.5 to 2 mol/l is generally used from the viewpoint of preventing the rise of the viscosity at the time of the reaction, and the solubility of iron sulfate. In general, the concentration of iron sulfate has a tendency that the particle size of a product becomes fine as the concentration Is dilute. On the occasion of a reaction, it is easy to make the particle size finer, as the reaction temperature is low and there are many air contents.

By using magnetic toner made from the hydrophobic magnetic substance thus produced, stable charging property of toner is obtained and high transfer efficiency, high image quality and high stability are achieved.

In the present invention, the toner is magnetic toner having the intensity of magnetization of 10 to 50 $Am^2/kg$ (emu/g) in a magnetic field of 79.6 kA/m (1,000 ersteds). This is because by providing magnetic force development means in a developer, it is possible to prevent the leakage of toner in the magnetic toner. This is also because the conveyance property or stirring property of toner is enhanced and the magnetic toner forms ears so that it becomes easy to prevent scattering of toner. However, the above-mentioned effect is not obtained as the intensity of magnetization of toner in a magnetic field of 79.6 kA/m is under 10 $Am^2/kg$, and if a magnetic force is made to act on a toner carrying member, ears of toner will become unstable, so that the toner cannot be charged uniformly, and fog and image density unevenness are readily generated. On the other hand, when the intensity of magnetization of toner in a magnetic field of 79.6 kA/m is larger than 50 $Am^2/kg$, if a magnetic force is made to act on the toner, the fluidity of the toner will remarkably fall by its magnetic condensation, developing property falls, the toner becomes easy to receive damage, and toner deterioration becomes remarkable. Further, the transfer property is lowered, thereby increasing the amount of the transfer residual toner, which is not preferable. The intensity of magnetization (saturation magnetization) of toner can be arbitrarily changed by the amount of a magnetic substance contained, and the saturation magnetization of the magnetic substance. For this reason, the saturation magnetization of a magnetic substance in a magnetic field of 796 kA/m is preferably 30 to 120 $Am^2/kg$.

In the present invention, the intensities of the saturation magnetization and residual magnetization of magnetic toner are measured at room temperature of 25° C. in an external magnetic field of 79.6 kA/m using an oscillatory type magnetometer VSM P-1-10 (made by Toei Industrial Co., Ltd.). Magnetic characteristics of the magnetic substance can be measured at room temperature of 25° C. in an external magnetic field of 796 kA/m using the oscillatory type magnetometer VSM P-1-10 (made by Toei Industrial Company).

The magnetic toner used for the method of image forming of the present invention may contain a release agent for the improvement in fixing ability and it is preferable that the toner contain 1 to 30% by mass thereof with respect to a binder resin, and more preferably 3 to 25% by mass.

The content of a release agent under 1% by mass is deficient in the low-temperature offset inhibition effect. If the content exceeds 30% by mass, a storage stability for a long time will get worse. In connection with that, the charging uniformity of toner is inferior with exudation of the release agent on the surface of toner etc, which causes a decline in transfer efficiency and is thus not preferable. Further, the toner contains plenty of waxes, with the result that toner form becomes easy to become irregular.

The release agent available to the magnetic toner according to the present invention includes: petroleum system waxes such as a paraffin wax, a micro crystalline wax, and a petro lactam and derivatives thereof; a montan wax and a derivative thereof; a hydrocarbon wax by the Fischer-Tropshch process method and a derivative thereof; polyolefine waxes typified by polyethylene and derivatives thereof; and natural waxes such as a carnauba wax and a candelila wax and derivatives thereof. An oxide, a block copolymer with a vinyl monomer and a graft denaturation object are included in the derivative. Further, fatty acids such as higher aliphatic alcohols, stearic acid, and palmitic acid or compounds thereof; acid amide waxes; ester waxes; ketones; hardened castor oil and a derivative thereof; vegetable waxes; animal waxes; and the like can be used.

Among those release agent components, a component whose endothermic peak by differential thermal analysis is 40 to 110° C., i.e., a component having the maximum endothermic peak in a 40 to 110° C. region at the time of temperature rise in the DSC curve measured by a differential scanning calotimeter, preferred. Furthermore, a component having the maximum endothermic peak in a 45 to 90° C. region is more preferable. Since the component has the maximum endothermic peak in the above-mentioned temperature region, satisfactory fixing ability is provided and exudation of a release agent component etc. can be controlled, which is preferable. The self-coagulation force of a release agent component becomes weak if the maximum endothermic peak is less than 40° C. As a result, exudation of a release agent component is easy to occur and then the charging uniformity of toner falls. On the other hand, since the solubility to the polymerization monomer of a release agent will get extremely bad in the suspension-polymerization method which is a suitable production method of the present invention if the maximum endothermic peak exceeds 110° C., dispersibility of the release agent gets worse, which is not preferable.

Measurement of the amount of endotherms and the maximum endothermic peak temperature of a release agent is performed according to "ASTM D 3418-99" and "ASTM D 3417-99". Perkin-Elmer DSC-7 is used for the measurement. For the temperature correction of a device detector, the melting points of indium and zinc are used and the heat of fusion of indium is used for the correction of the amount of heat. For a measurement sample, a pan made of aluminum is used and an empty pan is set for control. The sample is quenched, after carrying out temperature rise of the sample to 200° C. once and removing a heat history. The DSC curve measured when carrying out temperature rise again in the temperature range of 30 to 200° C. at a rate of temperature rise of 10° C./min is used. In the example to be described later, measurement is carried out similarly.

In order to stabilize charging characteristics, a charge control agent may be blended with the magnetic toner of the present invention. As the charge control agent, a well-known one can be used. In particular, the charge control agent whose charging speed is high and which can stably maintain a fixed charge amount is preferable. When producing toner using a direct polymerization method, the charge control agent whose polymerization inhibition property is low and which has substantially no solubilization object to a water system dispersion-medium is particularly preferred. Specific compounds include the metallic compound of aromatic carboxylic acid such as salicylic acid, alkyl salicylic acid, dialkyl salicylic acid, naphthoic acid, and dye carboxylic acid, and metal salt or metal complex of an azo dye or an azo pigment, a polymeric compound which has sulfonic acid or a carboxylic acid radical in a side chain, a boron compound, a urea compound, a silicon compound, calixarene, and the like as a negative system charge control agent. The quaternary ammonium salt, or the polymeric compound which has the quaternary ammonium salt in a side chain, a guanidine compound, the Nigrosine system compound, an imidazole compound, etc. are mentioned as a positive system charge control agent.

As the method of making toner containing a charge control agent, there is a method of adding it within the toner particles (internal addition) and a method of externally adding it to the toner particles. As the amount of use of these charge control agents, it is determined according to the toner production method inclusive of the type of a binder resin, the existence of other additives, and the dispersion method, which is not limited uniquely. However, In the case where internal addition is carried out, it is preferably used in the range of 0.1 to 10 parts by mass, more preferably of 0.1 to 5 parts by mass with respect to 100 parts by mass of the binder resin. In the case of external addition, preferably 0.005 to 1.0 part by mass is used with respect to 100 parts by mass of the toner, more preferably 0.01 to 0.3 part by mass.

However, for the magnetic toner of the present invention, the addition of a charge control agent of the magnetic toner is not indispensable. Instead of including such a charge control agent, a frictional charging with the toner layer thickness regulating member or a toner carrying member is positively used.

Next, there is described a method for suitably producing magnetic toner for the method of image forming of the present invention in accordance with a suspension polymerization method. The polymerization toner of the present invention is produced as follows. Generally, in a toner composition, i.e., a polymerizable monomer to be provided as a binder resin, a magnetic substance, a release agent, a plasticizer, a charge control agent, and a crosslinking agent and optionally other components and additives (e.g., a colorant) to be required for the toner, such as a polymeric polymer or a dispersant are added suitably, and are uniformly dissolved or dispersed using a disperser or the like to obtain a polymerization monomer system. Then the resulting polymerization monomer system is suspended in a water system medium that contains a dispersion stabilizer, resulting in a magnetic toner of the present invention.

In the production method of polymerization toner in accordance with the present invention, polymerization monomers that constitute the polymerization monomer system include the following monomers.

As the polymerization monomers, styrene monomers such as styrene, o-methylstyrene, m-methylstyrene, p-methylstyrene, p-methoxystyrene, and p-ethylstyrene: acrylates such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chlorethyl acrylate, and phenyl acrylate; methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; and other monomers such as acrylonitrile, methacrylonitrile, and acrylamide and the like may be given. Those monomers may be used individually or in combination. Of the above mentioned monomers, it is preferable that styrene or derivatives thereof be used individually or be combined with other monomers to be used, from the perspective of developing property and durability of the toner.

In the production of the polymerization toner according to the present invention, a resin may be added in a polymerizable monomer system for polymerization. For example, polymerizable monomer components containing a hydrophilic functional group, such as the amino group a carboxylic acid group, a hydroxyl group, a sulfonic acid group, a glycidyl group, and a nitrite group, cannot be used as a monomer since they dissolve in an aqueous suspension to cause emulsion polymerization because it is water-soluble. To introduce the above polymerizable monomer components to the toner, they can be used in the form of copolymers, such as a random copolymer with vinyl compounds, such as styrene or ethylene, a block copolymer, or a graft copolymer, or in the form of condensation polymer such as polyester and polyamide, polyaddition polymers such as polyether and polyimine. If a high polymer containing such a polar functional group or a nonpolar resin such as styrene-butadiene resin, are made to coexist in toner, phase separation of the above-mentioned wax component is carried out due to the difference in the compatibility of water/oil phase, encapsulation becomes more powerful, and the satisfactory toner of blocking resistance and developing property can be obtained.

By containing a polyester resin particularly among these resins, the effect will be more exerted as will be explained below. Since a polyester resin includes many ester bonds which are functional groups with a comparatively high polarity, the polarity of the resin itself becomes high, For the polarity, in a water system dispersion medium, with the increasing tendency for polyester to be unevenly distributed in the drop surface, the condition is maintained, while polymerization proceeds, and it becomes toner. For this reason, a surface state and a surface composition become uniform because a polyester resin is unevenly distributed in the toner surface, and as a result, charging property becomes uniform, and very good developing property can be obtained according to a synergistic effect with the good encapsulation property of a release agent.

The polyester resin used for the present invention includes a saturated polyester resin, an unsaturated polyester resin, or both, which may be selected appropriately for use, when controlling physical properties, such as charging property of toner, and durability and fixing ability.

As the polyester resin used for the present invention, the ordinary one constituted by an alcoholic component and an acid component can be used, and both components are illustrated below.

As the alcohol component, ethylene glycol; propylene glycol; 1,3-butanediol; 1,4-butanediol; 2,3-butanediol; diethylene glycol; triethylene glycol; 1,5-pentanediol; 1,6-hexanediol; neopentyl glycol; 2-ethyl-1,3-hexanediol; cyclohexanedimethanol; butenedlol; octenediol; cycrohexenedimethanol; hydrogenated bisphenol As; bisphenol derivatives represented by the following formula (III):

(III)

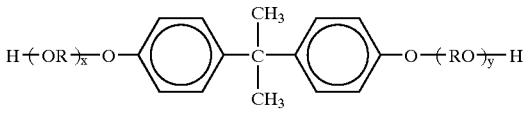

(wherein R is an ethylene group or a propylene group, each of x and y is an integer of 1 or more, and an average of x+y is 2 to 10), or hydrogenated products of the compounds of the formula (III); or diols represented by the following formula (IV):

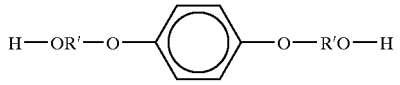

(IV)

(wherein R' is —$CH_2CH_2$— or —$CH_2$—$CH(CH_3)$— or —$CH_2$—$C(CH_3)_2$—), or hydrogenated diols of the compounds of the formula (IV), etc. may be given.

As the divalent carboxylic acids, benzenedicarboxylic acids such as phthalic acid, terephthalic acid, isophthalic acid, and phthalic anhydride and anhydrides thereof; alkyldicarboxylic acids such as succinic acid, adipic acid, sebacic acid, and azelaic acid and anhydrides thereof; and further, succinic acids substituted by an alkyl or alkenyl group having 6 to 18 carbon atoms, and anhydrides thereof; unsaturated dicarboxylic acids such as fumaric acid, maleic acid, citraconic acid, and itaconic acid and anhydrides thereof; and the like may be given.

Further, as the alcohol components, polyhydric alcohols such as glycerin, pentaerythritol, sorbitol, sorbitan, and oxyalkylene ether of novolak type phenol resins may be given. The acid component includes polyvalent carboxylic acids such as trimellitic acid, pyromellitic acid, 1,2,3,4-butanetetracarboxylic acid, and benzophenonetetracarboxylic acid, and anhydrides thereof may be given.

Among the above-mentioned polyester resins, the alkylene oxide addition product of above-mentioned bisphenol A superior in charging characteristics and environmental stability and well-balanced in other electrophotographic characteristics is used preferably. The number of average addition moles of alkylene oxide is preferably 2 to 10, in the case of this compound, in terms of fixability or the durability of toner.

As for the polyester resin in the present invention, it is preferred that 45 to 55 mol % in the whole component is an alcoholic component, and 55 to 45 mol % is an acid component.

In order to express the stable charging properties of the toner particles obtained in the magnetic toner of the present invention, it is preferred that a polyester resin has the acid value of 0.1 to 50 mg KOH/1 g resin. The amounts of existence of the polyesther resin to the toner surface are absolutely insufficient in the case of less than 0.1 mg KOH/1 g resin. When 50 mg KOH/1 g resin is exceeded, an adverse effect is exerted on the property of toner. In the present invention, the range of the acid value of 5 to 35 mg KOH/1 g resin is still more preferable.

In the present invention, unless an adverse effect is exerted on the physical properties of the toner particles obtained, two or more sorts of polyester resins can be used together. For example, denaturalizing with silicone or a fluoroalkyl group-containing compound, physical properties is also suitably adjusted.

When using the polymeric polymer containing, such a polar functional group, the average molecular weight of 5,000 or more is preferred. If it is less than 5,000, particularly less than 4,000, since it is easy to concentrate this polymer in the vicinity of the surface, there is a tendency of deteriorating the developing property, blocking resistance, and durability, which are not preferable.

Further, for the object of refinement in dispersion or fixing of a material, or in image characteristics, resins other than those described above may be added to the monomer system. As the resins used, for example, homopolymers of styrene and substituted products thereof such as polystyrene and polyvlnyltoluene; styrene copolymers such as a styrene/propylene copolymer, a styrene/vinyltoluene copolymer, a styrene/vinylnaphthalin copolymer, a styrene/methylacrylate copolymer, a styrene/ethylacrylate copolymer, a styrene/butylacrylate copolymer, a styrene/octylacrylate copolymer, a styrene/dimethylaminoethylacrylate copolymer, a styrene/methylmethacrylate copolymer, a styrene/ethylmethacrylate copolymer, a styrene/butylmethacrylate copolymer, a styrene/dimethylamlnoethylmethacrylate copolymer, a styrene/viny methylether copolymer, a styrene/vinylethylether copolymer, a styrene/vinylmethylketone copolymer, a styrene/butadiene copolymer, a styrene/isoprene copolymer, a styrene/maleic acid copolymer, and a styrene/maleate copolymer; polymethylmethacrylate, polybutylmethacrylate, polyvinylacetate, polyethylene, polypropylene, polyvinylbutyral, silicone resins, polyester resins, polyamide resins, epoxy resins, polyacrylic resins, rosins, modified rosins, terpene resins, phenol resins, aliphatic or alicyclic hydrocarbon resins, aromatic petroleum resins, and the like may be used individually or in combination. As an addition amount of these resins, 1–20 parts by mass are preferred to the polymerization monomer 100 parts by mass. Under 1 part by mass, the effect of the addition is small, and on the other hand, if the addition amount is more than 20 parts by mass, various physical-properties layout of the polymerization toner will become difficult.

If the polymer of different molecular weight from the molecular weight range of the toner obtained by polymerizing a polymerization monomer is dissolved into a monomer to be polymerized, a toner of high offset-proof property with a large molecular weight distribution can be obtained.

As a polymerization initiator used in production of the magnetic toner of the present invention, it has a half value period of 0.5 to 30 hours at the time of a polymerization reaction. If a polymerization reaction is performed with the addition amount of 0.5 to 20 parts by mass to the polymerization monomer 100 parts by mass, the polymer which has the maximum between molecular weight of 10,000 to 100,000 can be obtained and desirable hardness and suitable fusion characteristics can be given to the toner.

As the polymerization initiator, an azo or diazo polymerization initiator such as 2,2'-azobis-(2,4-dimethylvaleronitrile), 2,2'-azobisisobutyronitrile, 1,1'-azobis(cylohexane-1-carbonitrile), 2,2'-azobis-4-methoxy-2,4-dimethylvaleronitrile, or azobisisobutyronitrile; or a peroxide polymerization initiator such as benzoyl peroxide, methylethylketone peroxide, diisopropyl peroxycarbonate, cumene hydroperoxide, 2,4-dichlorobenzoyl peroxide, lauroyl peroxide, or t-butylperoxy-2-ethylhexanoate may be given.

In case where the magnetic toner of the method of image forming of the present invention is produced, a cross linking agent may be added in a preferable amount of 0.001 to 15 parts by mass is preferable to the polymerization monomer of 100 parts by mass.

Here, as the crosslinking agent, a compound that has two or more polymerizable double bonds is mainly used, and, for example, aromatic divinyl compounds such as divinylbenzene and divinylnaphthalene; carboxylates having two double bonds such as ethylene glycol diacrylate, ethylene glycol dimethacrylate, and 1,3-butanediol dimethacrylate; divinyl compounds such as divinylaniline, divinyl ether, divinyl sulfide, and divinyl sulfone; compounds having three or more vinyl groups, and the like may be used individually or in combination.

In the method of producing the magnetic toner of the present invention by the polymerizing method, generally, the above-mentioned toner composite or the like is added suitably and the polymerization monomer system, which are dissolved or dispersed uniformly by dispersion machines, such as a homogenizer, a ball mill, a colloid mill, and an ultrasonic dispersion machine, is suspended in the water system medium containing a dispersed stabilizer. At this time, when the particle size of toner particles is made into the size of desired toner particles at a stretch using a high-speed dispersion machine like a high-speed stirring machine or an ultrasonic dispersion machine, the size of the toner particles obtained becomes sharp. As for the polymerization initiator addition, it may be added when adding other additives in a polymerization monomer, or may be mixed just before suspending in a water system medium. Immediately after granulation, before starting a polymerization reaction, the polymerization initiator which dissolved in the polymerization monomer or the solvent can also be added.

After granulation, stirring is performed to such an extent that a particle condition is maintained and floating and sedimentation of a particle are prevented using the usual stirring machine.

When producing the magnetic toner of the present invention, a surfactant known as a dispersed stabilizer, and an organic dispersant and an inorganic dispersant can be used. Especially, the inorganic dispersant is hard to produce harmful super fines, since dispersed stability has been acquired by the steric hindrance property, even if a reaction temperature is changed, stability does not collapse easily. Since the inorganic dispersant is easy to wash, and is hard to have a bad influence on toner, it can be used preferably. As an example of the inorganic dispersant, inorganic compounds, such as phosphoric acid polyvalent metal salts like tricalcium phosphate, magnesium phosphate, aluminum phosphate, zinc phosphate, and hydroxyapatite; carbonate like calcium carbonate, and magnesium carbonate; mineral salt like meta-calcium silicate, calcium sulfate and barium sulfate; a calcium hydroxide; magnesium hydroxide; and aluminum hydroxide, are mentioned.

As for these inorganic dispersants, it is preferable that 0.2 to 20 parts by mass are used to the polymerization monomer 100 parts by mass. The above-mentioned dispersed stabilizer may be used independently or two or more sorts of them may be used together. The surfactant of 0.001 to 0.1 parts by mass may be used together.

When using these inorganic dispersants, it may be used as it is, but in order to obtain finer particles, in a water system medium, the inorganic dispersant particle can be generated for use. For example, in the case of tricalcium phosphate, a sodium phosphate aqueous solution and a calcium chloride aqueous solution can be mixed under high-speed stirring, the calcium phosphate of water insolubility can be generated, and more uniform and fine dispersion is attained. At this time, a water-soluble sodium chloride salt is generated as a byproduct simultaneously. However, since it will become difficult to generate the super-particle toner which depends on emulsion polymerization because the dissolution in the water of polymerization monomers is controlled if a water-soluble salt exists in a water system medium, which is more convenient.

As the surfactants, for example, sodium dodecylbenzene sulfate, sodium tetradecyl sulfate, sodium pentadecyl sulfate, sodium octyl sulfate, sodium oleate, sodium laurate, sodium stearate, and potassium stearate may be given.

Generally in the polymerization process, at 40° C. or more of polymerization temperature polymerization is performed by setting it as the temperature of 50 to 90° C. If it is polymerized in this temperature range, the kind of the release agent or wax which should be confined inside deposits according to phase separation. Therefore, intention becomes much more perfect. If it is a telophase of a polymerization reaction in order to consume the remaining polymerization monomer, it is possible to raise the reaction temperature up to 90 to 150° C.

The magnetic toner of the present invention can be obtained by a polymerization toner particles performing filtration, washing, and desiccation by a well-known method after polymerization termination, mixing inorganic fine particles and adhering it to the surface if needed. It is also possible to put a classification process into a production process, and to cut coarse powder and fines.

In the present invention, in order to give good fluidity to toner and to make (the floodability index of Carr/the fluidity index of Carr) into a specific value, it is preferable that fine particles are added to toner. These fine particles can be used for both an organic particle and an inorganic particle, and all well-known things can be used.

However, the fine particle having the reverse polarity to the toner is easy to accumulate in the charging member. Therefore, in the case of using it, the particle of low resistivity is chosen or it is preferable that the small quantity of 0.01 to 1.00 part by mass is used per 100 parts by mass of toner particles as an addition amount.

In the present invention, toner in which inorganic fine particles with a number average primary particle size of 4 to 80 nm is added as a plasticizer is a preferable form. Inorganic fine particles in which functions such as adjustment of charge amount of toner, and improvement in environmental stability, are imparted by treatment of carrying out hydrophobic treatment of the inorganic fine particles, are preferable forms, although added for improvement of fluidity of toner, and charging equalization of toner particles.

When the number average primary particle size of inorganic fine particles is larger than 80 nm, or when no inorganic fine particles each having a particle size of 80 nm or less are added, the transfer residual toner tends to anchor to the charging member when it adheres to the charging member. Therefore, it is difficult to stably obtain good charging characteristics. Moreover, good toner fluidity is not acquired, and the charging of toner particles tends to become uneven, so that problems such as buildup of fog, lowering of image concentration, and toner scattering cannot be avoided. When the number average primary particle size of inorganic fine particles is smaller than 4 nm, the coherence of inorganic fine particles becomes strong, and the particles tend to behave not as primary particles but as an aggregate having a broad particle size distribution and a strong coherence of such magnitude that the particles cannot be separated even by crack treatment. Thus, the image defects due to development of the aggregate, damaging of an image bearing member, or a magnetic toner carrying member, or the like easily occurs. In order to make charging distribution of toner particles more uniform, the number average primary particle size of inorganic fine particles Is preferably 6 to 35 nm. In the present invention, in a measuring method of the number average primary particle size of inorganic fine particles, the measurement can be achieved as follows. While contrasting a photograph of toner mapped by an element included in inorganic fine particles with a photograph of the toner obtained by enlarging radiography with a scanning electron microscope, and further with element-analysis means such as XMA attached to the scanning electron microscope, 100 or more primary particles of the inorganic fine particles which adhere to or are liberated from the toner surface are measured, and the average primary particle size of a number basis, namely the number average primary particle size is determined, so that the measurement can be achieved.

Silica, titanium oxide, alumina, etc. can be used as inorganic fine particles to be used in the present invention.

For example, dry type silica generated by vapor phase oxidation of silicon halide which is so called the dry process or the fumed silica, and wet type silica manufactured from water glass, etc. can be both used for silicic acid fine particles. However, more preferred is the dry type silica which has few silanol groups on the surface and in silica fine particle and produces few production remnants such as $Na_2O$ and $SO_3^{2}$—. Also, in the dry type silica, in a production process, other metal halides, such as alumininum chloride, and titanium chloride are used along with a silicon halide, so that it is also possible to obtain composite fine particles of silica and other metal oxides, and the powders are also included.

It is preferred that the addition amount of the inorganic fine particles whose number average primary particle size is 4–80 nm is 0.1 to 3.0% by mass with respect to toner particles. If the addition amount is less than 0.1% by mass, the effect of addition is insufficient, and fixability worsens if the addition amount is above 3.0% by mass or more.

The content of inorganic fine particles can be quantified using the calibration curve created from the standard sample using X-ray fluorescence analysis.

As for inorganic fine particles, in the present invention, they are preferably subjected to hydrophobic treatment for improved environmental stability. If the inorganic fine particles added to toner absorb moisture, charge amount of toner particles will fall remarkably, charge amount will tend to become uneven, and toner scattering will become easy to take place.

As a treatment agent used for hydrophobing treatment, treatment agents, such as a silicon varnish, various denaturation silicone varnishes, silicone oils, various denaturation silicone oil, a silane compound, a silane coupling agent, other organic silicon compounds, and an organic titanium compound, may be used independently or in combination and processed.

Of those, preferred are those processed by silicone oil, and more preferred are those processed by silicone oil after or simultaneously with the hydrophobic treatment of the inorganic fine particles with a silane compound, because they maintain the charge amount of toner particles at a high level also under a high humidity environment and will prevent toner scattering.

As the treatment method of such inorganic fine particles, after performing a silanizing reaction using a silane compound and eliminating a silanol group by a chemical bond, for example as a first-stage reaction, a hydrophobic thin film can be formed in the surface by silicone oil as the second-stage reaction.

The viscosity at 25° C. of the above-mentioned silicone oil is in the range of 10 to 200,000 $mm^2$/sec, more preferably in the range of 3,000 to 80,000 $mm^2$/sec. In the case of being less than 10 $mm^2$/sec, there is no stability in inorganic fine particles, and there is a tendency for the image quality to deteriorate due to heat and a mechanical stress. With a viscosity exceeding 200,000 $mm^2$/sec, there is a tendency for uniform treatment to become difficult.

As the silicone oil used, dimethyl silicone oil, methyl phenyl silicone oil, a-methyl-styrene denaturation silicone oil, chrol phenylsilicon oil, fluorine denaturation silicone oil, etc. are particularly preferred, for example.

As a method of processing inorganic fine particles by silicone oil, for example, the inorganic fine particles and silicone oil which were processed with the silane compound may be directly mixed using mixers, such as a Henschel mixer, or a method of spraying the silicone oil to the inorganic fine particles may be used. The method of adding inorganic fine particles after dissolving or dispersing silicone oil in a suitable solvent, mixing them, and removing solvent may also be used. A method of using a sprayer is more preferable because of relatively rare generation of the aggregate of inorganic fine particles.

The treatment amount of the silicone oil is 1 to 40 parts by mass, preferably 3 to 35 parts by mass, with respect to 100 parts by mass of inorganic fine particles. If the amount of the silicone oil is too small, good hydrophobicity will not be acquired, but when it is too large, there is a tendency that defects such as fog occur.

As the inorganic fine particles used in the present invention, in order to impart good fluidity to toner, those having a specific surface area, which is measured by the BET method adsorption method utilizing nitrogen adsorption in the range of 20 to 350 $m^2$/g are preferred, and those having a surface area of 25 to 300 $m^2$/g are more preferred.

The magnetic toner of the present invention contains the conductive fine particles explained below. As for the content of the conductive fine particles to the whole toner it is preferred that it is 0.2 to 10% by mass. In the present invention, a difference in charge amount between the toner recovered in the developing portion and the toner newly supplied/developed is preferably small, and for this reason, not only injection charging property but also uniform charging effect in recovery/development can be exhibited by adding the conductive fine particles to toner particles.

When the content of the conductive fine powder to the whole toner is less than 0.2% by mass, the developing property tends to deteriorate because the distribution of charging spreads. An amount of conductive fine particle sufficient to overcome the charging inhibition by adhesion and mixing of insulating residual toner to the contact-charging member for charging and to change an image bearing member in a favorable manner cannot be intervened in the contact portion between the charging member and the image bearing member or in the charging region in the vicinity of the contact portion, so that charging property falls, and charging failure occurs. In the case where the content is larger than 10% by mass, an amount of the conductive fine particle recovered by cleaning simultaneously with development becomes too large. Therefore, the charging ability of the toner in the developing portion and developing property are reduced, and a reduction in image concentration and toner scattering can easily occur. As for the content of the conductive fine particle to the whole toner, it is further preferred that it is 0.5 to 5% by mass.

As for the resistivity of the conductive fine particle, it is preferred that it is $10^9$ Ω·cm or less. When the resistivity of the conductive fine particle is larger than $10^9$ Ω·cm, the developing property tends to fall as described above. In the case where the conductive fine particle is applied to a method of image forming utilizing cleaning simultaneous with development, there are the following problems. That is, even if the close contact of the contact-charging member with the image bearing member through the conductive fine particle is maintained by making the conductive fine particle be intervened in the contact portion between the charging member and the image bearing member or In the charging region in the vicinity thereof, the charging facilitating effect for obtaining good charging property is not acquired. In order to fully exploit the charging facilicating effect of the conductive fine particle and to obtain good charging property in a stable manner, it is preferred that the resistivity of the conductive fine particle is smaller than the resistivity of the surface section of the contact-charging member or the contact portion with the image bearing member. More preferably, the resistivity of the conductive fine particle is $10^6$ Ω·cm or less.

As for the conductive fine particle contained in the magnetic toner of the method of image forming of the present invention, it is preferred to use those having a mean grain size smaller than the volume average particle size of magnetic toner particles, and those having a volume average particle size 0.3 μm or more are more preferred. If the average particle size of the conductive fine particle is small, in order to prevent lowering of the developing property, the content of the conductive fine particle to the whole toner must be set small. If the average particle size of the conductive fine particle is less than 0.3 μm, the effective dose of the conductive fine particle cannot be secured, and in the charging step, an amount of the conductive fine particle sufficient to overcome the charging inhibition by adhesion and mixing of insulating transfer residual toner to the contact-changing member cannot be intervened in the contact portion between charging member and the image bearing member or in the charging region in the vicinity thereof, so that charging failure can easily occur. In view of this, the average particle size of conductive fine particle is preferably, 0.8 μm or more, and more preferably 1.1 μm or more.

If the volume average particle size of the conductive fine particle is larger than the average particle size of magnetic toner particles, when mixed with toner particles, they can become easy to be liberated from the toner particles, and in the developing step, the amount of supply from the development container to the image bearing member becomes insufficient so that satisfactory charging property is hardly obtained. The conductive fine particle which dropped out of the charging member blocks or diffuses the exposure light which writes in an electrostatic latent image, causing a defect in the electrostatic latent image to reduce image quality. Further, if the average particle size of the conductive fine particle is large, the number of particles per unit mass will decrease. Thus, a reduction and deterioration of the conductive fine particle due to droppage from the charging member etc. arise. Therefore, in order to continuously supply fine particles to the contact portion between the charging member and the image bearing member or to the charging region in the vicinity thereof, or in order for the contact-charging member to maintain its close contact with the image bearing member through the conductive fine particles to thereby stably obtain good charging property, it is necessary that the content of the conductive fine particle to the whole toner must be enlarged. However, if the content of the conductive fine particles is enlarged too much, the charging ability and developing property of the toner as a whole will be reduced particularly under a high humidity environment, so that a reduction in image concentration and toner scattering will occur. In view of this, the mean grain size of the conductive fine particle is preferably 5 μm or less.

The conductive fine particles are preferably transparent, white, or light-colored because conductive fine particles transferred onto the transferring material do not become conspicuous as fogs. It is preferable that the conductive fine particles are transparent, white, or light-colored also from the viewpoint of not becoming a hindrance to the exposure light in an electrostatic latent image forming process, and it is more preferable that the permeability of the conductive fine particles to the exposure light is 30% or more.

In order to stably obtain charging property by further improving releasing property from the image bearing member or the charging member, it is also preferred that the conductive fine particles be subjected to a surface treatment with a coupling agent or a lubricant in the same manner as the above-mentioned inorganic fine particles, as far as this does not interfere with the resistivity of the present invention, and this notably alleviates the reduction uniform charging property due to accumulation of the transfer residual toner on the surface of the charging member.

As a lubricant which carries out the surface treatment of the conductive fine particles, natural or synthetic oils, a varnish, wax, fatty acid and its derivative, or resins containing a fluorine compound or a fluorine atom etc. may be used. One of those ay be used alone or two or more may be used in combination.

As a lubricant which performs the surface treatment of the conductive fine particles, those with which it is easy to treat the surface of the conductive fine particle uniformly and which are not easily desorbed from the surface of the conductive fine particles are preferred. In view of this, as a lubricant, (various denaturation) silicone oils, (various denaturation) silicone varnishes, fatty acid or its derivative with the carbon number of five or more, or a fluorine denaturation compound are preferred. Of those, a titanium coupling agent or an aluminum coupling agent which has silicone oil and alkyl part with the carbon number of five or more, fatty acid metal salt with a carbon number of five or more, or a fluorine denaturation coupling agent is particularly preferred.

As a result of examination, it is found that in the case where toner is produced using the toner particles of the present invention which are excellent in fluidity, the above-mentioned inorganic fine particles, and the conductive fine particles that have been subjected to the surface treatment, and the ratio of the floodability index to a fluidity index of the present invention is obtained, adjustment of the mixing conditions is important; for example, when toner is produced using the conductive fine particles treated with silicone oil, it is necessary make the adhesion be somewhat weak.

In the present invention, the following procedures were performed to measure the light transmittance of fine particles.

Permeability is measured in the state where one layer of the conductive fine particles of a transparent film which has an adhesive layer on one side is fixed. Light was irradiated in a direction perpendicular to the sheet and light transmitted through the film back surface is condensed to measure the quantity of light. The permeability of the fine particles was computed as a net quantity of light from the quantity of light obtained when only using a film and that obtained when the particles are adhered. The measurement was actually made using a 310 T transmission densitometer from X-Rite Incorporated.

As the conductive fine particles of the present invention, carbon such as carbon black and graphite; metal fine particles of copper, gold, silver, an aluminum, and nickel; metal oxides, such as zinc oxide, titanium oxide, tin oxide, aluminum oxide, indium oxide, silicon oxide, magnesium oxide, barium oxide, molybdenum oxide, iron oxide, and tungstic oxide; or metallic compounds such as a molybdenum sulfide, cadmium sulfide, and potash titanate, or a composite of those may be used by adjusting the particle size and particle size distribution if needed. Of those, a fine particle that has inorganic oxides, such as zinc oxide, tin oxide, and titanium oxide, at least on the surface is particularly preferred.

Particles which have on the surface a conductive material or a metal oxide containing 0.1–5% by mass content of elements different from the main metallic element of a conductive inorganic oxide, such as antimony and an aluminum, can also be used for the purpose of controlling the resistivity of the conductive inorganic oxide. Examples thereof include titanium oxide fine particles subjected to surface treatment with tin oxide/antimony, stannic oxide fine particles doped with antimony, and stannic oxide particles. Here, "the main metallic element of an oxide" means the main metallic elements like titanium or tin which is coupled with oxygen, when the oxide is, for example, titanium oxide or tin oxide.

Further, those in which the inorganic oxide is of the oxygen deficiency type are also used preferably. As conductive titanium oxide fine, particles treated with commercially available tin oxide/antimony, EC-300 (Titan Kogyo K.K.), ET-300, HJ-1, HI-2 (Ishihara Sangyo Co., Ltd.), W-P (MITSUBISHI MATERIALS CORP.), etc. may be given, for example. As the conductive tin oxide doped with commercial antimony, T-1 (MITSUBISHI MATERIALS CORP.), SN-100P (Ishihara Sangyo Co., Ltd.), etc may be given, and as commercial stannic oxide, SH—S (Nihon Kagaku Sangyo Co., Ltd.) etc. may be given. Especially preferred is the metal oxide and/or the oxygen deficiency type metal oxide which contain aluminum, from a viewpoint of developing property.

In the measurement of the volume average particle size and the average particle distribution of the conductive fine particles in the present invention, a liquid module was attached to LS-230 laser diffraction type particle-size-distribution measuring apparatus manufactured by Coulter, Inc., and the measurement was performed in the 0.04 to 2,000 micrometer measurement range. As the measuring method, after adding the surfactant of a minute amount to 10 ml of pure water, 10 mg of samples of the conductive fine particles is added to this, followed by dispersion using an ultrasonic dispersion machine (ultrasonic homogenizer) for 10 minutes, and thereafter the measurement was performed once for 90 seconds.

In the present invention, the following methods are used for adjusting the particle size and particle size distribution of the conductive fine particles. One is a method of setting the production method and production conditions so that a desired particle size and desired particle size distribution may be acquired for the primary particles of the conductive fine particles at the time of production. In addition, a method of flocculating small grains of primary particle, a method of grinding large grains of primary particle, a method using classification etc. are also possible. Further, a method of adhering or fixing conductive particles onto a part or the entire of the surface of base material particles having a desired particle size and particle size distribution, a method of using the conductive fine particles in which conductive components are dispersed in particles of a desired particle size and particle size distribution etc. are possible. It is also possible to adjust the particle size and particle size distribution of the conductive fine particles by combining these methods.

A particle size in the case where the grain of the conductive fine particles is constituted as floc is defined as average particle size as the floc. The conductive fine particles not only exist in the state of primary particles, but may also exist in the state of the aggregated secondary particles. The conductive fine particles may exist in any aggregation state as far as they are intervened in the contact portion between the charging member and the image bearing member or in the charging region in the vicinity thereof to aid in or promote the charging. In the present invention, the measurement of the resistivity of the conductive fine particles was performed by using the tablet method followed by normalization. Namely, while putting about 0.5 g of fine-particle sample into a cylinder having a base area of 2.26 $cm^2$ and applying a pressure of 147 N (15 kg) to the upper and lower electrodes, specific resistivity was computed by applying a voltage of 100V to obtain a resistivity and then normalizing the value.

A specific surface is computed using specific surface area measuring apparatus AUTOSOBE 1 (manufactured by YUASA IONICS) by making nitrogen gas absorbed onto the sample surface according to a BET method, and then using a BET multipoint method.

It is also preferred that the magnetic toner of the present invention be added with, for the purpose of improving the cleaning property, inorganic or organic fine particles having almost spherical shape and with the primary particle size of not less than 30 nm (preferably a comparative surface area of less than 50 $m^2/g$), more preferably 50 nm or more (preferably a specific surface area of not more than 30 $m^2/g$). For example, a spherical silica grain, a spherical polymethyl silsesquioleate grain, or a spherical resin grain is used preferably.

As the magnetic particles used in the present invention, further other additives, for example, lubricant powder such as polyfluoroethylene powder, zinc stearate powder, and polyvinylidene fluoride powder, abrasives such as cerium oxide powder, silicon carbide powder, and strontium titanate powder; fluidity imparting agents, such as titanium oxide powder and aluminum oxide powder; caking inhibitors; or organic particles with reverse polarity or inorganic fine particles may be used in a small quantity as a developing property improver. These additives may also be used by subjecting its surface to hydrophobic treatment.

Now, the method of image forming of the present invention is explained below.

Figure 4:
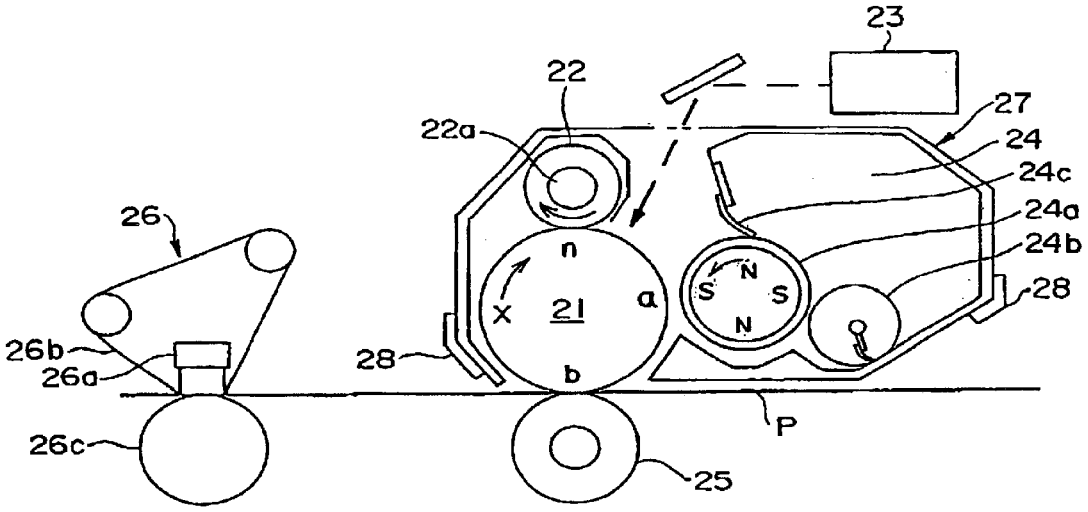
FIG. 4 is a schematic diagram showing a configuration of an image-forming apparatus for carrying out the method of image forming of the present invention.
Figure 5:
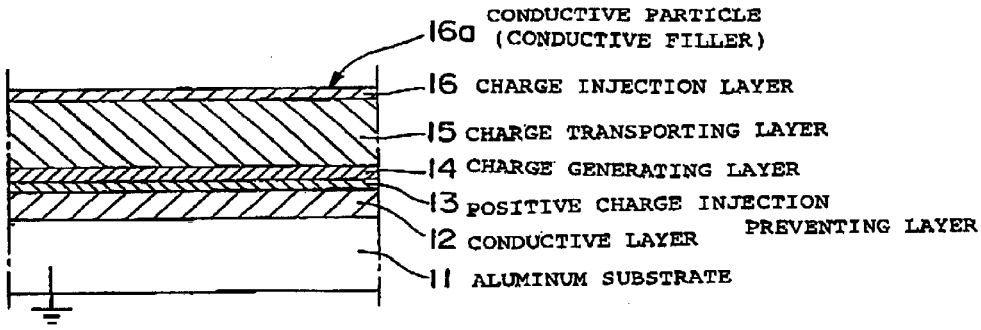
FIG. 5 is a schematic diagram showing a layered configuration of an image bearing member for carrying out the method of image forming of the present invention.

First, while the preferred embodiments of the method of image forming of the present invention will be explained in detail based on the drawings, the present invention is not limited to those at all. Next, the method of image forming of cleaning-simultaneous-with-development process (cleanerless system) will be specifically described as an embodiment of the present invention. FIG. 4 is a schematic configuration of an image forming apparatus in accordance with the present invention. The image forming apparatus is a laser printer (recording device) of a cleaning-simultaneous-with-development system (cleanerless system) in which a transfer type electrophotographic process is used. It has a process cartridge from which a cleaning unit that has a cleaning member like a cleaning blade is removed, magnetic one-component toner is used as a developer, and an example of the noncontact development in which a toner layer on a toner carrying member and an image bearing member are arranged in a noncontact manner.

Reference numeral 21 is a rotating drum type OPC photosensitive member as an image bearing member. It rotates at a constant peripheral speed (process speed) in the clockwise rotation of the arrow. Reference numeral 22 is a charging roller as a contact-charging member. The charging roller 22 is arranged in press contact with the photoconductor 21 by a predetermined pressing force against elasticity. In the figure, "n" is the charge-contact portion which is the contact portion of the photoconductor 21 and charging roller 22. The charging roller 22 is rotated in the charge-contact portion n which is a contact surface with the photosensitive member 21 in the opposite direction (direction opposite to the moving direction of the surface of the photosensitive member). That is, the surface of the charging roller 22 as contact-charging member has been given a speed difference with respect to the surface of the photosensitive member 21. The conductive fine particles 3 are applied to the surface of charging roller 22 so that coverage may become uniform.

Direct current voltage is applied to a core metal 22*a* of the charging roller 22 as charging bias from the charging bias application power supply. Here, charging treatment is uniformly carried out on the surface of the photosensitive member 21 by a direct-injection charging method at the electric potential almost equal to the applied-voltage to the charging roller 22. Reference numeral 23 denotes an exposure device. The electrostatic latent image corresponding to target image information is formed on the surface of the rotary photosensitive member 21 with this exposure device 23. Reference numeral 24 denotes a development device. The electrostatic latent image of the surface of the photosensitive member 21 is developed as a toner image by this development device 24.

This development device 24 is a noncontact reversal development device. This development device 24 approaches the photosensitive member 100, a cylindrical toner carrying member 24*a* (henceforth also referred to as a "development sleeve") made from non-magnetic metals, such as an aluminum and stainless steel, is arranged, and the gap of the photosensitive member 100 and development sleeve 24*a* is maintained in the fixed gap by the sleeve/the photosensitive member-gap-maintenance member or the like which is not illustrated. A magnet roller is fixed and arranged in the development sleeve 24*a* concentrically therewith. However, the development sleeve 24*a* is pivotable. In the magnet roller, two or more magnetic poles are provided as shown in the drawing, and development/amount regulation of toner coats/incorporation/conveyance/blowdown prevention/etc. are influenced. In developing portion a, which is the opposite section with the photosensitive member 21 (development range section), the development sleeve 24*a* is rotated with the peripheral speed of constant speed in the forward direction of the rotation direction of the photosensitive member 21. The coating of the toner is carried out to this development sleeve 24*a* by elastic blade 24*c* to form a thin layer. The thickness of the developer coated by the development sleeve 24*a* is regulated by the elastic blade 24*c*, and a charge is given thereto. By the rotation of the development sleeve 24*a*, the toner coated on the sleeve 24*a* is conveyed to the developing portion a which is the opposite section of the photosensitive member 21 and sleeve 24*a*. Developing bias voltage is applied to sleeve 24*a* from a developing bias impression electronic power supply. Furthermore, it allows to conduct one component jumping development between the developing sleeve 24*a* and the photosensitive member 21, where it is developing portion a.

Reference numeral 25 denotes a transfer roller as contact transfer means. The transfer roller 25 is in press contact with the photosensitive member 21 by a fixed linear load, and a transfer contact portion b is formed. A transfer material P as a recording medium is fed to this transfer contact portion b from the non-illustrated feed section at predetermined timing, and predetermined transfer bias voltage is applied to the transfer roller 25 from a transfer bias application power supply. Thus, the toner image on the side of the photosensitive member 21 is transferred one by one on the surface of the transfer material P fed to the transfer contact portion b. Then, the transfer is performed by impressing DC voltage using one with a fixed roller resistance. That is, nip conveyance of the transfer material P introduced into the transfer contact portion b is carried out in this transfer contact portion b, and the toner image formed and borne on the surface of the photosensitive member 21 is transferred one by one on the surface side of the transfer roller with electrostatic force and pressing force.

Reference numeral 26 denotes a fixing device of a heat fixing method, or the like. Being separated from the surface of the photosensitive member 21, the transfer material P which was fed to the transfer contact portion b and received transfer of the toner image on the side of the photosensitive member 21 is introduced into this fixing device 26, and is discharged out of a device as an image forming object (a print, copy) in response to fixing of a toner image.

This printer has removed the cleaning unit, and without being removed with a cleaner, the transfer residual toner on the surface of the photosensitive member 21 after the toner image transfered to the transfer material P is conveyed to the developing portion a via the charging-contact portion n along with the rotation of the photosensitive member 21, and cleaning simultaneous with development (recovery) is carried out in the development device 24 (recovery).

Furthermore, reference numeral 27 denotes an image forming apparatus and the process cartridge which can be detachably attached to the main body of the printer. The printer includes the process cartridge structured to collectively include three process units of the photosensitive member 21, charging roller 22, and the development device 24, which can be detachably attached. The combination of the process unit formed into a process cartridge etc. is not restricted above, and is arbitrary. For example, the combination of the photosensitive member 21 and the development device 24, the combination of charging roller 23 and the development device u24, the combination of the development device 24, the photosensitive member 21, and charging roller 22 etc. can be considered. Reference numeral 28 denotes a detachable guidance/maintenance member of process cartridge.

Next, the behavior of the conductive fine particles in the method for forming image of the present invention will be explained below. The conductive fine particles m are mixed in the developer t of the development device 24. An adequate amount thereof shifts to the photosensitive member 21 side with toner at the time of the toner development of the electrostatic latent image on the side of the photosensitive member 1 by the development device 24. Although the toner image on the photosensitive member 21 is attracted to the transfer material P side which is a recording medium and is positively transferred under the effect of transfer bias in the transfer section b, it does not transfer to the transfer material P side positively, and the conductive fine particles m on the photosensitive member 21 remains because of its conductivity and is substantially adhered and maintained on the photosensitive member 21.

In one embodiment of the present invention, the image forming apparatus does not include the cleaning step, so that the remaining conductive fine particles m and the transfer residual toner remaining on the surface of the photosensitive member 1 after the transfer are removed as follows. The residual toner and the remaining conductive fine particles m are directly transferred onto the charging part n which is a contact portion between the charging roller 22 as the contact-charging member and the photosensitive member 1 by the movement of the surface of the photosensitive member 21, followed by being adhered to or mixed in the charging roller 22. Therefore, after this, in a state where the conductive fine particles m exist in the charge-contact portion n between the photosensitive member 21 and the charging roller 22, direct-injection charging of the photosensitive member 21 is performed.

The presence of the conductive fine particles m allow the maintenance of fine contact and contact resistance of the charging roller 22 to the photosensitive member 21 even though some amount of the toner is adhered on or mixed in the charging roller 22, so that it becomes possible to perform the direct-injection charging of the photosensitive member 21 using the charging roller 22.

That is, the charging roller 22 is brought into close contact with the photosensitive member 21 through the conductive fine particles m. In other words, the conductive fine particles m existing in the mutual contact surface of the charging roller 22 and the photosensitive member 21, frictionally slides the surface of the photosensitive member 21 without a gap. The charging of the photosensitive member 21 by use of the charging roller 22 dominantly employs the direct-injection charging which does not utilize the discharge phenomenon because of the presence of the conductive fine particles m, so that the charging becomes stable and safe. Therefore, a high charging efficiency, which has not been attained by the conventional roller-charging or the like, can be attained by the present invention. As a result, it becomes possible to impart to the photosensitive member 21 a potential substantially equal to the voltage applied to the charging roller 22.

The transfer residual toner adhered to or mixed in the charging roller 22 is gradually discharged onto the photosensitive member 21 from the charging roller 22, is conveyed to the developing portion with movement of the surface of the photosensitive member 21, and cleaning of the toner simultaneous with development (recovery) is carried out in development means. The cleaning simultaneous with development recovers the toner which remained on the photosensitive member 21 after transfer as follows. Namely, the remaining toner on the photosensitive member 21 after the transfer, at the time of the developing of the subsequent image forming process, i.e., at the time of continuously charging the photosensitive member, exposing and forming a latent image, and developing the latent image, is recovered by using the fog eliminating electric potential difference (Vback) which is the electric potential difference between the direct current voltage applied to the development device, and the surface potential of the photosensitive member 21. In the case of reversal development as in the above-mentioned printer, this cleaning simultaneous with development is performed by the actions of the electric field which recovers toner from the dark section electric potential of the photosensitive member by developing bias to the development sleeve, and the electric field with which the toner is made to adhere from the development sleeve to the bright section electric potential of the photosensitive member 21.

Further, since the image forming apparatus operates, the conductive fine particles m made to have been mixed in the developer t of the development device 24 shift to the surface of the photosensitive member 21 in the developing portion a, pass the transfer section b by movement of the image bearing surface, and then are carried to the charging-contact portion n, so that fresh conductive fine particles m are sequentially supplied to the charging-contact portion n. As a result, even if the amount of the conductive fine particles m decreases by dropping etc. in the charging-contact portion n or conductive fine particles m deteriorate, there is prevented lowering of charging property, and good charging property is stabilized and is maintained.

Thus, in the image forming apparatus of a contact charging method, a transfer method, and a toner recycling process; the charging roller 22 being a simple contact-charging member is used, and irrespective of contamination by the transfer residual toner of the charging roller 22, stability can be maintained in ozoneless direct-injection charging over a long period of time with a low applied voltage. Accordingly, a simple configuration which can give uniform charging property and does not have the hindrance by an ozone product, the hindrance by poor charging, etc., and a low cost image forming apparatus can be obtained.

In order that the conductive fine particles m may not spoil charging property as mentioned above, the resistivity needs to be $1\times10^9$ Ω·cm or less. Therefore, when the contact development device in which the toner directly contacts the photosensitive member 21 in the developing portion a is used, through the conductive fine particles m in the toner, charge injection is carried out by developing bias to the photosensitive member 21, and image fog will occur.

However, in the above-mentioned example, since the development device is a noncontact development device, developing bias is not injected into the photosensitive member 21, and a good quality image can be obtained. Further, it is possible to give high electric potential difference between the development sleeve 24*a* and the photosensitive member 21, such as bias of AC, since charge injection to the photosensitive member 21 is not performed in the developing portion a. Therefore, the conductive fine particles m are easy to be developed uniformly, the conductive fine particles m are applied to the photosensitive member 21 surface uniformly, uniform contact is performed in the charging section, and good charging property is obtained, thereby attaining a satisfactory image.

By intervening the conductive fine particles m on the contact surfaces between the charging roller 22 and the photosensitive member 21, which is charging-contact portion n, it becomes possible to easily and effectively establish speed difference between the charging roller 22 and the photosensitive member 21 by the lubrication effect (the friction reduction effect) of the conductive fine particles m. By establishing the speed difference between the charging roller 22 and the photosensitive member 21, there can be greatly increased the chance that the conductive fine particles m contact the mutual contact surfaces, which is charging-contact portion n, of the charging roller 22 and the photosensitive member 21, so that high contacting property can be obtained and excellent direct-injection charging is possible.

In the present invention, by rotating the charging roller 22 in the direction opposite to the moving direction of the surface of the photosensitive member 21, a toner reservoir is provided immediately before the charging-contact portion n, the amount of toner in the charge-contact portion n is suppressed to an extreme degree, and the toner can be regularly charged/recovered.

In the method of image forming of the present invention, the photosensitive member uses photosensitive material, and an organic photosensitive member, a photosensitive member composed of amorphous silicon, etc. are used suitably.

For example, there are cases of providing a protecting film which is mainly composed of a resin on an inorganic photosensitive member, such as selenium and amorphous silicon, forming the surface layer with a charge transport material and a resin as a charge transporting layer of a functional discrete type organic image bearing member, and further providing thereon the above-mentioned protective layer. As means to give a releasing property to such a surface layer, there are proposed (1) Using a resin having a low surface energy for the resin constituting a film itself;

(2) Adding an additive which gives water-repellent and lipophilic properties;

(3) Making into the shape of fine particles a material which has high releasing property to be dispersed; and so on.

As an example of (1), it attains by introducing a fluorine containing base, a silicon containing base, etc. into the construction of a resin. As (2), a surfactant etc. may be used as an additive. As (3), fine particles of fluororesins such as the compound containing a fluorine atom, i.e., polytetrafluoroethylene, polyvinylidene fluoride, and carbon fluoride, are mentioned.

With these means, the contact angle over the water of the surface of the photosensitive member can be made into 85 degrees or more, and the transfer property of toner and the durability of the photosensitive member can be further increased. As for the contact angle over water, 90 degrees or more are preferable.

Among these means, the method of dispensing fine particles having releasing property such as a fluororesin of (3) on the outmost surface layer is preferred. It is particularly preferred to use polytetrafluoroethylene.

In order to make the surface contain these fine particles, the photosensitive member outmost layer is made to have the layer in which these fine particles are dispersed in the binder resin on the photosensitive member maximum surface, or if the organic photosensitive member is constituted by the resin as a main subject from the first, it does not need to newly provide a surface layer, and the fine particles may only be dispersed on the outmost layer. The addition amount is preferably in the range of 1 to 60% by mass and more preferably 2 to 50% by mass based on the surface layer gross mass. If it is lower than 1% by mass, the effect of improvements of transfer property of toner and durability of the photosensitive member is inadequate, and if it is higher than 60% by mass, film hardness will fall or the amount of incident light to the photosensitive member will fall remarkably, it is not desirable.

Measurement of a contact angle is defined at the location where the free surface of water touches the photosensitive member using a dropping-type contact angle meter (for example, CA-X type contact angle meter manufactured by Kyowa Interface Science Co., Ltd.), with the angle (angle in the inside of liquid) formed by a liquid level and the surface of the photosensitive member. The above-mentioned measurement shall be performed at a room temperature (about 21 to 25° C.).

Next, one of the preferred forms of the image bearing member used for the present invention is explained below. As the conductive substrate, a material of a cylindrical form or a sheet form may be used. The material may be selected from metals such as aluminum and stainless steel, plastics having coatings made of the aluminum alloy, an indium oxide and tin oxide alloy, or the like, paper in which the conductive particles are included, plastics, and plastics having conductive polymer.

On the conductive substrate, an under coat layer may be provided for the purposes of improving the adhesion property and coating property of the photosensitive layer protecting the base improving the charge injection property and protecting the electrical breakdown of the photosensitive layer. An under coat layer may be prepared with material such as polyvinyl alcohol, Poly-N-vinyl imidazole, polyethylene oxide, ethyl cellulose, methyl cellulose, cellulose nitrate, ethyleneacrylic acid copolymer, polyvinyl butyral, a phenol resin, casein, polyamide, copolymerization nylon, glue, gelatin, polyurethane, and aluminum oxide. The thickness of the under coat layer may be generally in the range of 0.1 to 10 $\mu$m, preferably about 0.1 to 3 $\mu$m.

The charge generation layer is prepared by dispersing and coating or depositing a charge generation material such as an inorganic material in or as appropriate. The inorganic material includes an azo pigment, a phthalocyanine pigment, an indigo pigment, a perylene pigment, a multi-ring quinone pigment, squalirium coloring matter, pyrylium salts, thio pyrylium salts, triphenylmethane coloring matter, selenium, and amorphous silicone. The binder can be selected from a wide range of binding. For example, polycarbonate resin, polyester resin, a polyvinyl butyral resin, polystyrene resin, an acrylic resin, a methacrylic resin, a phenol resin, a silicone resin, an epoxy resin, vinyl acetate resin, and the like may be given. The amount of the binder contained in a charge generation layer is preferably 80% by mass or less, more preferably 0 to 40% by mass. As for the thickness of the charge generation layer, it is preferably 5 $\mu$m or less, more preferably 0.05 to 2 $\mu$m.

A charge transportation layer receives charge carriers from the charge generation layer under existence of an electric field, and is capable of transporting the carriers. A charge transportation layer is formed by dissolving the charge transfer material into a solvent with a binder resin as necessary to use it for coating, and, generally the thickness thereof is 5 to 40 $\mu$m. As the charge transfer material, a polycycle aromatic compound which has a structure such as biphenylene, anthracene, pyrene and phenanthrene on its principal chain or a side chain, nitrogenous cyclic compound such as indole, carbazole, oxadiazole, and pyrazoline, hydrazone compound, styryl compound, selenium, selenium-tellurium, amorphous silicon, and sulfurate cadmium may be given. The binder resin which disperses the charge transporting materials may be one selected from resins such as polycarbonate resin, polyester resin, polymethacrylate, polystyrene resin, acrylic resin, and polyamide resin, and organic photoconductivity polymer, such as poly-N-vinylcarbazole, and polyvinyl anthracene.

A protective layer may be provided as a surface layer. The resin of a protective layer may be one or two or more of polyester, polycarbonate, acrylic resin, epoxy resin, phenol resin, and curing agent of these resins.

In order to adjust a volume resistivity, conductive particles may be dispersed in the resin of a protective layer. As an example of conductive particles, a metal, a metal oxide, etc. are mentioned and there are fine particles, such as zinc oxide, titanium oxide, tin oxide, antimony oxide, indium oxide, bismuth oxide, tin oxide-coated titanium oxide, tin-coated indium oxide, antimony-coated tin oxide, and zirconium oxide, preferably. They may be used independently, or may be used in combination with two or more kinds of particles. Generally, when dispesing the conductive particles in a protective layer, in order to prevent scattering of the incident light by the dispersed particles, it is required for the particle size to be smaller than the wavelength of incident light. As for the particle size of conductive particles dispersed in the protective layer according to the present invention, it is preferably 0.5 $\mu$m or less. The content in the inside of a protective layer is preferably 2 to 90% by mass to the total mass of the protective layer, more preferably 5 to 80% by mass. As for the thickness of a protective layer, it is preferably 0.1 to 10 $\mu$m, more preferably 1 to 7 $\mu$m.

The coating of a surface layer can be performed through spray coating, beam coating, or dipping coating of resin dispersion solution.

Next, the charging step in the present invention will be explained below. In the charging step, voltage is applied to a charging member which forms a contact portion and is in contact with an image bearing member to charge it. In the present invention, the contact portion which makes a conductive fine particle intervene between charging member and an image bearing member is provided. Therefore, as for the charging member, it is preferred to have elasticity, and since an image bearing member is charged by applying voltage to the charging member, it is preferred that the member has conductivity.

For this reason, it is possible to use a brush composed of conductive fibers or a magnetic brush contact-charging member including an elastic conductive roller and a magnetic brush part with magnetic particles being magnetically constrained. In use, the magnetic brush part is brought into contact with an object to be charged. However, according to the present invention, in terms of stable formation of a toner reservoir on a charging-contact portion n, the elastic conductive roller is used preferably. It is preferred to use the elastic conductivity roller which is a flexible member as the contact-charging member, also when bearing the conductive fine particle and performing direct-injection charging dominantly, while recovering the residual toner on an image bearing member temporarily.

This is because the opportunity that a conductive fine particle is in contact with the image bearing member in the contact portion between the contact-charging member and the image bearing member can be increased, high contact performance can be obtained, and direct-injection charging property can be increased, if the contact-charging member has flexibility. That is, the contact-charging member contacts the image bearing member closely through the conductive fine particles, such that, the conductive fine particles present on the contact portion between the contact-charging member and the image bearing member slide on the surface of the image bearing member without clearance. Thus, charging of the image bearing member by the contact-charging member is performed by existence of a conductive fine particle without using a discharge phenomenon. Therefore, stable and safe direct-injection charging becomes dominant. High charging efficiency was not acquired by conventional roller-charging. However, high charging efficiency is acquired in the present invention. Electric potential almost equivalent to the voltage applied to the contact-charging member can be given to the image bearing member.

The relative speed difference is made between the moving speed of the surface of the charging member and the moving speed of the surface of the image bearing member, which form the contact portion as described above, to greatly increase the chance that the conductive fine particles contact the image bearing member at the contact portion between the contact-charging member and the image bearing member. Therefore, it is advantageous in that the direct-injection charging properties can be improved as the high contact performance between these members can be obtained. The conductive fine particles are made to be placed at the contact portion between the contact-charging member and the image bearing member. The lubricous effect (the friction reduction effect) of a conductive fine particle is acquired by this configuration. According to this effect, buildup of large torque is not brought about between the contact-charging member and the image bearing member. In addition, it is possible to provide the speed difference without causing significant cutting or the like on the surface of the contact-charging member and the image bearing member. As the configuration for establishing the speed difference, by rotating the contact-charging member, there is provided the speed difference between the image bearing member and the contact-charging member.

As charging means, there are a method of using a charging roller and a charging blade, and a method of using a conductive brush. These contact charging means are effective in that high voltage becomes unnecessary and the development of ozone is decreased. As the materials of the charging roller and of the charging blade for the contact charging means, conductive rubber is preferred and may be provided with a releasing property film. In the surface there can be used a nylon resin, PVdF (polyvinylidene fluoride), PVdC (polyvinylidene chloride), a fluorine acrylate resin, etc.

The form of an elastic conductivity roller will not be stabilized if the hardness thereof has too low hardness, so that its contacting property with the object to be charged worsens, and an elastic conductivity roller surface is further cut or damaged by making a conductive fine particle B placed between the contact portion between the charging member and the image bearing member, so that a stable charging property is not obtained. If the hardness is too high, not only the charge-contact portion for charging is securable between the roller and the object to be charged, but also the micro contacting property to the surface of the object to be charged will worsen. Thus, 25 to 50 degrees are preferred by Oscar C hardness.

It is important that an elastic conductivity roller functions as an electrode having resistance low enough to charge a moving object to be charged, while the elastic conductivity roller gives elasticity and acquires sufficient contacting condition with the object to be charged. On the other hand, when defective parts, such as a pinhole, exist in the object to be charged, it is necessary to prevent leak of voltage. When the electrophotographic photosensitive member is used as the object to be charged, in order to obtain sufficient charging property and leak-proof, a volume resistivity is preferably $10^3$ to $10^8$ Ω·cm, and more preferably $10^4$ to $10^7$ Ω·cm The resistance of the roller is measured by applying voltage of 100 V between the core metal and an aluminum drum in the condition in which the roller is press-contacted to the cylindrical aluminum drum which is F30 mm such that the load of 9.8 N (1 kg) of total pressure may be applied to a core metal of the roller.

For example, an elastic conductivity roller is produced by forming a middle resistive layer made of rubber or a foam as a plasticity member on the core metal. The intermediate resistive layer is prescribed with a resin (for example, urethane), a conductive particle (for example, carbon black), a sulphidizing agent, a foaming agent, etc., and is formed into a roller shape on the core metal. It may be cut if needed after that, the surface may be ground into an appropriate form, and an elastic conductivity roller may be produced. The roller surface preferably has a very small cell or unevenness in order to make the conductive fine particles intervene.

It is preferable that the surface of the roller member has at least the hollow which is 5 to 300 μm in the diameter of an average cell in globular form conversion, and the percent of void on the surface of the roller member when assuming this recess as the void section is preferably 15 to 90%.

The material of a conductive elastic roller is not limited to the elastic foam. Examples of the materials of the elastic body include: rubber materials obtained by dispersing conductive materials for the resistance adjustment, such as carbon black and metallic oxide, to ethylene propylene diene polyethylene (EPDM), urethane, acrylonitrile-butadiene rubber (NBR), silicone rubber, polyisoprene rubber, and so on; and materials obtained by foaming these rubber materials. It is also possible to use the material having ion conductivity to carry out the resistance adjustment, together with the conductive material or without dispersing the conductive material.

The conductive elastic roller is pressurized by a given pressing force to be arranged so as to come in contact with the object to be charged as an image bearing member against elasticity. Therefore, the charge-contact portion which is the contact portion of the conductive elastic roller and the image bearing member is formed. Although the width of the charge-contact portion is not particularly limited, in order to obtain stability between the conductive elastic roller and the image bearing member, it is preferably 1 mm or more, more preferably 2 mm or more.

Next, a contact-transferring step preferably applied in the method of image forming of the present invention Is concretely explained.

In the contact-transferring step, the photosensitive member contacts the transfer member via a recording medium to transfer the toner image on the recording medium. The contact pressure of the transfer member is preferably a linear load of 2.9 N/m (3 g/cm) or more, and more preferably 19.6 N/m (20 g/cm) or more. If the contact pressure as the linear load is less than 2.9 N/m (3 g/cm), conveyance error of the recording medium and poor transfer performance are liable to be caused, which is not desirable.

Figure 3:
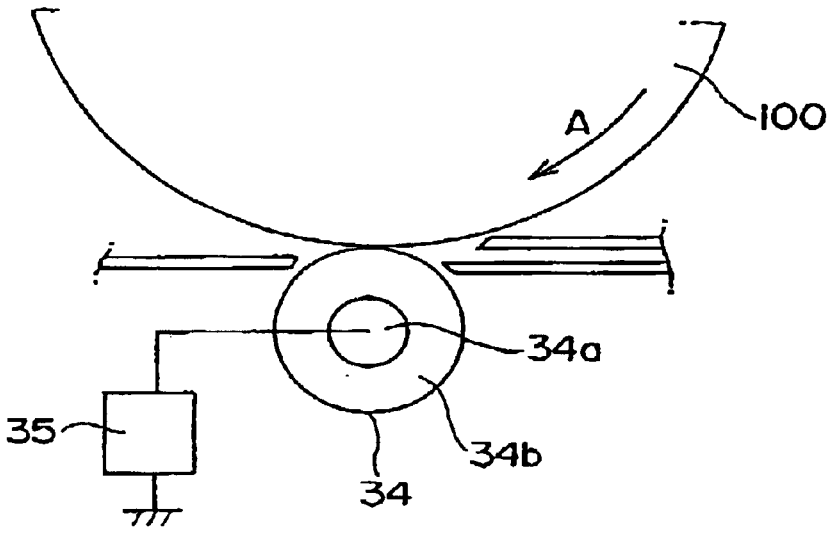
FIG. 3 is a schematic diagram showing a configuration of a contact transfer member for carrying out the method of image forming of the present invention.

As the transfer member in the contact-transferring step, a transfer roller, a transfer belt, or the like is used. An example of the configuration of a transfer roller is shown in FIG. 3. The transfer roller 34 is composed of at least a core metal 34*a* and a conductive elastic layer 34*b*. The conductive elastic layer 34*b* is made from elastic bodies having volume resistivities of about $10^6$ to $10^{10}$ Ω·cm, such as urethane, in which a conductive material such as carbon is dispersed therein, and epichlorohydrin rubber. A transfer bias is applied thereto by the transfer bias power supply 35.

The method of image forming of the present invention which adopts the contact transfer method is used particularly effectively in an image forming apparatus which includes a photosensitive member having a small diameter of 50 mm or less. That is, in the case of the photosensitive member having a small diameter, the curvature to the same linear load is large, and thus, the pressure is liable to concentrate in the contact portion. It is thought that the same phenomenon can be obtained with the belt photosensitive member. Therefore, the present invention is effectively used for the image forming apparatus that has a transfer section in which the radius of curvature is 25 mm or less.

In the method for forming image of the present invention, it is preferred that the magnetic toner is applied by a thickness thinner than the distance of closest approach (between S–D) of the magnetic toner carrying member and the photosensitive member on the magnetic toner carrying member to conduct development in the development step in order to obtain a high definition image without any fog. Although the toner thickness on the magnetic toner carrying member is generally regulated by the thickness regulating member (a magnetic cut, regulation blade, etc.) which regulates the magnetic toner on a magnetic toner carrying member, in the present invention, it is required to regulate the toner thickness by making the thickness regulating member contact the magnetic toner carrying member via the magnetic toner. As the thickness regulating member which contacts the toner carrying member, a regulation blade is common, which can be suitably used in the present invention.

By making the regulation blade contact the image bearing member to regulate the toner thickness, an improvement in transfer efficiency and reduction of fog can be achieved. It is considered that this is ascribable to the fact that the regulation blade contacts the toner carrying member under a specific contact pressure while the material of the regulation blade can be designed according to the charging property of the toner, and thus, sufficient frictional charging is performed and charge amount of the toner becomes high, thereby obtaining uniform charging property. Further, by thus suppressing fog and improving the transfer efficiency, satisfactory cleanerless property is maintained, and image defects, such as poor charging, are not caused, thereby maintaining a high definition image in a long-term usage.

As a regulation blade, a rubber elastic body such as silicone rubber, polyurethane rubber, or NBR; the synthetic resin elastic body such as polyethylene terephthalate; and further, even complexes thereof, may be used. Preferably, a rubber elastic body is suitable.

The material of the regulation blade greatly affects charging of the toner on the toner carrying member. Therefore, when an elastic body is used as the regulation blade, an organic substance or an inorganic substance may be added in the elastic body, fusion-mixed, or dispersed. As the substance to be added, for example, a metal oxide, a metal powder, ceramics, a carbon allotrope, a whisker, inorganic fiber, a dye, a pigment, and a surfactant may be given. Further, it may be used that is obtained by attaching a charge control substance such as a resin, rubber, or a metal oxide, to the elastic support member such as rubber, a synthetic resin, and a metal elastic body so as to make the charge control substance contact the toner carrying member at the contact portion in order to control the charging property of the toner. In addition, a material obtained by bonding a resin or rubber on a metal elastic body so as to contact the toner carrying member at the contact portion is preferred.

When the toner has negative charging property, as the elastic blade and charge control substance, it is preferable to choose the one that can be easily charged to the positive polarity, such as polyurethane rubber, urethane resin, polyamide resin, and nylon. When the toner has positive charging property, as the elastic blade and charge control substance, it is preferable to choose the one that can be easily charged to the negative polarity such as polyurethane rubber, urethane resin, silicone rubber, a silicone resin, polyester resin, a fluorine resin, and polyimide resin.

If a contact portion of the toner carrying member is made of a resin or the molding object of rubber, in order to adjust charging property of the toner, it is preferred to contain therein a metal oxide such as silica, alumina, titania, tin oxide, oxidation zirconia, zinc oxide; carbon black; or the charge control agent generally used for toner.

The base portion which is on the regulating blade upper section side is fixedly held at the toner container side, and the lower section side is bent to the forward or the opposite direction of the toner carrying member against the elastic force of the blade to contact the toner carrying member surface with a moderate elastic pressing force.

An effective contact pressure between the blade and the toner carrying member is provided as a linear load along a bus line of the toner carrying member in the range of 0.98 N/m (1 g/cm) or more, preferably 1.27 to 245 N/m (3 to 250 g/cm), more preferably 4.9 to 118 N/m (5 to 120 g/cm). When the contact pressure is smaller than 0.98 N/m (1 g/cm), the uniform application of the toner becomes difficult, causing fog and scattering. When the contact pressure exceeds 245 N/m (250 g/cm), the toner receives a large pressure and tends to be deteriorated, which is not preferable.

As a toner layer on the toner carrying member, it is preferred to form the toner layer of 5 to 50 g/m$^2$. When the amount of the toner on the magnetic toner carrying member is smaller than 5 g/m$^2$, it is hard to obtain a sufficient image density and the unevenness of the toner layer is caused due to an excess charging of the toner. When the amount of the toner on the magnetic toner carrying member exceeds 50 g/m$^2$, it is hard to charge the toner uniformly so that the transfer efficiency of the toner will fall. As a result, an increase in the occurrence of fog is caused and the toner is liable to be scattered, which is not preferred.

As the magnetic toner carrying member to be used in the invention, a conductive cylinder (development roller) made of a metal such as aluminum or stainless steel or an alloy thereof is preferably used. The conductive cylinder may be formed with the resin composite which has a sufficient mechanical strength and conductivity. Alternatively, a conductive rubber roller may be used. Furthermore, the toner carrying member is not limited to such a cylindrical form. It may be formed of an endless belt which performs a rotary movement.

As for the surface roughness of the magnetic toner carrying member used for the present invention, it is preferable to be in the range of 0.2 to 3.5 μm on the basis of the JIS center line average roughness (Ra). When Ra is smaller than 0.2 μm, the charge amount on the magnetic toner carrying member increases. Thus, the developing properties of the toner becomes insufficient. When Ra exceeds 3.5 μm, unevenness is caused in the toner coat layer on the magnetic toner carrying member, which is liable to result in occurrence of concentration unevenness on the resulting image. It is more preferred that the surface roughness is in the range of 0.5 to 3.0 μm.

The surface roughness Ra of the magnetic toner carrying member is equivalent to the center line average roughness measured using a surface roughness measuring instrument (Surf Coder SE-30H, produced by Kosaka Laboratory, Co., Ltd.) based on the JIS surface roughness "JIS B 0601". Concretely, a 2.5 mm portion is sampled as a measurement length "a" in the direction of the central line from a roughness curve. That is, when the central line of this sampling portion is represented by the X-axis, the depth magnification by the Y-axis, and a roughness curve by y=f (x), the surface roughness Ra is a value obtained from the following equation (12) and represented in micrometer (μm).

$$Ra = 1/a \int_0^a |f(x)|\,dx \qquad \text{equation (12)}$$

The surface roughness (Ra) of the magnetic toner carrying member of the invention can be made to have the value within the above-mentioned range, by changing the polishing condition of the surface layer of the toner carrying member, or adding spherical carbon particles and carbonization fine particles, graphite, and so on into surface layer.

Furthermore, for attaining a high charging ability of the magnetic toner of the present invention, it is preferable to control the total amount of charging at the time of developing. Thus, the surface of the magnetic toner carrying member of the present invention may be preferably coated with the conductive fine particles and/or a resin layer in which a lubricant is being dispersed.

The conductive fine particles contained in the coating layer of the magnetic toner carrying member preferably have a resistivity of 0.5 Ω·m or less after being pressurized at 11.7 Mpa (120 kg/cm$^2$). In addition, preferable conductive fine particles may be carbon fine particles, a mixture of carbon fine particles and crystalline graphite, or crystalline graphite. Furthermore, preferably, the contact fine particles may be those having particle size of 0.005 to 10 μm.

As the resin used for the resin layer, thermoplastic resins such as styrene resins, vinyl resins, polyethersulfone resins, polycarbonate resins, polyphenylene oxide resins, polyamide resins, flourine resins, cellulose resins, and acrylic resins; thermosetting resins such as epoxy resins, polyester resins, alkyd resins, phenol resins, melamine resins, polyurethane resins, urea resins, silicone resins, and polyimide resins; and photosetting resins can be used.

Among them, resins having releasing property, for example a silicone resin and a fluororesin, or resins excellent in the mechanical properties, for example polyethersulfone, polycarbonate, polyphenylene oxide, polyamide, a phenol resin, polyester, polyurethane, and styrene resins, are preferred. In particular, a phenol resin is particularly preferred. Preferably, 3 to 20 parts by mass of the conductive fine particles are used with respect to 10 parts by mass of the resin component.

In the case of using the combination of carbon fine particles and graphites, it is preferable to use 10 parts by mass of graphites and 1 to 50 parts by mass of carbon particles. The volume resistivity of the resin layer of the magnetic toner carrying member in which the conductive fine particles are dispersed is preferably in the range of $10^{-6}$ to $10^{6}$ Ω·cm.

In the present invention, the surface of the magnetic toner carrying member that carries the magnetic toner moves preferably in the same direction as the surface of the image bearing member. The moving speed of the toner carrying member, which is also referred to as a moving speed ratio, is preferably 1.00 to 1.80 times the moving speed of the image bearing member. When the moving speed ratio is less than 1.00, the quality of the resulting image tends to be deteriorated. The more a moving speed ratio increases, the more amount of the toner supplied to a developing portion. As a result, an image faithful to a latent image can be obtained. However, when the moving speed of the toner carrying member is 1.80 times faster than the image bearing member, the toner deterioration tends to occur easily, thus degrading the image quality after long-term usage.

The image bearing member of the present invention has a fixed magnet having a plurality of magnetic poles, preferably 3 to 10 magnetic poles, therein. The center of the development pole of the magnet is usually located on the line that connects the center of the image bearing member and the center of the toner carrying member. In the present invention, however, the center line of the development pole of the magnet is shifted at an angle of 3° to 10° toward the upstream side of the line connecting the image bearing member and the toner carrying member because such an arrangement is preferable in preventing increase in the occurrence of fog even in a long-term usage. When the development pole is on the center line, it is considered that the recovery of the residual toner which exists on the image bearing member is performed only in a development area. However, it is considered that the recovery of the residual toner by a magnetic field starts in the upstream side rather than in the usual development area by shifting the development pole toward the upstream, thus suppressing occurrence of fog even in a long-term usage. For this reason, it is preferable to shift the development pole at an angle of 3° or more toward the upstream side. However, as the development area is almost fixed without depending on the position of the magnetic field, the shifting of the development pole toward the upstream by 10° or more causes lowering of developing property, an image omission, or the like, which is not preferable.

In the present invention, the developing step including cleaning may be preferably designed as a step in which an alternating developing bias is applied on the magnetic toner carrying member and the toner is transferred onto an electrostatic latent image on the photosensitive member to form a toner image. The developing bias may be a voltage obtained by superimposing a direct current on an alternating current.

As an electric current waveform of an alternating electric field, a sine wave, a square wave, and a triangular wave are suitably selected. Alternatively, it may be a pulse wave formed by periodically turning on and off the direct current power source. Thus, the bias in which the voltage value changes periodically can be used as the waveform of the electric current in an alternating electric field.

As a developing bias to be applied between the magnetic toner carrying member that carries the toner and the image bearing member, it is preferable to be in the range of 3.8 to 4.8 v/μm at the maximum electric field intensity at the time of developing, and the frequency thereof is preferably in the range of 1600 to 4500 Hz.

The maximum electric field intensity at the time of developing can be expressed by the following equation.

$$\text{Maximum electric field intensity}=\{1/2Vpp+(VL-Vdc)\}/(\text{between S–D})$$

wherein Vpp denotes a peak-to-peak voltage of the alternating current voltage, VL is a bright section potential of the image bearing member, and Vdc is a potential of the direct current voltage. Here, when the ratio between the duration of the electric field being applied at the time of developing and the duration of the retracting electric field is different (to be described later), the potential of the alternating current component at the time of developing is used instead of 1/2 Vpp.

If the maximum electric field intensity is raised, the development of high tribo toner with a strong adhesion with an image bearing member will be performed, thus being capable of obtaining a high definition image. The maximum electric field intensity can be raised by raising the Vpp of the alternating current voltage. In addition, since the retracting electric field strength by an image bearing member is also raised in this case, the recovering ability can be improved. Therefore, it is preferred that the maximum electric field at the time of developing is 3.8 v/μm or more. However, when the maximum electric field intensity is raised, occurrence of fog is likely to increase. If the maximum electric field intensity is larger than 4.8 v/μm, the occurrence of fog is increased, and a dielectric breakdown is liable to be caused, which is not preferable.

When the frequency of alternating current bias is examined, in a frequency less than 1600 Hz, occurrence of toner fog increases, and the number of times of development and pull back decreases, thereby deteriorating the image quality. On the other hand, it becomes impossible for the toner to follow the bias in a frequency higher than 4500 Hz, thereby lowering the concentration and the recovering ability, which is not preferable.

Furthermore, when the time t1 is defined as an application time period of the voltage to be applied in the direction in which the magnetic toner is scattered among the alternating current components of the alternating electric field applied on the toner carrying member, and the time t2 is defined as an application time period of the voltage in the direction to which magnetic toner is recovered from the image bearing member, the ratio of t1/t2 is preferably in the range of 1.10 to 2.30, so that good developing property can be retained while decreasing fog.

The reasons of such phenomenon are as follows.

When the ratio of t1/t2 is raised, the voltage becomes low while the application time period of the voltage applied in the development direction is long. On the other hand, the retracting voltage will become high if the application time period of retracting voltage becomes short, and the retracting strength of the toner on the image bearing member becomes high, thereby decreasing occurrence of fog, which is preferable. If the t1/t2 is too high, the concentration of the toner becomes diluted, so that the selective development is likely to occur, causing fog or the like during the latter half of endurance, which is not preferable, For this reason, it is preferred that the ratio of t1/t2 is preferably in the range of 1.10 to 2–30, more preferably 1.15 to 1.80.

In the present invention, it is preferred that the process of forming an electrostatic latent image on the charging surface side of the image bearing member is performed by image exposure means. The image exposure means for forming an electrostatic latent image is not limited to a laser scanning method. Other light emitting devices, such as the general analog image exposure and LED, or a combination of a light emitting device, such as a fluorescent light, and a liquid crystal shutter, may be used instead, provided that form electrostatic latent image corresponding to image information can be formed.

EXAMPLES

Hereinafter, the invention will be described concretely with reference to the production example and practical examples. However, the present invention is not limited to these examples. Furthermore, all of parts in the formulations described below denote parts by mass.

<1> Production of Magnetic Substance

As described below, surface-treated magnetic substances 1 to 13, and a magnetic substance 1 were obtained.

<Production of Surface-treated Magnetic Substance 1>

In a ferrous sulfate aqueous solution, 1.0 to 1.1 equivalents of a caustic soda solution to an iron element, 1.5% by mass of a hexamethaphosphate soda in terms of a phosphorous element to an iron element, and 1.6% by mass of a silicate soda in terms of a silicon element to an iron element were mixed to prepare an aqueous solution containing ferrous hydroxide.

Maintaining an aqueous solution to pH 9, air was blown into the aqueous solution to initiate an oxidation reaction at a temperature of 82 to 95° C. Therefore, a slurry solution that produces a seed crystal was prepared.

Subsequently, a ferrous sulfate aqueous solution was added to the slurry solution with 0.9 to 1.2 equivalents to the original amount of alkali (sodium component of caustic soda). Then, the slurry solution was maintained to pH 8, and oxidation reaction was proceeded by blowing air therein. Thus the slurry solution that contains a magnetic iron oxide was obtained. After filtering and washing, this water-containing slurry solution was once taken out. At this time, a small amount of the water-containing sample was collected and the water content thereof was measured in advance. Subsequently, the water-containing sample was not dried but dispersed again in another water system medium, followed by adjusting pH of the dispersion solution to about 4.5 and, while sufficiently stirring the solution 2.0 parts of n-hexyl trimethoxysilane coupling agent was added with respect to 100 parts of magnetic iron oxide (the amount of magnetic iron oxide was calculated as a value obtained by subtracting the water content from the water-containing sample) to carry out hydrolysis. Then, pH of the dispersion solution was set to about 10, and a condensation reaction was performed to conduct coupling treatment. The generated hydrophobic magnetic substance was washed, filtered, and dried according to the conventional method. The resulting particles were sufficiently pulverized to obtain a spherical surface-treated magnetic substance 1 having an average particle size of 0.2 μm. The physical properties of the surface-treated magnetic substance 1 thus obtained are shown in Table 3.

<Production of Surface-treated Magnetic Substance 2>

A surface-treated magnetic substance 2 was prepared by the same way as that of the surface-treaded magnetic substance 1, except that the content of n-hexyltrimethoxy silane coupling agent was changed from 2.0 parts to 1.0 parts and washing times were extended. The physical properties of the surface-treated magnetic substance 2 thus obtained are shown in Table 3.

<Production of Surface-treated Magnetic Substance 3>

A surface-treated magnetic substance 3 was prepared by the same way as that of the surface-treaded magnetic substance 1, except that the content of n-hexyltrimethoxy silane coupling agent was changed from 2.0 parts to 0.62 parts. The physical properties of the surface-treated magnetic substance 3 thus obtained are shown in Table 3.

<Production of Surface-treated Magnetic Substance 4>

A surface-treated magnetic substance 4 was prepared by the same way as that of the surface-treaded magnetic substance 1, except that the content of n-hexyltrimethoxy silane coupling agent was changed from 2.0 parts to 2.6 parts. The physical properties of the surface-treated magnetic substance 4 thus obtained are shown in Table 3.

<Production of Surface-treated Magnetic Substance 5>

The surface-treated magnetic substance 1 was placed in toluene, and ultrasonic dispersion was performed for 30 minutes. After performing this treatment 3 times, it was filtered and dried according to the conventional method. The resulting particles were sufficiently pulverized to obtain a surface-treated magnetic substance 5. The physical properties of the surface-treated magnetic substance 5 thus obtained are shown in Table 3.

<Production of Surface-treated Magnetic Substance 6>

In a ferrous sulfate aqueous solution, 1.0 to 1.1 equivalents of a caustic soda solution to an iron element, 1.5% by mass of a hexamethaphosphate soda in terms of a phosphorous element to an iron element, and 1.5% by mass of a silicate soda in terms of a silicon element to an iron element were mixed to prepare an aqueous solution containing ferrous hydroxide.

Maintaining an aqueous solution to pH 9, air was blown into the aqueous solution to initiate an oxidation reaction at a temperature of 80 to 90° C. Therefore, a slurry solution that produces a seed crystal was prepared.

Subsequently, a ferrous sulfate aqueous solution was added to the slurry solution with 0.9 to 1.2 equivalents to the original amount of alkali (sodium component of caustic soda). Then, the slurry solution was maintained to pH 13, and oxidation reaction was proceeded by blowing air therein. The slurry solution that contains a magnetic iron oxide was obtained. After filtering and washing, this water-containing slurry solution was once taken out. At this time, a small amount of the water-containing sample was collected and the water content thereof was measured in advance. Subsequently, the water-containing sample was not dried but dispersed again in another water system medium, followed by adjusting pH of the dispersion solution to about 4.5 and, while sufficiently stirring the solution, 2.0 parts of n-hexyl trimethoxysilane coupling agent was added with respect to 100 parts of magnetic iron oxide (the amount of magnetic iron oxide was calculated as a value obtained by subtracting the water content from the water-containing sample) to carry out hydrolysis. Then, pH of the dispersion solution was set to about 10, and a condensation reaction was performed to conduct coupling treatment. The generated hydrophobic magnetic substance was washed, filtered, and dried according to the conventional method. The resulting particles were sufficiently pulverized to obtain an octahedral surface-treated magnetic substance 6 having an average particle size of 0.19 $\mu$m. The physical properties of the surface-treated magnetic substance 6 thus obtained are shown in Table 3.

<Production of Surface-treated Magnetic Substance 7>

Similar to the production of the surface-treated magnetic substance 1, oxidation reaction is proceeded, and after the completion of the oxidization reaction, the magnetic iron oxide fine particles thus produced were washed, filtered, and dried. Then, the particle aggregates were pulverized to obtain a magnetic substance. Subsequently, the magnetic substance was dispersed again in a watersystem medium and the pH of the dispersion solution was adjusted to about 4.5. While the solution was being stirred, 0.6 part of n-hexyl trimethoxysilane coupling agent was added with respect to 100 parts of magnetic iron oxide (the amount of magnetic iron oxide was calculated as a value obtained by subtracting the water content from the water-containing sample) to carry out hydrolysis. Then, pH of the dispersion solution was set to about 10, and a condensation reaction was performed to conduct coupling treatment. The generated hydrophobic magnetic substance was washed, filtered, and dried according to the conventional method. The resulting particles were sufficiently pulverized to obtain a surface-treated magnetic substance 7. The physical properties of the surface-treated magnetic substance 7 thus obtained are shown in Table 3.

<Production of Magnetic Substance 1>

Similar to the production of the surface-treated magnetic substance 1, oxidation reaction is proceeded, and after the completion of the oxidization reaction, the magnetic iron oxide fine particles thus produced were washed, filtered, and dried. Then, the particle aggregates were pulverized to obtain a magnetic substance 1'. The physical properties of the magnetic substance 1' thus obtained are shown in Table 3.

TABLE 3

| | TREATMENT AGENT/ ADDITIONAL AMOUNT | HYDRO-PHOBIC DEGREE | AMOUNT OF POLY-SILOXANE (PART BY MASS %) |
|---|---|---|---|
| SURFACE-TREATED-MAGNETIC SUBSTANCE 1 | n-hexyl-trimethoxy-silane = 2.0 | 82 | 0.16 |
| SURFACE-TREATED-MAGNETIC SUBSTANCE 2 | n-hexyl-trimethoxy-silane = 1.1 | 59 | 0.09 |
| SURFACE-TREATED-MAGNETIC SUBSTANCE 3 | n-hexyl-trimethoxy-silane = 0.62 | 44 | 0.09 |
| SURFACE-TREATED-MAGNETIC SUBSTANCE 4 | n-hexyl-trimethoxy-silane = 2.6 | 85 | 0.48 |
| SURFACE-TREATED-MAGNETIC SUBSTANCE 5 | n-hexyl-trimethoxy-silane = 2.0 | 81 | 0 |
| SURFACE-TREATED-MAGNETIC SUBSTANCE 6 | n-hexyl-trimethoxy-silane = 2.0 | 81 | 0.18 |
| SURFACE-TREATED-MAGNETIC SUBSTANCE 7 | n-hexyl-trimethoxy-silane = 0.6 | 30 | 0.10 |
| MAGNETIC SUBSTANCE 1' | none | 0 | 0 |

<2> Production of Conductive Fine Particle

<Production Example 1 of Conductive Fine Particle>

Zinc oxide fine particles containing aluminum elements and having a resistivity of 100 Ω·cm (a number average particle size of the primary particle is 0.1 $\mu$m, and composed of a coagulate of the primary particles having a particle size of aggregation of particles of 0.7 to 7 $\mu$m) were treated with 1% mass of hexamethyl silan, followed by a surface treatment with 1% by mass of dimethyl silicon oil. Then, the particles were pulverized after the surface treatment, Consequently, zinc oxide fine particles having a resistivity of 1,000 Ω·cm were obtained as conductive fine particles 1.

The conductive fine particles 1 had the number average particle size of 0.1 μm, and composed of coagulate of primary particles having a particle size of 1.3 μm. The conductive fine particles 1 were white, and permeability thereof was 37% when the permeability in the above wavelength band was measured using the light source with a wavelength of 740 nm and the product 310 T penetration type densitometer manufactured by X-Rite in accordance with exposure light having a wavelength of 740 nm of the laser beam scanner used for image exposure in the image forming apparatus used in this example.

The resistivity of the conductive fine particles was measured by applying a voltage of 100 V simultaneously with load application of 142.5 N (15 kg) between the upper and lower electrodes arranged above and below the fine particle sample after placing about 0.5 g of a fine particle sample in a cylinder having a bottom surface area of 2.26 $cm^2$. The resulting resistivity was normalized into a specific resistance.

The particle size distribution of the conductive fine particles was measured as follows. That is, a minute amount of the surfactant was added to 10 ml of pure water. Next, 10 mg of sample of the conductive fine particles was added therein, and was then dispersed by an ultrasonic dispersion machine (ultrasonic homogenizer) for 10 minutes. Then, the particle size distribution was measured using the LS-230 type laser diffraction type partlcle-size-distribution measuring apparatus (produced by Courter Co., Ltd.). The particle size of 0.04 to 2,000 μm was defined as the measurement range of the particle size. The measurement was performed once for 90 seconds. A major peak particle size in the particle size distribution on the volume basis to be obtained was defined as the particle size of the agglomerate.

The conductive fine particles were observed with a scanning electron microscope at magnitudes of 3,000 times and 30,000 times, respectively, for primary particles and the aggregated form.

<Production Example 2 of Conductive Fine Particle>

The same treatment was conducted as that in Production example 1 of the conductive fine particles except for the surface treatment with 5% by mass of dimethyl silicon oil without conducting the treatment using hexamethyl disilazane that was conducted in Production example 1 of the conductive fine particles. Thus, zinc oxide fine particles having a resistivity of 2500 Ω·cm were obtained as conductive fine particles 2.

<3> Production of Magnetic Toner

<Production Example of Magnetic Toner 1>

A water system medium containing dispersion stabilizer, which pH is 5.2, was prepared by introducing 450 parts of 0.1M-$Na_3PO_4$ aqueous solution and 19 parts of 1N hydrochloric acid into 720 parts of ion-exchanged water, followed by adding 67.7 parts of 1.0M-$CaCl_2$ aqueous solution.

| | |
|---|---|
| Styrene | 83 parts |
| n-butylacrylate | 17 parts |
| Saturated polyester resin | 5 parts |
| Negative charge controlling agent (mono-azo dye-based Fe compound) | 1 part |
| Surface-treated magnetic substance 1 | 80 parts |
| Divinylbenzene | 0.8 part |

The above-mentioned materials were mixed so that they were uniformly dispersed, by using Attritor (Mitsui Miike Kakoki K.K.) This monomer composition was heated at 60° C. Then, 10 parts of ester wax (maximum endothermic peak 72° C. in DSC) were added, mixed, and dissolved, followed by dissolving 5 parts of a polymerization initiator 2,2'-azobis (2,4-dimethylvaleronitrile).

The polymerization monomer system was supplied in the water system medium and was then stirred and granulated with a TK homomixer (Tokushu Kika Kogyo, Co., Ltd.) at 10,000 rpm for 15 minutes at 60° C. under $N_2$ atmosphere. After that, the mixture was reacted at 80° C. for 8 hours while stirring the mixture with a puddle stirring blade. After terminating the reaction, the suspension was cooled and hydrochloric acid was added to dissolve a dispersant at pH=2 or less, followed by filtering, washing, and drying to obtain the toner particle 1.

100 parts of the resulting toner particles, 1.0 part of hydrophilic silica fine particle having (BET value of 120 $m^2/g$ after treating with silicon oil, which is prepared by treating silica having a number average particle size of 12 nm with hexamethyl disilane), and 11.0 parts of the conductive fine particles were mixed by a Henschel Mixer (Mitsui Miike Kakoki K.K.) under conditions of 4,000 rpm for 2 minutes. As a result, the magnetic toner 1 having a weight average particle size of 7.3 μm was obtained. The physical properties of the magnetic toner 1 thus obtained are shown in Table 4.

<Production Example of Magnetic Toner 2>

Magnetic toner 2 was prepared by the same way as that of the magnetic toner 1, except that the surface-treated magnetic substance 1 was changed to the surface-treated magnetic substance 2. The physical properties of the magnetic toner 2 are shown in Table 4.

<Production Example of Magnetic Toner 3>

Magnetic toner 3 was prepared by the same way as that of the magnetic toner 1, except that the surface-treated magnetic substance 1 was changed to the surface-treated magnetic substance 3. The physical properties of the magnetic toner 3 are shown in Table 4.

<Production Example of Magnetic Toner 4>

Magnetic toner 4 was prepared by the same way as that of the magnetic toner 1, except that the surface-treated magnetic substance 1 was changed to the surface-treated magnetic substance 4. The physical properties of the magnetic toner 4 are shown in Table 4.

<Production Example of Magnetic Toner 5>

Magnetic toner 5 was prepared by the same way as that of the magnetic toner 1, except that the surface-treated magnetic substance 1 was changed to the surface-treated magnetic substance 4, and 1.1 parts of silicone oil was further added in the monomer composition. The physical properties of the magnetic toner 5 are shown in Table 4.

<Production Example of Magnetic Toner 6>

Magnetic toner 6 was prepared by the same way as that of the magnetic toner 1, except that the surface-treated magnetic substance 1 was changed to the surface-treated magnetic substance 5. The physical properties of the magnetic toner 6 are shown in Table 4.

<Production Example of Magnetic Toner 7>

Magnetic toner 7 was prepared by the same way as that of the magnetic toner 1, except of that the surface-treated magnetic substance 1 was changed to the surface-treated magnetic substance 6. The physical properties of the magnetic toner 7 are shown in Table 4.

<Production Example of Magnetic Toner 8>

Magnetic toner 8 was prepared by the same way as that of the magnetic toner 1, except that the surface-treated magnetic substance 1 was changed to the surface-treated magnetic substance 7. The physical properties of the magnetic toner 8 are shown in Table 4.

| | |
|---|---|
| Styrene | 65.0 parts |
| 2-ethylhexylacrylate | 35.0 parts |
| Divinylbenzene | 0.8 parts |
| magnetic substance 1' | 98.0 parts |
| Saturated polyester resin used in magnetic toner 1 | 5 parts |

The above-mentioned materials were mixed so that they were uniformly dispersed, by using an Attritor. This monomer composition was heated at 65° C. Then, 8 parts by mass of ester wax used for the production of the magnetic toner 1 and 4.5 parts of 2,2'-azobisisobutylonitrile were added and dissolved.

Subsequently, after heating 650 parts of the water system colloidal solutions of 4% by mass of tricalcium phosphate at 60° C., 216.3 parts of the polymerization monomer system were added. The mixture was emulsion-dispersed using the TK homomixer at 10,000 rpm for 3 minutes at a room temperature.

Subsequently, the mixture was continuously stirred under the nitrogen atmosphere for allowing the reaction for 10 hours at 80° C., and then the mixture was cooled to room temperature, resulting in a dispersion solution of magnetic toner particles.

Then, 14.0 parts of styrene, 5.0 parts of 2-ethylhexylacrylate, 0.9 part of azobisisobutylonitrile, 0.3 part of divinyl benzene, and 0.1 part of sodium lauryl sulfate were added in 20 parts of water. The mixture was dispersed using an ultrasonic homogenizer, resulting in a water emulsion.

This was dropped into the magnetic toner particle dispersion solution, and the particle was swollen. Then, the stirring was performed under the nitrogen atmosphere and the reaction was performed at 85° C. for 10 hours. Then, the suspension was cooled, washed, and filtered like in the case of the magnetic toner 1. Subsequently, pneumatic elutriation was performed, and the magnetic toner particle 9 was obtained.

100 parts of the resulting toner particle 9, 1.0 part of silica fine particle and 1.0 part of the conductive fine particle 1 used in the production of the magnetic toner 1 were mixed by the Henschel Mixer (Mitsui Miike Kakoki K.K.) under conditions of 4,000 rpm for 2 minutes. As a result, the magnetic toner 9 having a weight average particle size of 7.5 μm was obtained. The physical properties of the magnetic toner 9 are shown in Table 4.

| | |
|---|---|
| Styrene/n-butylacrylate/Divinylbenzene copolymer (mass ratio 78/22/0.6) | 100 parts |
| Saturated polyester resin | 5 parts |
| Negative charge controlling agent | 4 parts |
| Surface-treated magnetic substance 1 | 80 parts |
| Ester wax using production of magnetic toner 1 | 10 parts |

The above materials were mixed with the blender. Next, melt-kneading was carried out by the double spindle extruder heated at 110° C. The cooled kneaded product was roughly ground by a hammer mill, and the roughly ground product was pulverized with the jet mill. Then, pneumatic elutriation of the obtained pulverized product was carried out, and the magnetic toner particles 10 were obtained. To 100 parts of the resulting toner particle 10, 1.0 part of silica and 11.0 parts of the conductive fine particle were added and mixed by Henschel Mixer (Mitsui Miike Kakoki K.K.) under conditions of 4,000 rpm for 2 minutes. As a result, magnetic toner 10 having a weight average particle size of 7.3 μm was obtained. The physical properties of the magnetic toner 10 are shown in Table 4.

<Production Example of Magnetic Toner 11>

The magnetic toner particle 10 obtained by the production process of the magnetic toner 10 was processed using a hibridizer at 6,000 rpm for 3 minutes twice to obtain the magnetic toner particle 11. For 100 parts of the magnetic toner particle 11, 1.0 part of silica and 11.0 parts of conductive fine particle used in the production of the magnetic toner 1 were added and mixed using the Henschel mixer (Mitsui Miike Kakoki K.K.) under conditions of 4,000 rpm for 2 minutes to prepare a magnetic toner 11. The physical properties of the magnetic toner 11 are shown in Table 4.

| (Preparation of resin fine particle dispersion solution) | |
|---|---|
| Styrene | 330 parts |
| n-butylacrylate | 80 parts |
| Acrylic acid | 6 parts |
| Divinylbenzene | 2.3 parts |
| Dodecanethiol | 6 parts |
| Carbon tetrabromide | 4 parts |

The above components were mixed and dissolved and a desired solution was prepared.

In addition, 6 parts of non-ionic surfactant and 9 parts of anionic surfactant were dissolved in 550 parts of ion-exchanged water. The above solution was added and dispersed in a flask for emulsification by gently agitating and mixing the solution for 10 minutes while adding 50 parts of ion-exchanged water in which 5 parts of ammonium persulfate is being dissolved. Subsequently, after nitrogen substitution is made on the inside of the whole system, the resultant was heated up to 70° C. with an oil bath while being stirred in the flask. The emulsion polymerization is continued as it is for 5 hours. As a result, a dispersion solution 1 of an anionic resin fine particle is obtained having a center diameter of 160 nm, a glass transition point of 59° C., and Mw of 52,500.

| (Preparation of magnetic substance dispersion solution) | |
|---|---|
| Magnetic substance 1' | 160 parts |
| Nonionic surfactant | 10 parts |
| Ion-exchanged water | 400 parts |

These components were mixed and dissolved, followed by being dispersed by a homogenizer for 10 minutes to obtain a magnetic substance dispersion solution 1.

| (Preparation of release agent dispersion solution) | |
|---|---|
| Paraffin wax | 50 parts |
| Cationic surfactant | 5.2 parts |
| Ion-exchanged water | 200 parts |

The above components were heated at 98° C. under pressure, followed by sufficient dispersion with a pressure-injection type homogenizer to obtain the release agent dispersion solution 1 containing the release agent particle having a center diameter of 0.16 μm.

| (Production of toner) | |
|---|---|
| Resin fine particle dispersion solution 1 | 200 parts |
| Magnetic substance dispersion solution 1 | 283 parts |
| Release agent dispersion solution 1 | 64 parts |
| Poly aluminum chloride | 1.23 parts |

The above components were sufficiently mixed and dispersed using a homogenizer in a round flask made of stainless steel. After that, the resultant is heated up to 58° C. while being stirred in the flask with the oil bath, and the mixture was kept at 58° C. for 50 minutes. Furthermore, additional 10 parts of dispersion solution 1 of the resin fine particle was added in the mixture and gradually stirred.

Subsequently, after adjusting the inside of the system to pH 7.5 with aqueous sodium hydroxide (0.5 mol/l), the flask made of stainless steel was tightly closed while heating up to 85° C. with continued stirring. After that, the pH was lowered to 4.0 and the resultant was kept for 6 hours. After cooling and performing filtration and sufficient washing with ion-exchanged water after the completion of the reaction, a solid-liquid separation was performed using a Nutsche type suction filtration. Furthermore, the product was dispersed in ion-exchanged water (3 L) at 40° C. again and was then stirred and washed.

After repeating this washing operation 5 times, solid-liquid separation was performed with filtration. Subsequently, vacuum drying was continued for 12 hours and the magnetic particle 12 was obtained. To 100 parts of obtained magnetic particle 12, 1.0 part of silica used in the production of magnetic toner 1 and 1.0 part of the conductive fine particle 1 were added and mixed by Henschel Mixer (Mitsui Miike Kakoki K.K.) at 4,000 rpm for 2 minutes. As a result, magnetic toner 12 was prepared. The physical properties of the magnetic toner 12 are shown in Table 4.

The magnetizing intensity in the magnetic field (79.6 kA/m) of each magnetic toner described above is 24 to 28 $Am^2/kg$.

(Production Example of Magnetic Toner 13)

In order to lower the adhesive power of the conductive fine particles, in production example of magnetic toner 10, after obtaining the toner particle 10, silica with a number average primary particle size of 12 nm was treated with hexamethyldlsilazane, and it was treated with silicone oil after such a treatment. 1.0 part of the hydrophobic silica fine particle having a BET value after treatment of 120 $m^2/g$ and 1.0 part of the conductive fine particle 1 are mixed together using the Henschel Mixer (Mitsui Miike Kakoki K.K.) for 1 minute at 2.000 rpm to prepare the magnetic toner 13. The physical properties of the magnetic toner 13 are shown in Table 5.

(Production Example of Magnetic toner 14)

Magnetic toner 14 was prepared in the same way as that of the magnetic toner 13, except for the following formulation. That is, the formulation of the magnetic toner 34 was changed as follows: 1.0 part of hydrophobic silica is chaneged to 2.0 parts of hydrophobic silica; and 1.0 part of the conductive fine particle 1 is changed to 3.0 parts of the conductive fine particle 2. The physical properties of the magnetic toner 14 are shown in Table 5.

TABLE 4

| EXAMPLES OF PRODUCING TONER | MAGNETIC TONER | USED MAGNETIC SUBSTANCE | AVERAGE PARTICLE SIZE OF TONER | D4/D1 | AVERAGE CIRCULARITY DEGREE | MODE CIRCULARITY DEGREE | REVEATION RATE OF IRON COMPOUND (%) | σr/σs | FLOODABILITY INDEX OF Carr/FLUIDITY INDEX OF Carr | AMOUNT OF POLYSILOXANE [PART BY WEIGHT %] |
|---|---|---|---|---|---|---|---|---|---|---|
| 1 | 1 | 1 | 7.3 μm | 1.17 | 0.984 | 1.00 | 0.13 | 0.06 | 1.2 | 0.05 |
| 2 | 2 | 2 | 6.8 μm | 1.36 | 0.977 | 1.00 | 1.53 | 0.06 | 1.0 | 0.03 |
| 3 | 3 | 3 | 6.3 μm | 1.39 | 0.969 | 1.00 | 2.75 | 0.06 | 1.0 | 0.03 |
| 4 | 4 | 4 | 7.5 μm | 1.16 | 0.982 | 1.00 | 0.15 | 0.06 | 1.7 | 0.21 |
| 5 | 5 | 4 | 7.9 μm | 1.27 | 0.978 | 1.00 | 0.35 | 0.06 | 2.1 | 0.59 |
| 6 | 6 | 5 | 7.0 μm | 1.15 | 0.983 | 1.00 | 0.12 | 0.06 | 0.6 | 0 |
| 7 | 7 | 6 | 7.3 μm | 1.18 | 0.982 | 1.00 | 0.21 | 0.12 | 1.2 | 0.06 |
| 8 | 8 | 7 | 6.1 μm | 1.43 | 0.959 | 0.98 | 3.55 | 0.06 | 1 | 0.06 |
| 9 | 9 | 1' | 7.5 μm | 1.38 | 0.970 | 1.00 | 0.02 | 0.06 | 1.2 | 0.02 |
| 10 | 10 | 1 | 7.3 μm | 1.44 | 0.954 | 0.96 | 1.86 | 0.06 | 1.4 | 0.06 |
| 11 | 11 | 1 | 7.7 μm | 1.29 | 0.961 | 0.96 | 1.95 | 0.06 | 1.4 | 0.06 |
| 12 | 12 | 1' | 5.8 μm | 1.09 | 0.962 | 0.97 | 0.03 | 0.06 | 0.9 | 0.06 |

TABLE 5

| EXAMPLES OF PRODUCING TONER | MAGNETIC TONER | USED TONER PARTICLE | AMOUNT OF HYDROPHOBIC SILICA/CONDUCTIVE FINE PARTICLE [No.] | CONDITION FOR EXTERNALLY ADDING | FLOODABILITY INDEX OF Carr/FLUIDITY INDEX OF Carr |
|---|---|---|---|---|---|
| 13 | 13 | 10 | 1.0/1.0[1] | 2000 RPM 1 MIN. | 1.3 |
| 14 | 14 | 10 | 2/0/3.0[2] | 2000 RPM 1 MIN. | 1.3 |
| 10 (REFENRENCE) | 10 | 10 | 1.0/1.0[3] | 4000 RPM 2 MIN. | 1.3 |

Example 1

(Production of Photosensitive Member 1)

A photosensitive member 1 is formed of an aluminum cylindrical substrate of 30 mm in diameter. In addition, as shown in FIG. 6 and shown below, layers having the following configurations are laminated on the photosensitive member 1 through sequential dipping and coating to obtain the photosensitive member 1.

(1) Conductive coating layer: based on a phenol resin in which powders of titanium oxide and tin oxide were dispersed (15 μm in film thickness);

(2) Undercoating layer: based on modified nylon and copolymerized nylon (0.6 μm in film thickness);

(3) Charge generating layer: based on a butyral resin in which azo pigment having an absorption within long wavelength regions is dispersed (0.6 μm in film thickness);

(4) Charge transporting layer: based on a polycarbonate resin (molecular weight of 20,000 by the Ostwald viscosimetry) in which a triphenylamine compound having a hole transporting property was dissolved in a mass ratio of 8:10 (25 μm in film thickness);

(5) Charge injection layer; based on a photo-curing acrylic resin in which conductive tin oxide fine particle and a tetrafluoroethylene resin particle having a particle size of about 0.25 μm were dispersed (3.0 μm in film thickness). The contact angle with water was 95 degrees.

Used in measurement of the contact angle is a contact angle meter CA-X type produced by Kyowa Interface Science Co., Ltd. using pure water.

<Image Forming Apparatus>

As an image forming apparatus, the LBP-1760 device was modified and the same one as that shown in FIG. 4 of the above embodiment was used. The photosensitive member 1 was used as a photosensitive member 100 to be provided as an image bearing member.

In the photosensitive member, as a charging member, a charging roller 22 (243 mm in length and 12 mm in diameter) is used, which is elastic body. It is produced as follows. A foam urethane layer having an intermediate resistance and comprising a urethane resin, carbon black as conductive particles, a sulphidizing agent, a foaming agent, and so on was layered in the shape of a roller on a core metal (SUS roller of 264 mm in length and 6 mm in diameter). Furthermore, it was further subjected to cutting and polishing to make the shape and the surface of the roller uniform. Here, the charging roller 22 has a resistivity of 105 Ω·cm and a hardness of 30 degrees (Asker C hardness). In addition, when the charging roller surface was observed with the scanning electron microscope, the charging roller had an average cell diameter of about 100 μm, and a percentage of voids of 60%. The charging roller 22 is arranged such that it is brought into press contact with the photosensitive member 21 at a contact pressure of 40 g/cm while resisting the elasticity thereof. Here, n represents a charging-contact portion as the contact portion between the photosensitive member 21 and the charging roller 22. In this example, at the charging-contact portion n with the photosensitive member 21, the charging roller 22 is rotationally driven at a peripheral speed of 100% in the opposite direction (the direction which is opposite to the moving direction of the photosensitive member surface). That is, the surface of the charging roller 22 as a contact-charging member has a relative velocity difference in terms of a relative displacement velocity of 200% with respect to the surface of the photosensitive member 21. In addition, the conductive fine particles 3 were coated to the surface of the charging roller 22 so that a uniform coating is obtained at a coating amount of $1\times10^4/mm^2$.

Furthermore, the core metal 22*a* of the charging roller 2 is applied with a direct current voltage of −700 V as a charging bias from an electric source for applying a charging bias. Subsequently, after the charging, an image section is exposed to a laser beam to form an electrostatic latent image. At this time, the exposure conditions are set such that a dark section potential Vd=−620 V and a bright section potential VL=−120 V.

A gap between the photosensitive member drum and the developing sleeve is 150 μm. In addition, as a magnetic toner carrying member, a development sleeve is used. This developing sleeve comprises an aluminum cylinder (16 mm in diameter) with a blasted surface, a layer having the composition described below and having a film thickness of about 7 μm and a JIS center-line-average-roughness (Ra) of 1.0 μm. In this case, as a toner layer thickness regulating member, a blade made of urethane having a development magnetic pole of 85 mT (850 gausses), a free length of 0.70 mm and a thickness of 1.0 mm is brought into contact with the development sleeve at a leaner pressure of 39.2 N/m (40 g/cm).

| | |
|---|---|
| Phenol resin | 100 parts |
| Graphite | 90 parts |
| Carbon black | 10 parts |

Note that, the center line of the development magnetic pole was shifted by 5 degrees toward the upstream side from the line connecting the image bearing member and the center of the toner carrying member.

Next, as a developing bias, one having a direct current voltage Vdc of −440 V, an alternating current voltage to be superimposed of −0.7 kVpp, a frequency of 2500 Hz, and a ratio (t1/t2) of the time period of the electric field on the development side to the time period of the electric field on the retracting side of 1.50 is used. In addition, the peripheral speed of the development sleeve was 110 of speed (106 mm/sec) in the forward direction with reference to the peripheral speed (96 mm/sec) of the photosensitive member.

The maximum electric field intensity at this time was 4.0 V/μm. When the magnetic toner 1 was used, the value of the equation (1):[(frequency of the alternating current component of an alternating electric field)/(peripheral speed of a toner carrying member))×(maximum electric field intensity at the time of developing)] of the present invention was 94.3, and the value of the equation (2): [(frequency of the alternating current component of an alternating electric field/peripheral speed of toner carrying member)×(floodability index of Carr/the fluidity index of Carr)] of the present invention was 28.3.

As a transfer member 114, a transfer roller shown in FIG. 3 was used. In this case, the transfer roller is made of ethylene propylene rubber and has a volume resistivity of the conductive elastic layer of $10^8$ Ω·cm, a surface rubber hardness of 24 degrees, a diameter of 20 mm, and a contact pressure of 59 N/m (60 g/cm). In addition, the transfer roller rotates at an equal speed with respect to the peripheral speed (96 mm/sec) of the photosensitive member in the direction of X in FIG. 4 and a transfer bias is 1.4 kV (direct current) At first, a magnetic toner 1 is used. Under the environmental conditions of ordinary temperature and humidity (23° C., 60% RH), an intermittent printing test was performed on 6,000 sheets of printing medium with lattice patterns at a printing rate of 4%. Evaluations were performed on the image densities at an initial state and after endurance, the generation of fog on the solid white after continuously printing three sheets with solid black color, and uniformity of a halftone image after printing three sheets with solid black color, and light shielding. The printing medium used was a sheet of paper of 75 g/m$^2$. As a result, in the magnetic toner 1, high transfer properties can be shown during the endurance test, no substantial fog was observed on a non-imaging area, and a uniform halftone image was obtained without causing light shielding. The evaluation results are listed in Table 6.

The evaluation items described in Examples of the present invention and Comparative Examples and the judgement criteria therefor will be described below.

<Image Density>

An image density was measured by forming a solid image portion and measuring the image density of the solid image using a Macbeth reflection densitometer (manufactured by Macbeth Co., Ltd.).

<Uniformity of Halftone>

A judgment was made on the uniformity of halftone image after printing solid black images on three sheets of paper.

A: A clear image with excellent image uniformity;
B: A good image with slightly inferior image uniformity;
C: An image with an image quality involving no practical problem; and
D: An image having substantially less image uniformity, which is not preferable for practical use.

<Light Shielding>

A visual observation is performed with respect to a light shielding phenomenon (white speck) on a halftone image after printing three solid-black sheets.

A: No generation of light shielding;
B: A little light shielding occurred within an absolutely negligible range for a practical use;
C: light shielding occurred but practically allowable; and
D: Light shielding occurred significantly, practically unallowable.

<Fog>

After three sheets of solid black were printed out, a white image was outputted and the fog on the sheet of paper was measured. Evaluation was made according to the following criteria. Here, the measurement of fog was conducted using a REFLECTMETER MODEL TC-6DS produced by Tokyo Denshoku Co., Ltd. In this case, a filter used was a green filter and the fog was calculated by the following equation (16).

$$\text{Fog (Reflectance)(\%)} = \text{Reflectance (\%) of standard paper} - \text{Reflectance (\%) of non-image area of the sample} \quad (16)$$

The judgement criteria of fog were as follows.

A: Very good (less than 1.5%);
B: Good (1.5% or more, less than 2.5%);
C: Usual (2.5% or more, less than 4.0%); and
D: Bad (4% or more).

Examples 2 to 13

In these examples, magnetic toners 2 to 13 were used as toners. An image formation test and an endurance evaluation were conducted under the same conditions as those of Example 1, respectively. In each example, as a result, there was no problem in the initial image characteristics. In addition, no substantial problems existed until 6,000 sheets of paper were printed out. The results obtained under ordinary temperature and humidity are listed in Table 6.

Comparative Example 1

The magnetic toner 14 was used as toner. An image formation test and an endurance evaluation were conducted according to the method of image forming under the same conditions as those of Example 1. As a result, a decrease in image density, deterioration regarding fog and light shielding property, and so on occurred as the endurance test proceeded Furthermore, since the toner contaminated the charging member, the resulting image was of poor uniformity in its halftone. The results of evaluation obtained under ordinary temperature and humidity are listed in Table 6.

TABLE 6

| | USED TONER | VALUE OF EQUATION (2) OF THE PRESENT INVENTION | INITIAL STAGE | | | | AFTER ENDURANCE OF PRINTING | | | |
|---|---|---|---|---|---|---|---|---|---|---|
| | | | IMAGE DENSITY | FOG | HALFTONE UNIFORMITY | LIGHT SIELDING | IMAGE DENSITY | FOG | HALFTONE UNIFORMITY | LIGHT SIELDING |
| EXAMPLE 1 | 1 | 28.3 | 1.58 | A | A | A | 1.56 | A | A | A |
| EXAMPLE 2 | 2 | 23.6 | 1.52 | B | A | B | 1.48 | B | B | B |
| EXAMPLE 3 | 3 | 23.6 | 1.48 | C | B | B | 1.42 | C | B | C |
| EXAMPLE 4 | 4 | 40.1 | 1.49 | B | B | B | 1.45 | C | B | B |
| EXAMPLE 5 | 5 | 49.5 | 1.47 | C | B | B | 1.42 | C | B | C |
| EXAMPLE 6 | 6 | 14.2 | 1.53 | B | B | B | 1.48 | C | B | C |
| EXAMPLE 7 | 7 | 28.3 | 1.56 | A | A | B | 1.46 | B | A | B |
| EXAMPLE 8 | 8 | 25.9 | 1.39 | C | B | C | 1.25 | C | C | C |
| EXAMPLE 9 | 9 | 28.3 | 1.46 | A | A | A | 1.29 | C | B | C |
| EXAMPLE 10 | 10 | 23.6 | 1.45 | C | B | C | 1.34 | C | B | C |
| EXAMPLE 11 | 11 | 25.9 | 1.46 | B | B | B | 1.32 | B | B | C |
| EXAMPLE 12 | 12 | 21.2 | 1.45 | B | B | B | 1.33 | C | B | C |
| EXAMPLE 13 | 13 | 30.7 | 1.49 | B | B | B | 1.43 | B | B | C |
| COMPARATIVE EXAMPLE 1 | 14 | 70.8 | 1.41 | C | B | C | 1.28 | D | C | D |

Next, in order to determine the application range of the cleanerless system, the process speed was raised and the peripheral speed of a development sleeve was set to 110% of the speed (211 mm/sec) in the forward direction with respect to the peripheral speed (192 mm/sec) of the photosensitive member. Here, the same development conditions as those of Example 1 were applied.

Examples 14 to 26

In these examples, magnetic toners 1 to 5 and 7 to 14 were used as toners. An image formation test and an endurance evaluation were conducted under the above-mentioned conditions, respectively. In each example, as a result, there was no problem in the initial image characteristics. In addition, no substantial problems existed until 6,000 sheets of paper were printed out. The results of evaluation obtained under ordinary temperature and humidity are listed in Table 7.

Comparative Example 2

The magnetic toner 6 was used as the toner. An image formation test and an endurance evaluation were conducted according to the same image forming method as that of Example 15. As a result, a decrease in image density, deterioration regarding fog and light shielding property, and so on occurred as the endurance tests proceeded. Furthermore, since the toner contaminated the charging member, the resulting image was of poor uniformity in its halftone. The results of evaluation obtained under ordinary temperature and humidity are listed in Table 7.

TABLE 7

| | USED TONER | VALUE OF EQUATION (2) OF THE PRESENT INVENTION | INITIAL STAGE | | | | AFTER ENDURANCE OF PRINTING | | | |
|---|---|---|---|---|---|---|---|---|---|---|
| | | | IMAGE DENSITY | FOG | HALFTONE UNIFORMITY | LIGHT SIELDING | IMAGE DENSITY | FOG | HALFTONE UNIFORMITY | LIGHT SIELDING |
| EXAMPLE 14 | 1 | 14.2 | 1.53 | A | A | A | 1.51 | A | A | A |
| EXAMPLE 15 | 2 | 11.8 | 1.50 | B | B | B | 1.45 | B | B | C |
| EXAMPLE 16 | 3 | 11.8 | 1.45 | C | B | B | 1.43 | C | C | C |
| EXAMPLE 17 | 4 | 20.1 | 1.48 | B | C | B | 1.42 | C | C | B |
| EXAMPLE 18 | 5 | 24.9 | 1.43 | C | C | B | 1.39 | C | B | B |
| EXAMPLE 19 | 7 | 14.2 | 1.51 | A | A | A | 1.43 | B | B | C |
| EXAMPLE 20 | 8 | 13.0 | 1.42 | C | C | C | 1.31 | C | C | C |
| EXAMPLE 21 | 9 | 14.2 | 1.46 | A | A | A | 1.27 | B | B | C |
| EXAMPLE 22 | 10 | 11.8 | 1.42 | C | B | C | 1.35 | C | C | C |
| EXAMPLE 23 | 11 | 13.0 | 1.43 | B | B | B | 1.37 | B | B | C |
| EXAMPLE 24 | 12 | 10.7 | 1.43 | C | B | C | 1.40 | C | C | C |
| EXAMPLE 25 | 13 | 15.4 | 1.50 | B | B | B | 1.45 | B | B | C |
| EXAMPLE 26 | 14 | 35.5 | 1.37 | C | B | C | 1.30 | C | C | C |
| COMPARATIVE EXAMPLE 2 | 6 | 7.1 | 1.39 | C | B | C | 1.27 | D | C | D |

Example 27 and Comparative Examples 3 and 4

An evaluation on image formation was conducted in the same way as in Example 14, except that the magnetic toner 1 was used and the distance between the toner carrying member and the image bearing member (i.e., the distance S–D) was set to 80 μm, 210 μm, or 350 μm. Since the maximum electric field intensity differs when the distance between S–D changes, Vpp of the alternating current voltage to be applied onto the toner carrying member was changed as shown in Table 8. The results of evaluation on image formation are listed in Table 9.

As is evident from the table, when the distance S–D was 210 μm, an image without any problem was obtained during the endurance test. On the other hand, when the distance S–D was 80 μm, many fogs and irregularities were found on the resulting image at a level which is not preferable for practical use. Furthermore, when the distance S–D was 350 μm, the charge-amount adjusting member became saturated with the fogging toner as the endurance test proceeded. Inferior uniformity of halftone was observed presumably because the residual toner having passed therethrough contaminated the charging member.

TABLE 8

| | S-D DISTANCE [μm] | FREQUENCY [Hz] | Vpp (V) | DIRECT CURRENT VOLTAGE (V) | t1/t2 | MAXIMUM ELECTRIC FIELD INTENSITY (V/μm) |
|---|---|---|---|---|---|---|
| EXAMPLE 27 | 210 | 2500 | 1200 | −440 | 1.22 | 4.1 |
| COMPARATIVE EXAMPLE 3 | 90 | 2500 | 300 | −420 | 2.33 | 4.3 |
| COMPARATIVE EXAMPLE 4 | 350 | 2500 | 2400 | −440 | 1.12 | 4.1 |

TABLE 9

| | S-D | INITIAL STAGE | | | | AFTER ENDURANCE OF PRINTING | | | |
|---|---|---|---|---|---|---|---|---|---|
| | DISTANCE [μm] | IMAGE DENSITY | FOG | HALFTONE UNIFORMITY | LIGHT SIELDING | IMAGE DENSITY | FOG | HALFTONE UNIFORMITY | LIGHT SIELDING |
| EXAMPLE 27 | 210 | 1.50 | A | A | A | 1.48 | B | B | A |
| COMPARATIVE EXAMPLE 3 | 90 | 1.49 | D | C | C | 1.46 | D | D | C |
| COMPARATIVE EXAMPLE 4 | 350 | 1.53 | C | B | B | 1.48 | D | B | C |

Example 28 and Comparative Example 5

An evaluation on image formation was conducted in the same way as in Example 14, except that the magnetic toner 1 was used and the distance between the toner carrying member and the image bearing member (i.e., the distance S–D) was set to 150 μm. Note that Vpp and frequency of the alternating current voltage and the direct current voltage, which are applied to the toner carrying member, were changed as shown in Table 10. The results of evaluation on image formation are listed in Table 11.

In Examples 28 and 29, during the endurance test, images having no problem in practical use were obtained, respectively. In Comparative Example 5, on the other hand, probably, because of poor recovering ability of the residual toner, poor charging had occurred and the resulting image was of inferior uniformity. In Comparative Example 6, likewise, because of poor recovering ability of the residual toner, poor charging had occurred and the resulting image was of inferior uniformity.

Examples 30 to 35

An evaluation on image formation was conducted in the same way as in Example 1, except that the magnetic toner 1 was used, the distance between the toner carrying member and the image bearing member (i.e., the distance S–D) was set to 150 μm and the alternating current voltage was set to 2500 Hz and 700 Vpp, and the direct current voltage was set to −400 V, which are applied to the toner carrying member. In each of these examples, t1/t2 and the position of a development magnetic pole were discussed.

In the table, the position of a development magnetic pole is represented as ±0° when the development magnetic pole is located on the line connecting between the image bearing member and the center of the toner carrying member. The respective developing conditions are listed in Table 12, and the results of evaluations on the respective image formations are listed in Table 13, respectively.

TABLE 10

| | S-D DISTANCE [μm] | FREQUENCY [Hz] | Vpp (V) | DIRECT CURRENT VOLTAGE (V) | t1/t2 | MAXIMUM ELECTRIC FIELD INTENSITY (V/μm) | VALUE OF EQUATION (1) | VALUE OF EQUATION (2) |
|---|---|---|---|---|---|---|---|---|
| EXAMPLE 28 | 150 | 1500 | 650 | −430 | 1.6 | 3.7 | 26.3 | 8.5 |
| EXAMPLE 29 | 150 | 4600 | 1000 | −440 | 1.38 | 4.9 | 107.5 | 26.4 |
| COMPARATIVE EXAMPLE 5 | 150 | 1300 | 500 | −400 | 1.5 | 3.2 | 19.7 | 7.4 |
| COMPARATIVE EXAMPLE 6 | 150 | 5000 | 1100 | −440 | 1.33 | 5.3 | 125 | 28.4 |

TABLE 11

| | INITIAL STAGE | | | | AFTER ENDURANCE OF PRINTING | | | |
|---|---|---|---|---|---|---|---|---|
| | IMAGE DENSITY | FOG | HALFTONE UNIFORMITY | LIGHT SIELDING | IMAGE DENSITY | FOG | HALFTONE UNIFORMITY | LIGHT SIELDING |
| EXAMPLE 28 | 1.51 | B | B | B | 1.47 | C | B | C |
| EXAMPLE 29 | 1.41 | B | B | C | 1.34 | C | B | C |
| COMPARATIVE EXAMPLE 5 | 1.47 | C | C | C | 1.45 | D | D | C |
| COMPARATIVE EXAMPLE 6 | 1.53 | B | B | C | 1.24 | D | C | C |

TABLE 12

| | LOCATION OF DEVELOPMENT MAGNETIC POLE | FREQUENCY [Hz] | Vpp (V) | DIRECT CURRENT VOLTAGE (V) | t1/t2 | MAXIMUM ELECTRICAL FIELD INTENSITY (V/μm) | VALUE OF EQUATION (1) OF THE PRESENT INVENTION |
|---|---|---|---|---|---|---|---|
| EXAMPLE 30 | 5° upper | 2500 | 700 | −440 | 1 | 4.47 | 53 |
| EXAMPLE 31 | 5° upper | 2500 | 700 | −440 | 1.13 | 4.33 | 51.3 |
| EXAMPLE 32 | 5° upper | 2500 | 700 | −400 | 1.86 | 3.77 | 44.7 |
| EXAMPLE 33 | 5° upper | 2500 | 700 | −440 | 2.33 | 3.53 | 41.8 |
| EXAMPLE 34 | ±0° | 2500 | 700 | −400 | 1.5 | 4 | 47.4 |
| EXAMPLE 35 | 12° upper | 2500 | 700 | −440 | 1.5 | 4 | 47.4 |

What is claimed is:

1. A method of image forming comprising the steps of:

charging an image bearing member by applying a voltage on a charging member;

forming an electrostatic latent image while writing image information as the electrostatic latent image on the charged image bearing member;

developing the electrostatic latent image by a magnetic toner carried on a toner carrying member to thereby form a toner image; and transferring the toner image onto a recording medium, the step of charging being carried out such that the charging member and the image bearing member move in opposite directions to each other so as to a contact portion where the charging member and the image bearing member are brought into contact with each other, the step of developing including cleaning for recovering the toner remaining on the image bearing member without being transferred onto the recording medium in the step of transferring, as cleaning simultaneous with development, wherein:

the toner carrying member is provided with a layer thickness regulating member so as to contact therewith;

the image bearing member and the toner carrying member are arranged with a gap of 100 μm to 250 μm therebetween;

the magnetic toner includes toner particles containing at least a binder resin and a magnetic substance, and the conductive fine particles;

a maximum electric field intensity (V/μm) of an alternating electric field formed on the toner carrying member at the time of developing, a frequency (Hz) of an alternating current component of the alternating electric field, and a peripheral speed (mm/sec) of the toner carrying member satisfy a relationship represented by the following equation (1); and the frequency (Hz) of the alternating current component of the alternating electric field formed on the toner carrying member, the peripheral speed (mm/sec) of the toner carrying member, and a floodability index of Carr and a fluidity index of Carr for the magnetic toner satisfy a relationship represented by the following equation (2):

$$22 \leqq (\text{the frequency of the alternating current component of the alternating electric field/the peripheral speed of the toner carrying member}) \times (\text{the maximum electric field intensity at the time of developing}) \leqq 120; \text{ and} \quad (1)$$

$$8 \leqq (\text{the frequency of the alternating current component of the alternating electric field/the peripheral speed of the toner carrying member}) \times (\text{the floodability index of Carr/the fluidity index of Carr}) \leqq 50. \quad (2)$$

2. The method according to claim 1, wherein in the step of charging, the conductive fine particles contained in the magnetic toner are attached onto at least one of a contact portion between the charging member and the image bearing member, and a vicinity thereof in the step of developing, and the attached conductive fine particles are remained on the image bearing member and carried after the step of transferring, thereby intervening therebetween during the step of charging.

3. The method according to claim 1, wherein the gap between the toner carrying member and the image bearing member is 100 μm to 200 μm.

4. The method according to claim 1, wherein the maximum electric field intensity of the alternating electric field formed on the toner carrying member at the time of developing is 3.8 V/μm to 4.8 V/μm.

5. The method according to claim 1, wherein the frequency of the alternating current component of the alternating electric field formed on the toner carrying member is 1,600 Hz to 4,500 Hz.

6. The method according to claim 1, wherein the maximum electric field intensity (V/μm) of the alternating electric field formed on the toner carrying member at the time of developing, the frequency (Hz) of the alternating, current component of the alternating electric field, and the peripheral speed (mm/sec) of the toner carrying member satisfy a relationship represented by the following equation (3):

$$30 \leqq (\text{the frequency of the alternating current component of the alternating electric field/the peripheral speed of the toner carrying member}) \times (\text{the maximum electric field intensity at the time of developing}) \leqq 105. \quad (3)$$

7. The method according to claim 1, wherein the frequency (Hz) of the alternating current component of the alternating electric field formed on the toner carrying member, the peripheral speed (mm/sec) of the toner carrying member, the floodability index of Carr, and the fluidity index of Carr satisfy a relationship represented by the following equation (4):

$$8 \leqq (\text{the frequency of the alternating current component of the alternating electric field/the peripheral speed of the toner carrying member}) \times (\text{the floodability index of Carr/the fluidity index of Carr}) \leqq 35. \quad (4)$$

8. The method according to claim 1, wherein among the alternating current components of the alternating electric field formed on the toner carrying member, assuming that a time period during which the electric field is applied in a direction of injecting the magnetic toner is t1 and a time period during which the electric field is applied in a direction of pulling back the magnetic toner from the image bearing member is t2, t1 and t2 satisfy an equation (5):

$$1.10 \leqq t1/t2 \leqq 2.30. \quad (5)$$

9. The method according to claim 1, wherein among the alternating current components of the alternating electric field formed on the toner carrying member, assuming that a time period during which the electric field is applied in a direction of injecting the magnetic toner is t1 and a time period during which the electric field is applied in a direction of pulling back the magnetic toner from the image bearing member is t2, t1 and t2 satisfy an equation (6):

$$1.15 \leqq t1/t2 \leqq 1.80. \quad (6)$$

10. The method according to claim 1, wherein the toner carrying member has a fixed magnet having a plurality of poles inside a rotatable hollow cylindrical member.

11. The method according to claim 1, wherein a development pole of the magnet is shifted by 3° to 10° toward an upstream side from a line connecting between centers of the image bearing member and the toner carrying member.

12. The method according to claim 1, wherein the magnetic toner has a magnetizing intensity of 10 $Am^2/kg$ to 50 $Am^2/kg$ (emu/g) in a magnetic field of 79.6 kA/m (1,000 oersteds).

13. The method according to claim 1, wherein the magnetic toner has a weight average particle size of 3 $\mu$m to 12 $\mu$m.

14. The method according to claim 1, wherein the magnetic toner has a ratio of a weight average particle size/a number average particle size being 1.40 or less in a particle size distribution.

15. The method according to claim 1, wherein a value of the floodability index of Carr/the fluidity index of Carr is 0.8 to 2.0.

16. The method according to claim 1, wherein a valve of the floodability index of Carr/the fluidity index of Carr is 1.0 to 1.5.

17. The method according to claim 1, wherein the magnetic toner contains iron-containing particles exposed at a surface of the toner particles in a proportion of 0.05 to 3.00%.

18. The method according to claim 1, wherein the magnetic toner contains iron-containing particles exposed at a surface of the toner particles in a proportion of 0.05% to 1.50%.

19. The method according to claim 1, wherein the magnetic toner contains iron-containing particles exposed at a surface of the toner particles in a proportion of 0.05% to 1.00%.

20. The method according to claim 1, wherein the magnetic toner has an average circularity of 0.955 or more.

21. The method according to claim 1, wherein the magnetic toner has an average circularity of 0.970 or more.

22. The method according to claim 1, wherein the magnetic toner has a mode circularity of 0.99 or more.

23. The method according to claim 1, wherein a ratio of $\sigma r/\sigma s$ is 0.11 or less in a magnetic field of 79.6 kA/m (1,000 oersteds), wherein $\sigma s$ denotes a magnetizing intensity (saturation magnetization) of the magnetic toner, and $\sigma r$ denotes a residual magnetization.

24. The method according to claim 1, wherein the magnetic toner contains 0.01% to 0.2% by mass of polysiloxane compound in the toner particle.

25. The method according to claim 1, wherein the magnetic substance is subjected to a hydrophilic treatment with 0.5 to 5.0 parts by mass of a silane coupling agent, and is further subjected to a treatment with 0.05 to 0.40 part by mass of a polysiloxane compound, with respect to 100 parts by mass of the magnetic substance.

26. The method according to claim 1, wherein the magnetic toner has a resistivity of $10^9$ Ω·cm or less, and 0.2% to 10% by mass of conductive fine particles having a size smaller than a volume average particle size of the toner are contained, with respect to a total amount of the magnetic toner.

27. The method according to claim 26, wherein the conductive fine particles have a resistivity of $10^6$ Ω·cm or less.

28. The method according to claim 26, wherein the non-magnetic conductive fine particles are subjected to a surface treatment with a coupling agent or a lubricant.

* * * * *

UNITED STATES PATENT AND TRADEMARK OFFICE

CERTIFICATE OF CORRECTION

PATENT NO. : 6,879,793 B2
APPLICATION NO. : 10/463421
DATED : April 12, 2005
INVENTOR(S) : Tatsuhiko Chiba et al.

It is certified that error appears in the above-identified patent and that said Letters Patent is hereby corrected as shown below:

IN THE DRAWINGS, Sheet No. 1 of 6:
Figure 1, "PHOTOSENSEITIVE" should read --PHOTOSENSITIVE--.

COLUMN 1:
Line 19, "anyone" should read --any one--.

COLUMN 4:
Line 55, "Is" should read --is--.

COLUMN 7:
Line 54, "Image" should read --image--.

COLUMN 8:
Line 43, "It" should read --it--.

COLUMN 9:
Line 31, "Image" should read --image--.
Line 56, "Including" should read --including--.
Line 65, "includes," should read --includes--.

COLUMN 12:
Line 21, "aggregate" should read --aggregate.--.

COLUMN 13:
Line 10, "member))" should read --member)--.

COLUMN 16:
Line 23, "scientific" should read --Scientific--.
Line 35, "paraticle" should read --particle--.

COLUMN 17:
Line 25, "illustration" should read --illustration"--.
Line 27, "Japan)"." should read --Japan).--.

COLUMN 21:
Line 14, "Iron-containing" should read --iron-containing--.

UNITED STATES PATENT AND TRADEMARK OFFICE

CERTIFICATE OF CORRECTION

PATENT NO. : 6,879,793 B2
APPLICATION NO. : 10/463421
DATED : April 12, 2005
INVENTOR(S) : Tatsuhiko Chiba et al.

It is certified that error appears in the above-identified patent and that said Letters Patent is hereby corrected as shown below:

COLUMN 22:
Line 30, “particles-exposed” should read --particles exposed--.
Line 47, “etc” should read --etc.,--.
Line 58, “etc” should read --etc.,--.

COLUMN 23:
Line 1, “vise” should read --vice--.

COLUMN 24:
Line 41, “has high” should read --has a high--.

COLUMN 25:
Line 13, “ypropyltrimethoxysilane” should read --ypropyltrimethoxysilane,--.

COLUMN 26:
Line 21, “1 to 3.)” should read --1 to 3).--.
Line 40, “of-the” should read --of the--.

COLUMN 28:
Line 2, “oil” should read --oil,--.

COLUMN 29:
Line 51, “mesures” should read --measures--.

COLUMN 30:
Line 50, “washing,” should read --washing--.

COLUMN 31:
Line 6, “Is” should read --is--
Line 62, “etc,” should read --etc.,--.

COLUMN 32:
Line 5, “fine” should read --fin--.
Line 19, “calotimeter, preferred.” should read --calorimeter, is preferred.--.

COLUMN 33:
Line 14, “In” should read --in--.
Line 50, “p-ehtylstyrene:” should read --p-ethylstyrene;--.

UNITED STATES PATENT AND TRADEMARK OFFICE

CERTIFICATE OF CORRECTION

PATENT NO. : 6,879,793 B2
APPLICATION NO. : 10/463421
DATED : April 12, 2005
INVENTOR(S) : Tatsuhiko Chiba et al.

It is certified that error appears in the above-identified patent and that said Letters Patent is hereby corrected as shown below:

COLUMN 34:
Line 51, "butenedlol" should read --butenediol--

COLUMN 35:
Line 55, "containing," should read --containing--.
Line 67, "polyvlnyltoluene" should read --polyvinyltoluene--.

COLUMN 36:
Line 9, "styrene/dimethylamlnoethylmethacrylate" should read --styrene/dimethylaminoethylmethacrylate--.

COLUMN 38:
Line 54, "occurs." should read --occur.--.
Line 56, "Is" should read --is--; and "In" should begin a new paragraph.

COLUMN 39:
Line 13, "alumininum" should read --aluminum--.

COLUMN 40:
Line 63, "In" should read --in--.
Line 66, "facilicating" should read --facilitating--.

COLUMN 42:
Line 14, "ay" should read --may--.

COLUMN 44:
Line 2, "In" should begin a new paragraph.

COLUMN 46:
Line 34, "u24" should read --24--.

COLUMN 50:
Line 50, "dispesing" should read --dispersing--.

COLUMN 53:
Line 7, "Is" should read --is--.

COLUMN 58:
Line 2, "2-30" should read --2.30--.

UNITED STATES PATENT AND TRADEMARK OFFICE

CERTIFICATE OF CORRECTION

PATENT NO. : 6,879,793 B2
APPLICATION NO. : 10/463421
DATED : April 12, 2005
INVENTOR(S) : Tatsuhiko Chiba et al.

It is certified that error appears in the above-identified patent and that said Letters Patent is hereby corrected as shown below:

COLUMN 59:
Line 14, "surface-treaded" should read --surface-treated--.

COLUMN 61:
Line 29, "partlcle-size-distribution" should read --particle-size-distribution--.

COLUMN 63:
Line 4, --<Production Example of Magnetic Toner 9>-- should be inserted.
Line 50, --<Production Example of Magnetic Toner 10>-- should be inserted.

COLUMN 64:
Line 9, "hibridizer" should read --hybridizer--.
Line 18, --<Production Example of Magnetic Toner 12>-- should be inserted.

COLUMN 65:
Line 65, "(REFERNENCE)" should read --(REFERENCE)--.

COLUMN 66:
Line 14, "hexamethyldlsilazane" should read --hexamethyldisilazane--.
Line 24, "toner" should read --Toner--.
Line 29, "enged" should read --nged--.

COLUMN 68:
Line 35, "110 of" should read --110% of--.
Line 57, "current)" should read --current).--.

COLUMN 76:
Line 51, "alternating," should read --alternating--.

UNITED STATES PATENT AND TRADEMARK OFFICE

CERTIFICATE OF CORRECTION

PATENT NO. : 6,879,793 B2
APPLICATION NO. : 10/463421
DATED : April 12, 2005
INVENTOR(S) : Tatsuhiko Chiba et al.

It is certified that error appears in the above-identified patent and that said Letters Patent is hereby corrected as shown below:

COLUMN 77:
Line 47, "valve" should read --value--.

COLUMN 78:
Line 28, "particle." should read --particles.--.

Signed and Sealed this

Eighth Day of August, 2006

JON W. DUDAS
*Director of the United States Patent and Trademark Office*